US006965366B2

(12) United States Patent
Ozawa

(10) Patent No.: US 6,965,366 B2
(45) **Date of Patent: *Nov. 15, 2005**

(54) SYSTEM AND METHOD FOR DRIVING AN ELECTRO-OPTICAL DEVICE

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 508 days.

This patent is subject to a terminal disclaimer.

(21) Appl. No.: 09/860,637

(22) Filed: May 21, 2001

(65) Prior Publication Data

US 2002/0024511 A1 Feb. 28, 2002

(30) Foreign Application Priority Data

May 26, 2000 (JP) ..... 2000-156659
Dec. 1, 2000 (JP) ..... 2000-366962
Apr. 19, 2001 (JP) ..... 2001-121597

(51) Int. Cl.[7] ..... G09G 3/36
(52) U.S. Cl. ..... 345/89; 345/94; 345/208
(58) Field of Search ..... 345/87–100, 204, 345/690, 208–210

(56) References Cited

U.S. PATENT DOCUMENTS 5,302,966 A * 4/1994 Stewart ..... 345/76
6,335,778 B1 * 1/2002 Kubota et al. ..... 345/98
6,445,372 B1 * 9/2002 Asai ..... 345/99

FOREIGN PATENT DOCUMENTS

| | | |
|---|---|---|
| EP | 0 673 011 A1 | 9/1995 |
| EP | 0 673 012 A2 | 9/1995 |
| EP | 0 730 258 A1 | 9/1996 |
| EP | 0 782 124 A1 | 7/1997 |
| EP | 0 848 369 A2 | 6/1998 |
| FR | 2 772 501 | 6/1999 |
| JP | 58-196582 | 11/1983 |
| JP | 02-240687 | 9/1990 |
| JP | 06-095071 | 4/1994 |
| JP | 08-194205 | 7/1996 |
| JP | 08-234703 | 9/1996 |
| JP | 09-237058 | 9/1997 |
| JP | 11-326874 | 11/1999 |
| JP | 2002-116742 | 4/2002 |
| WO | WO 99/42983 | 8/1999 |

* cited by examiner

*Primary Examiner*—Regina Liang
(74) *Attorney, Agent, or Firm*—Oliff & Berridge, PLC

(57) ABSTRACT

An electro-optical driving device for providing a high-quality display that is free from non-uniformities. Subpixels 120*a*, 120*b*, and 120*c* are arranged at the respective intersections of 3m scanning lines 112 that extend in the X direction and n data lines 114 that extend in the Y direction. The subpixels 120*a*, 120*b*, and 120*c* are adjacent in the Y direction and are grouped together as a pixel 120 in a driving operation. In a first mode, the subpixels forming the one pixel are individually turned on and off in response to gray scale data indicating the gray scale of the pixel. In a second mode, the subpixels forming the one pixel are supplied with a common voltage in response to the gray scale data indicating the gray scale of the pixel. In this way, the signal supplied to the data lines is binary regardless of the first mode or the second mode.

36 Claims, 33 Drawing Sheets

< Mode = High >

SYSTEM AND METHOD FOR DRIVING AN ELECTRO-OPTICAL DEVICE

BACKGROUND OF THE INVENTION

1. Field of Invention

The present invention relates to a method for driving an electro-optical device presenting a high-quality gray scale display, a driving circuit for driving the electro-optical device, the electro-optical device, and electronic apparatus.

2. Description of Related Art

The electro-optical devices refer to devices that present a display by means of an electro-optical change in an electro-optical material, such as a liquid crystal, an electroluminescence, a phosphor, a gas, etc. For example, a liquid-crystal device employing the liquid crystal can have following construction. Conventional liquid-crystal devices include a matrix of pixel electrodes, an element substrate having switching elements respectively connected to the pixel electrodes, a counter substrate having a counter electrode opposed to the pixel electrodes, and a liquid crystal as an electro-optical material encapsulated between the two substrates.

In this arrangement, a switching element becomes conductive when applied with a scanning signal at an on level through a scanning line. When a pixel electrode is applied with a voltage signal responsive to a gray scale through a data line with the switching element in an on state, the capacitor of a liquid crystal sandwiched between the pixel electrode and the counter electrode stores charge responsive to the voltage signal. Even when the switching element is turned off subsequent to charge storage, the accumulated charge in the liquid crystal is maintained by the capacitance of the liquid crystal itself and a storage capacitor. Each switching element is driven in this way and the stored charge is controlled in response to the gray scale. The orientation state of the liquid crystal changes accordingly, causing a density to change in each pixel, and thereby presenting a gray scale display.

SUMMARY OF THE INVENTION

Since the voltage signal applied to the data line is a voltage responsive to the gray scale, namely, an analog signal, the display can be subject to a nonuniformity due to unevenness in element characteristics and wiring resistance.

In one technique called "area gray scale method", a single pixel is split into a plurality of subpixels and the subpixels are turned on and off to present a gray scale display. Since the subpixels are simply turned on and off in the area gray scale method, the voltage signal applied to the data line is binary. The use of the binary signal is less subject to display nonuniformity resulting from unevenness in the element characteristics and wiring resistance. However, in the area gray scale method, the number of gray scale levels is $2^k$ when a single pixel is split into k subpixels, and a display of gray scale levels larger than $2^k$ is not possible.

Accordingly, the present invention has been developed, and it is an object of the present invention to provide an electro-optical device which switches as appropriate between a display using an area gray scale method and a display of multi-level gray scale having a number of gray scale levels grater than the number of gray scale levels defined by the number of split subpixels. It is also an object of the present invention to provide a driving method for driving the electro-optical device, a driving circuit for driving the electro-optical device, an electro-optical device, and electronic apparatus.

The present invention in one embodiment relates to a driving method for driving an electro-optical device in which subpixels are arranged at each of the intersections of scanning lines running in the direction of rows and data lines running in the direction of columns and the subpixels adjacent to each other are grouped as a single pixel in the driving thereof. The driving method includes the steps of turning on and off each subpixel of the single pixel in response to gray scale data indicating the gray scale of the pixel in a first mode, and presenting common gray scale on the subpixels of the single pixel in response to the gray scale data for the pixel in a second mode.

In accordance with the driving method, a display using the area gray scale method in response to the on and off state of the subpixel is performed on the pixel in the first mode. In the second mode, a gray scale display is presented with the subpixels constituting the single pixel having the same density. For this reason, the number of gray scale levels in the second mode is not dependent on the number of subpixels constituting a single pixel. When a picture presenting a moving object or a landscape is displayed, the second mode may be selected and a display with many more number of gray scale levels may be enjoyed. A separate determination mechanism may be employed to select between the first mode and the second mode, by accounting for a variety of conditions (including the quality of an image, the remaining power in a battery, and the state of operation), or a user may manually select between the first mode and the second mode.

In the driving method of the electro-optical device, in the first mode, the subpixel at an intersection of a selected scanning line is preferably turned on and off in response to a corresponding bit of the gray scale data of the pixel including the subpixel. In the first mode, the subpixel is supplied with a bit indicating on or off operation, namely, a binary signal, and the electro-optical device is less subject to the effect of unevenness in element characteristics and wiring resistance. When a picture having no or little moving object is presented, or pixels in a wide area are presented at the same gray scale level, a high-quality display free from non-uniformities is presented by selecting the first mode.

In the first mode, the subpixels constituting the single pixel preferably maintain, and are turned on and off in response to, corresponding bits of the gray scale data indicating the gray scale of the pixel. This arrangement eliminates the need for regularly refreshing the subpixels. A subpixel having no change in the on/off state thereof needs no refreshing the storage content of the corresponding bit. Power consumption is thus reduced.

In the first mode, the subpixels are preferably turned off regardless of the maintained bits thereof, and thereafter the subpixels are turned on and off in response to the maintained bits. After the display content of the subpixels is reset to an off state, the subpixels are turned on again or are continuously on. Specifically, the subpixels in the on and off states are refreshed in response to the maintained bits.

When the subpixel is turned on, preferably, the subpixel is first turned off, and thereafter the on polarity of the subpixel is inverted with respect to a reference level. In this way, the alternating driving method for driving the subpixels is performed taking advantage of a timing at which the subpixels are turned off.

In a driving method for driving an electro-optical device, in the second mode, the subpixel at an intersection of a selected scanning line is preferably supplied, through the data line, with a timing signal for sampling a time-varied voltage at a timing corresponding to the gray scale data of the pixel including the subpixel. In the second mode, the signal supplied to the data line is binary for simply giving an instruction for sampling, and a high-quality display is thus presented as in the first mode.

In the driving method for driving an electro-optical device, in the first mode, the scanning lines are selected on a line by line basis, and in the second mode, the scanning lines are preferably selected on a plurality of lines at a time basis with the number of the plurality of lines equal to the number of subpixel constituting the pixel when subpixels grouped as a single pixel are adjacent to each other in the column direction, and the scanning lines are selected on a line by line basis when subpixels grouped as a single pixel are adjacent to each other in the row direction. In any case, the polarity of the voltage supplied to the subpixel is preferably inverted with respect to a reference level each time the scanning line is preferably selected. In this arrangement, the generation of flickering is controlled because writing characteristics of the single pixel containing the subpixels are inverted each time the scanning line is selected.

The present invention in another embodiment relates to a driving circuit for driving an electro-optical device in which subpixels are arranged at each of the intersections of scanning lines running in the direction of rows and data lines running in the direction of columns and the subpixels adjacent to each other are grouped as a single pixel in the driving thereof. The driving circuit includes a scanning line driving circuit which selects the scanning lines on a line by line basis in a first mode, while in a second mode selecting the scanning lines on a line by line basis or on a plurality of lines at a time basis with the number of the plurality of lines equal to the number of subpixels constituting the single pixel. The driving circuit can further include a data line driving circuit which supplies the subpixel, at an intersection of a scanning line selected by the scanning line driving circuit, through the data line, with a signal for an on or off operation in response to a corresponding bit of gray scale data of the pixel including the subpixel in the first mode, while in the second mode, supplying the subpixel at the intersection of the selected scanning line, through the data line, with a timing signal for sampling a time-varied voltage at a timing corresponding to the gray scale data of the pixel including the subpixel. As in the previously described driving method, this driving method presents a high-quality display free from nonuniformity in the first mode, while a display with many more number of gray scale levels is enjoyed in the second mode.

The driving circuit preferably includes an enable circuit for disabling the selection of the scanning line in the first mode when there is no change in the on/off state in the subpixel corresponding to the scanning line selected by the scanning line driving circuit. With the selection of the scanning line disabled by the enable circuit, power consumption is reduced accordingly.

The present invention in yet another embodiment relates to a driving circuit for driving an electro-optical device which selects, through a scanning line, a sub-pixel arranged at each of the intersections of scanning lines running in the direction of rows and data lines running in the direction of columns and groups mutually adjacent subpixels as a single pixel to cause the pixel to present a display. In this embodiment, the scanning lines are selected on a line by line basis in a first mode, while in a second mode the scanning lines are selected on a plurality of lines at a time basis with the number of the plurality of lines equal to the number of subpixels constituting the single pixel. The arrangement provides a scanning line driving circuit for appropriately selecting the scanning lines in accordance with the first mode or the second mode.

The driving circuit preferably includes a shift register for successively outputting a pulse signal, and a logic circuit which controls the pulse width of the pulse signal in the first mode so that the pulses of the pulse signal do not overlap each other. In the second mode, the logic circuit controls the pulse width of the pulse signal to be wider than the pulse width of the pulse signal that is controlled to select the scanning lines on a line by line basis, wherein the logic circuit outputs one of the controlled pulse signals to the scanning line to be selected. This arrangement eliminates the need for a particular control signal and allows the scanning line appropriately to be selected in accordance with the mode.

Shift registers are typically fabricated of multi-stages of latch circuits, each shifting an input signal. In this construction, as the resolution of the display increases, the number of stages of latch circuits increases, high-speed performance is required of the shift register, and power consumption accordingly increases. The driving circuit for selecting the scanning lines preferably includes a shift register for successively outputting a pulse signal, and a logic circuit which splits the pulse signal in the axis of time in the first mode so that the pulses of the pulse signal do not overlap each other, while, in the second mode, controlling the pulse widths of the pulse signal so that the pulses of the pulse signal do not overlap each other, and the logic circuit outputs one of the split pulse signal and the controlled pulse signal to the scanning line to be selected. Since the single pulse signal is split in the time axis to be supplied to the scanning lines in this arrangement, the number of stages of latch circuits is decreased, thereby reducing power consumption.

The present invention, in still another embodiment, relates to a driving circuit for driving an electro-optical device which drives, through a data line, a sub-pixel arranged at each of the intersections of scanning lines running in the direction of rows and data lines running in the direction of columns and groups mutually adjacent subpixels as a single pixel to cause the pixel to present a display. In a first mode, the subpixel at an intersection of a selected scanning line is supplied, through a data line, with a signal indicating an on/off operation in response to a corresponding bit of the gray scale data of the pixel including the subpixel. In a second mode, the subpixel at the intersection of the selected scanning line is supplied, through the data line, with a timing signal for sampling a time-varied voltage at a timing corresponding to the gray scale data of the pixel including the subpixel. The arrangement provides a data line driving circuit for appropriately supplying a data line with a binary signal in accordance with the first mode or the second mode.

The driving circuit preferably includes a first circuit for outputting a signal indicating an on/off operation in response to a corresponding bit of the gray scale data of the pixel including the subpixel at the intersection of the selected scanning line, a second circuit for outputting a signal that becomes active for a period corresponding to the gray scale data of the pixel including the subpixel at the intersection of the selected scanning line. The driving circuit also includes a selector which selects a signal from the first circuit in the first mode, while selecting a signal from the second circuit in the second mode, and the selector supplies the data line corresponding to the subpixel with the selected signal. With this arrangement, the selector selects the signal from the first circuit in the first mode while selecting the signal from the second circuit in the second mode. The selector thus supplies the data line with the signal from the first circuit or the second circuit.

The present invention, in still another embodiment, relates to an electro-optical device in which subpixels are arranged at each of the intersections of scanning lines running in the direction of rows and data lines running in the direction of columns and the subpixels adjacent to each other are grouped as a single pixel to cause the pixel to present a display, wherein each subpixel in a single pixel is turned on and off in response to a corresponding bit of gray scale data of the pixel including the subpixel in a first mode and the subpixels forming the single pixel present common gray scale in response to the gray scale data indicating the gray scale of the pixel in a second mode. As similarly described in the above driving method and driving circuit, this electro-optical device presents a high-quality display free from nonuniformity in the first mode, while a display with many more number of gray scale levels is enjoyed in the second mode.

The electro-optical device preferably includes a first signal line which is applied with a voltage for turning on the subpixel in the first mode while being applied with a time-varied voltage in the second mode, and a second signal line which is applied with a voltage for turning off the subpixel in at least the first mode, wherein the subpixel includes a first switch which is turned on and off in response to a signal supplied to a corresponding scanning line, a storage element for storing the content corresponding to the signal level at a corresponding data line when the first switch is turned on, a second switch which selects between the first signal line and the second signal line in response to the storage content of the storage element in the first mode, while sampling, in the second mode, the voltage applied to the first signal line at the timing of the gray scale data of the one pixel of the subpixels during the on period of the first switch, and a subpixel electrode applied with the voltage selected or sampled by the second switch. With this arrangement, the subpixel electrode is applied with the voltage for turning on or off the subpixel in accordance with the storage content in the storage element in the first mode even with the first switch turned off. The subpixel needs to be refreshed only when the display content changes. A high-quality display is thus presented with reduced power consumption.

In the electro-optical device, each subpixel preferably includes a storage capacitor for storing the voltage applied to the subpixel electrode. With this arrangement, the voltage applied to the subpixel electrode is prevented from leaking in the second mode.

With the storage capacitor incorporated, the storage capacitor is preferably configured with one terminal thereof connected to the subpixel electrode and with the other terminal thereof connected to a constant-potential signal line. With this arrangement, the storage capacitor holds a voltage between the constant-potential signal line and the pixel electrode regardless of the mode.

The second signal line is preferably applied with a voltage for turning off the subpixel even in the second mode, and is used as the constant-potential signal line. With this arrangement, any additional wiring for commonly connecting the storage capacitor is not required, and the construction of the device is simplified accordingly.

As described above, the subpixels constituting one pixel are applied with a common voltage in the second mode, but the areas of the subpixels constituting the one pixel are different from each other. For this reason, the storage capacitors of the subpixels in the same pixel are different from each other in required storage characteristics, and the storage capacitor preferably accounts for the area of the corresponding subpixel.

Preferably, the storage element includes a single capacitor, and is supplied across the two terminals thereof with voltages having mutually opposite signal levels in the first mode. With this arrangement, even if there is a change in the storage content in the storage capacitor of the storage element in the first mode, charge simply moves between the electrodes of the storage capacitor. Accordingly, no power is additionally consumed, and capacitance required of the capacitor is small.

The storage element of the electro-optical device may include two capacitors which store mutually opposite charges in the first mode, and the one-side electrodes of the two capacitors are together connected to a constant-potential signal line. With this arrangement, even if there is a change in the storage content in the two storage capacitors of the storage element in the first mode, charge simply moves between the two storage capacitors via the second signal line having the constant potential. Accordingly, no power is additionally consumed by the device.

When the storage element includes two capacitors, preferably, the second signal line is applied with a voltage for turning off the subpixel even in the second mode, and is used as the constant-potential signal line. With this arrangement, the two capacitors are connected together, requiring no separate wiring, and thereby leading to a simplified construction.

The subpixel of the electro-optical device preferably includes a logic element for controlling the second switch, wherein a first supply line for supplying the logic element with a low voltage of a power source and a second supply line for supplying the logic element with a high voltage of the power source are alternately arranged in the direction parallel with the scanning line or the data line. In this arrangement, the power source of the logic element contained in the subpixel is provided by alternately arranged supply lines for high voltage power source and low voltage power source. There is no need for arranging two supply lines for each subpixel. The construction of the device is thus simplified.

The first switch in the electro-optical device is preferably of a complementary element. When the first switch is of one type channel transistor, the voltage applied to the scanning line needs to be set accounting for the threshold voltage thereof. The use of the complementary type element requires no such consideration.

Similarly, the second switch is preferably of a complementary element. When the second switch is of one type channel transistor, the voltage applied to the scanning line needs to be set accounting for the threshold voltage thereof. The use of the complementary type element requires no such consideration.

Both the first switch and the second switch are preferably of a complementary element. With this arrangement, the voltages applied to the scanning line and the data line have binary voltage levels common to both lines, and load on the power source is lightened.

The electro-optical device includes a display refresh control line provided at each row for supplying a refresh command signal for refreshing the on and off state of the subpixel in the first mode, and a signal line which is provided at each row and supplied with an off voltage signal for turning off the subpixel when the refresh command is given, or with an on voltage signal for turning on the subpixel when the refresh command is not given in the first mode while, in the second mode, being supplied with a time-varied ramp voltage signal when a corresponding row scanning line is selected, wherein the subpixel includes a third switch configured with one terminal thereof connected to the data line of a corresponding column, and turned on when the scanning line on a corresponding row is selected, a storage element for storing a signal level at the other terminal of the third switch, a fourth switch configured with one terminal thereof connected to the signal line at the corresponding row and turned on and off in response to the signal level at the other terminal of the third switch, a fifth switch configured with one terminal thereof connected to the signal line at the corresponding row and turned on when the refresh command is given to the corresponding row, and a subpixel electrode commonly connected to the other terminals of the fourth switch and the fifth switch. The arrangement is as preferable as the arrangement having the first and second switches. With this arrangement, when a given row is selected in the first mode, the third switch is turned on in the subpixel on that row, the signal level supplied to the data line on the corresponding column is stored in the storage element. When a command for turning on or off the subpixel is issued, the fifth switch is turned on and the subpixel electrode is applied with an off voltage signal supplied to the signal line on the corresponding row. When the third switch and the fifth switch are turned off thereafter, the fourth switch is turned on or off in response to the storage content in the storage element. The subpixel electrode is again applied with the on voltage signal, or is continuously applied with the off voltage signal. In its on or off state, the subpixel is refreshed depending on the maintained bit. The subpixel having no change in the on or off state thereof requires no rewriting on the storage content held by the storage element, and power consumption is reduced accordingly. In the second mode, the fourth switch samples the ramp voltage signal in response to the signal level of the corresponding data line, thereby supplying the subpixel electrode with the sampled voltage. The device thus easily presents a multi-gray scale display.

Each subpixel preferably includes a storage capacitor for storing a voltage applied to the subpixel electrode in order to prevent the voltage applied to the subpixel electrode from being leaked in the second mode in the arrangement with the third, fourth, and fifth switches incorporated.

Electronic apparatus of another embodiment of the present invention includes the above-referenced electro-optical device. The electronic apparatus thus presents a high-quality display free from nonuniformity in the first mode, while presenting a display of many more gray scale levels.

BRIEF DESCRIPTION OF THE DRAWINGS

The invention is described in detail with regard to the following Figures, wherein like numerals reference like elements, and wherein:

FIG. 1(*b*) is a cross-sectional view of the electro-optical device taken along line A–A';

DETAILED DESCRIPTION OF PREFERRED EMBODIMENTS

An electro-optical device of a first embodiment of the present invention will now be discussed. The electro-optical device is a type-type liquid-crystal device employing a liquid crystal as an electro-optical material and presents a predetermined display by means of an electro-optical change in the liquid crystal. In the electro-optical device, each pixel is composed of three subpixels. As will be discussed in greater detail below. The electro-optical device presents a display using the area gray scale method based on the three subpixels in a first mode, while presenting a display of the same density on the three subpixel in a second mode.

Figure 1:
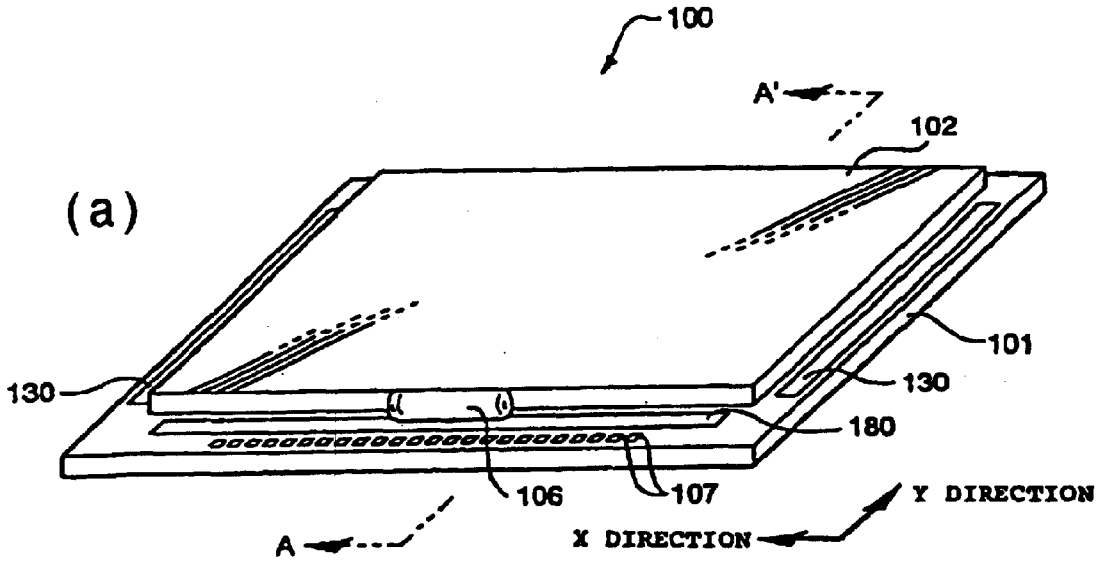
FIG. 1(*a*) is a perspective view showing the external appearance of the electro-optical device of a first embodiment of the present invention.
Figure 1:
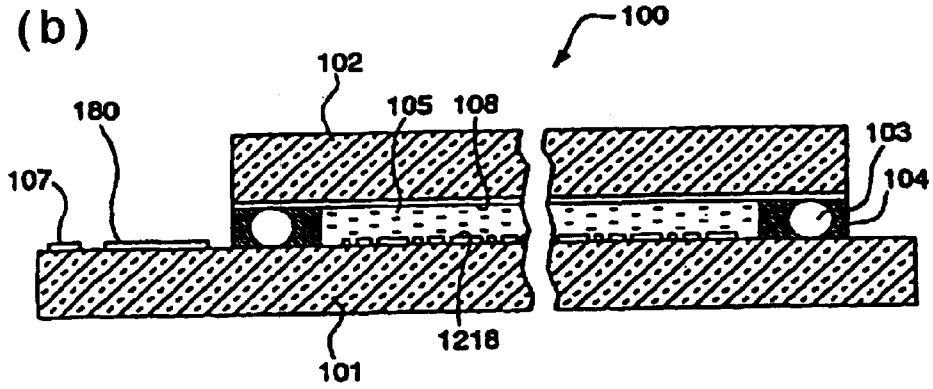

FIG. 1(*a*) is a perspective view showing an electro-optical device 100, and FIG. 1(*b*) is a cross-sectional view of the electro-optical device 100 taken along line A–A' in FIG. 1(*a*). As shown, the electro-optical device 100 includes an element substrate 101 having a variety of elements, subpixel electrodes 1218 formed thereon, and a counter substrate 102 having a counter electrode 108. The element substrate 101 and the counter substrate 102 are bonded together with a sealing member 104 containing spacers 103 interposed therebetween to keep a predetermined gap therebetween so that the electrode bearing surfaces thereof face each other. A liquid crystal 105 such as of TN (Twisted Nematic) as an electro-optical material is encapsulated in the gap between the two substrates. As discussed in greater detail below, three subpixel electrodes 1218 correspond to a single pixel. To present a gray scale display based on the area gray scale method in the first mode, the ratio of areas of the three subpixel electrodes 1218 is set to be approximately 1:2:4.

In this embodiment, the element substrate 101 employs glass, semiconductor, or quartz. Alternatively, an opaque substrate may be used for the element substrate 101. However, when the element substrate 101 employs an opaque substrate, the device can be used as a reflective type rather than as a transmissive type. The sealing member 104 is formed on the peripheral edge of the counter substrate 102, and has an opening to introduce the liquid crystal 105 therethrough. After encapsulating the liquid crystal 105, the opening is closed with a seal material 106.

A data line driving circuit 180 is formed on the element substrate 101 on one side external area thereof outside the sealing member 104 on the opposing surface thereof. A plurality of mount terminals 107 are formed on the one side external area of the element substrate 101 to receive a variety of signals from external circuits.

Scanning line driving circuits 130 are formed on two side areas on both sides of the first side area on the element substrate 101. If a delay in scanning signals supplied to scanning lines is not a primary concern, the scanning line driving circuits 130 may alternatively be formed on one side area only. Wiring (not shown) commonly used to the two scanning line driving circuits 130 is formed on the remaining one side area. Circuits and elements formed on the peripheral areas of the element substrate 101, such as the scanning line driving circuits 130 and the data line driving circuit 180, are produced in the same process for producing thin-film transistors (hereinafter referred to as "TFT") forming the subpixels. If the peripheral circuits are built in on the element substrate 101, and if the elements are produced in the same process, compact and low-cost design is achieved more than in an electro-optical device of the type that is constructed of peripheral circuits on external and separate boards.

The counter (common) electrode 108 formed on the counter substrate 102 has a conductive material such as a silver paste deposited at least one of the four corners on the bonding area thereof with the element substrate 101. Through the conductive material, the counter electrode 108 is electrically connected to the mount terminal 107 formed on the element substrate 101.

Although not shown, a color layer (a color filter) can be arranged as necessary on an area of the counter substrate 102 facing the subpixel electrodes 1218. However, when the electro-optical device is used as a projector in color modulation applications, as discussed in greater detail below, the color filter is not needed on the counter substrate 102. Regardless of whether or not the color layer is mounted, the counter substrate 102 is provided with a light shield layer (not shown) on the area thereof other than the regions thereof facing the subpixel electrodes 1218 to prevent the contrast ratio from dropping under light leakage.

The element substrate 101 and the counter substrate 102 respectively have on the mutually facing surfaces thereof alignment layers that have been subjected to a rubbing process so that the major axis of the molecules in the liquid crystal 105 is continuously twisted by about 90°. On the other hand, the element substrate 101 and the counter substrate 102 respectively have on the external surfaces thereof polarizers responsive to the orientation direction of light. These are not shown because these optical elements are not directly related to the present invention. Referring to FIG. 1(*b*), the counter electrode 108, the subpixel electrodes 1218, the mount terminals 107 are shown as having a thickness, however, it is to be understood that this is shown this way for description purposes only, and the actual thicknesses of these components is very small.

Figure 2:
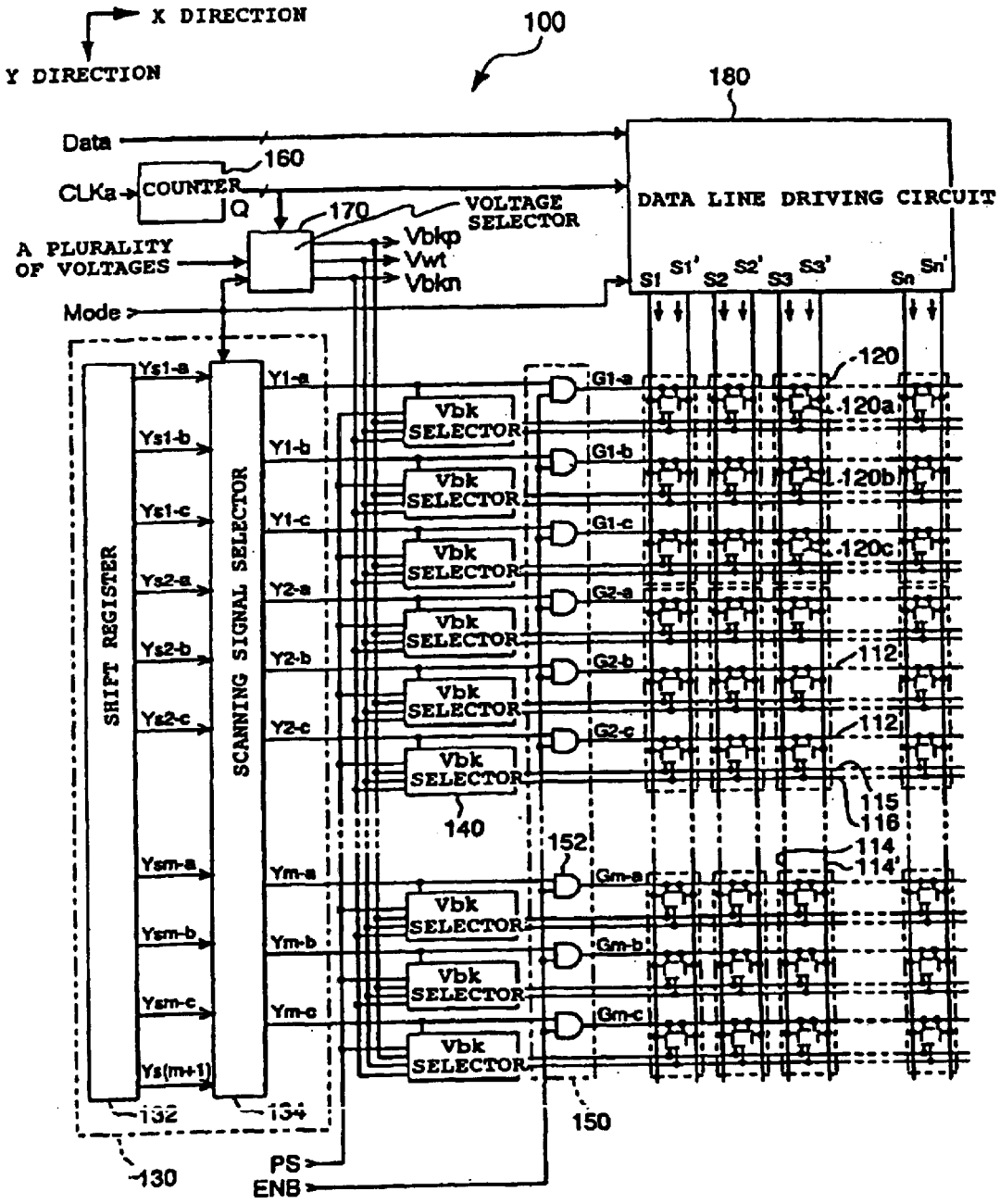
FIG. 2 is a block diagram showing the electrical construction of the electro-optical device.

FIG. 2 is a block diagram showing the electrical construction of the electro-optical device of the present invention.

As shown, 3m scanning lines 112 extend in the X (row) direction, while n data lines 114 extend in the Y (column) direction (m and n are integers). Subpixels 120*a*, 120*b*, and 120*c* are respectively arranged at the intersections of the scanning lines 112 and the data lines 114. Three subpixels 120*a*, 120*b*, and 120*c* adjacent to each other in the column direction are grouped as a single pixel. In this embodiment, pixels 120 are arranged in a matrix of m rows by n columns.

Figure 3:
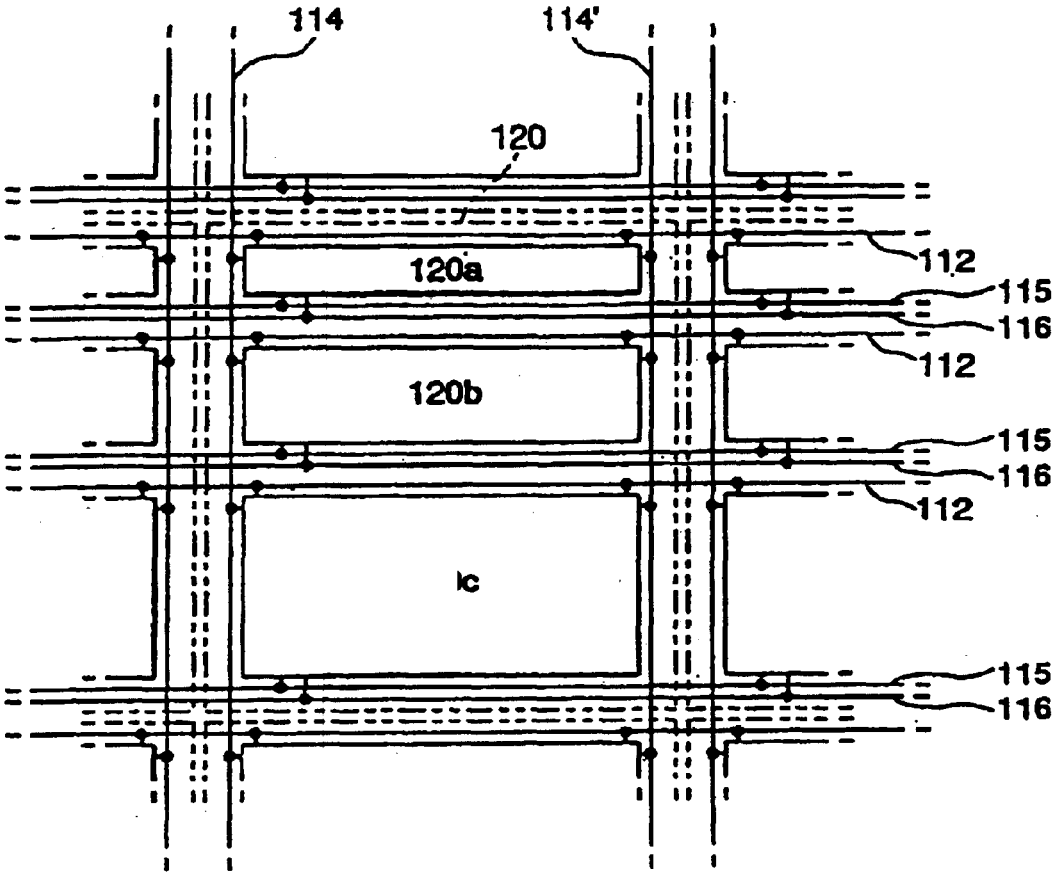
FIG. 3 is a plan view showing the layout of pixels in the electro-optical device.

Each of a first signal line 115 and a second signal line 116 is arranged every row along the scanning line 112 while an auxiliary data line 114' is arranged every column along the data line 114. Referring to FIG. 2, the scanning lines 112, the first signal lines 115, and the second signal lines 116 are respectively equally spaced. In practice, however, the spacings therebetween are set to reflect the area ratio of the subpixels 120*a*, 120*b*, and 120*c* of approximately 1:2:4 as shown in FIG. 3.

In the electro-optical device of this embodiment, the operation modes include a first mode and a second mode. In the first mode, one single pixel presents an eight level gray scale display indicated by gray scale Data of three bits. In the second mode, one single pixel presents a sixteen level gray scale display indicated by gray scale data Data of four bits. Specifically, the electro-optical device of this embodiment presents an eight level area gray scale display by turning on and off the subpixels 120*a*, 120*b*, and 120*c* respectively in response to the values at the least significant bit, the intermediate bit, and the most significant bit in the first mode. In the second mode, the electro-optical device presents a sixteen level gray scale display (with the three subpixels on the same density) on the three subpixels constituting one pixel by sampling a ramp voltage signal at a timing corresponding to the four bit gray scale data.

In the discussion that follows, to identify the rows respectively corresponding to the subpixels 120*a*, 120*b*, and 120*c*, out of a pixel 120 at an i-th row from the top, an (i-a)-th row designates a row corresponding to the subpixel 120*a*, an (i-b)-th row designates a row corresponding to the subpixel 120*b*, and an (i-c)-th row designates a row corresponding to the subpixel 120*c* (here, i is an integer from 1 to m). In this case, the three subpixels at the (i-a)-th row, the (i-b)-th row, and the (i-c)-th row constitute a pixel at the i-th row.

The scanning line driving circuit 130, including a shift register 132 having (3m+1) stages, and a scanning signal selector 134, supplies each scanning line 112 with a scanning signal at a predetermined sequence. For convenience of explanation, the scanning signals output to the (i-a)-th row, the (i-b)-th row, and the (i-c)-th row are respectively designated Yi-a, Yi-b, and Yi-c. The signals that are actually output to the scanning lines 112 are ones output through AND gates 152 and are discussed in greater detail below.

In the first mode, the scanning line driving circuit 130 successively supplies the scanning lines 112 on one line at a time basis from top to bottom shown in FIG. 2, with the scanning signals having active periods not overlapping each other. The active period of each scanning signal is one-third of one horizontal scanning period. In the second mode, the scanning line driving circuit 130 successively supplies the scanning lines 112 on three lines at a time basis from top to bottom shown in FIG. 2, with the scanning signals having active periods not overlapping each other. The active period of each scanning signal is as long as the one horizontal scanning period. Specifically, in the second mode, the scanning signals Yi-a, Yi-b, and Yi-c respectively supplied to the scanning lines 112 at the (i-a)-th row, the (i-b)-th row, and the (i-c)-th row constituting the i-th row of pixels become concurrently active during one horizontal scanning period for the i-th row of pixels. The scanning line driving circuit 130 will be discussed in more detail below.

A counter 160 counts a clock signal CLKa, thereby outputting a count result Q of four bits. Specifically, the counter 160 outputs the count result Q ranging from "0" to "15" in a decimal number. The counter 160 resets the count result Q to zero in response to a latch pulse LP (not shown in FIG. 2) that is output at the start of each horizontal scanning period, and starts counting the clock signal CLKa. When the count result reaches "15", the counter 160 temporarily stops counting.

A voltage selector 170 selects one of a plurality of voltages generated by a separate external power source, and outputs voltage signals Vbkp, Vwt, and Vbkn to be discussed later. Specifically, in the first mode, the voltage selector 170 selects a positive side voltage signal Vbk(+) as the voltage signal Vbkp for turning on the subpixel, a voltage signal as the voltage Vwt for turning off the subpixel, and selects a negative side voltage signal Vbk(−) as the voltage signal Vbkn for turning on the subpixel.

In the second mode, the voltage selector 170 selects a voltage corresponding to the counter result Q as the voltage Vbkp, and respectively voltage signals as the voltage signal Vwt and the voltage signal Vbkn for turning off the subpixel.

The electro-optical device of this embodiment is now in a normally white mode for presenting a white display with no voltage applied. If applied to the subpixel electrode 1218, the voltage signal Vbk(+) for turning on the subpixel refers to a positive side signal out of the signal that presents a black display on the subpixel (see FIG. 4). If applied to the subpixel electrode 1218, the voltage signal Vwt for turning off the subpixel refers to the signal that presents a white display on the subpixel. If applied to the subpixel electrode 1218, the voltage signal Vbk(−) refers to a negative side signal of the signal that presents a black display on the subpixel.

More specifically, in this embodiment, the liquid crystal 105 is sandwiched between the above-referenced subpixel electrodes 1218 and the counter electrode 108, and the signal for turning off the subpixel is approximately equal to the voltage applied to the counter electrode 108. The positive side signal for turning on the subpixel refers to the on voltage signal higher in level than the voltage applied to the counter electrode 108, and the negative side signal for turning on the subpixel refers to the on voltage signal lower in level than the voltage applied to the counter electrode 108. In other words, a substantially intermediate voltage between the positive side voltage signal Vbk(+) and the negative side voltage signal Vbk(−) for turning on the subpixel is the voltage signal Vwt for turning off the subpixel.

In this embodiment, the voltage selector 170 in the second mode selects the voltage for turning off the subpixel when the count result Q is a decimal "0". As the count result Q rises, the voltage selector 170 selects a gradually rising or gradually falling voltage.

In the second mode, the voltage selector 170 switches between the voltage falling direction and the voltage rising direction every horizontal scanning period, and in the same horizontal scanning period subsequent to one vertical scanning period, the voltage selector 170 switches between the voltage falling direction and the voltage rising direction.

In this embodiment, the switching between the first mode and the second mode is performed in response to the level of a signal Mode output by an external control circuit, for example. Specifically, when the signal Mode is at a low level, the first mode is designated. When the signal Mode is a high level, the second mode is designated. The signal Mode is fed to the scanning line driving circuit 130 (the scanning signal selector 134), and the data line driving circuit 180 to be discussed later, in addition to the voltage selector 170.

A Vbk selector 140, arranged at each row, selects one of the voltage signals Vbkp, Vwt, Vbkn from the voltage selector 170, and outputs the selected voltage signal to the corresponding first signal line 115 and second signal line 116 as described below. Specifically, the Vbk selector 140 holds and outputs the voltage signal Vbkp (Vbk(+)) to the corresponding first signal line 115 in the first mode, for example. When the scanning signal applied to the corresponding scanning line 112 shifts into an active level, the Vbk selector 140 selects and holds the voltage signal Vbkn(Vbk(−)) opposite in polarity to the one held prior to the selection. Conversely, when the Vbk selector 140 has held and output the voltage signal Vbkn to the corresponding first signal line 115 in the first mode, the Vbk selector 140 selects and holds the voltage signal Vbkp opposite in polarity to the one selected prior to the selection when the scanning signal to the corresponding scanning line 112 shifts into an active level. Specifically, the Vbk selector 140 alternately selects the voltage signals Vbkp and Vbkn every vertical scanning period, and outputs the selected signal to the first signal line 115.

In the second mode, the Vbk selector 140 selects a ramp voltage signal as the voltage signal Vbkp during one horizontal scanning period for a corresponding row and outputs the ramp voltage signal to the corresponding first signal line 115. During one horizontal period for the i-th row of pixels in the second mode, the scanning signals Yi-a, Yi-b, and Yi-c become concurrently active, and three Vbk selectors 140 corresponding to the (i-a)-th row, the (i-b)-th row, and the (i-c)-th row output mutually identical ramp voltage signals.

Regardless of the first mode and the second mode, the Vbk selector 140 outputs the voltage signal Vwt selected by the voltage selector 170 to the corresponding second signal line 116.

For simplicity of explanation, voltage signals, selected by the Vbk selectors 140 for the (i-a)-th row, the (i-b), and the (i-c)-th row and output to the first signal lines 115 are designated as Vbki-a, Vbki-b, and Vbki-c. Voltage signals, selected by the Vbk selectors 140 for the (i-a)-th row, the (i-b), and the (i-c)-th row and output to the second signal line 116 are designated as Vwti-a, Vwti-b, and Vwti-c. The Vbk selector 140 will be discussed in greater detail below.

An enable circuit 150, arranged for each of the scanning lines 112, includes an AND gate 152. One input of the AND gate 152 receives the scanning signal from the scanning line driving circuit 130, and the other input thereof receives an signal ENB. When the signal ENB is at a high level, the AND gate 152 is opened, and the scanning signal from the scanning line driving circuit 130 is directly output therethrough. When the signal ENB is at a low level, all AND gates 152 are closed. The scanning signal shifts into an inactive level. For simplicity of explanation, actual scanning signals output to the scanning lines 112 from the AND gates 152 at the (i-a)-th row, the (i-b)-th row, and the (i-c)-th row are respectively designated as Gi-a, Gi-b, and Gi-c.

The data line driving circuit 180 drives the data lines 114 and the auxiliary data lines 114' according to each mode. As will be discussed in more detail, in the first mode, the data line driving circuit 180 supplies the data line 114 with the corresponding bit of the gray scale data Data of the pixel composed of the subpixels arranged for the scanning line 112, which is in an active level, and supplies the corresponding auxiliary data line 114' with the inverted version of the bit.

In the second mode, the data line driving circuit 180 supplies the data line 114 of the corresponding column with a timing signal for sampling the ramp voltage signal in response to the gray scale data Data of the pixel for the three subpixels (constituting the one single pixel) of the three scanning lines 112 in an active level, while supplying all auxiliary data lines 114' with a low level signal.

For simplicity, data signals supplied to the data line 114 and the auxiliary data line 114' atj-th column from the left are respectively designated as Sj and Sj' (j is an integer from 1 to n).

Figure 4:
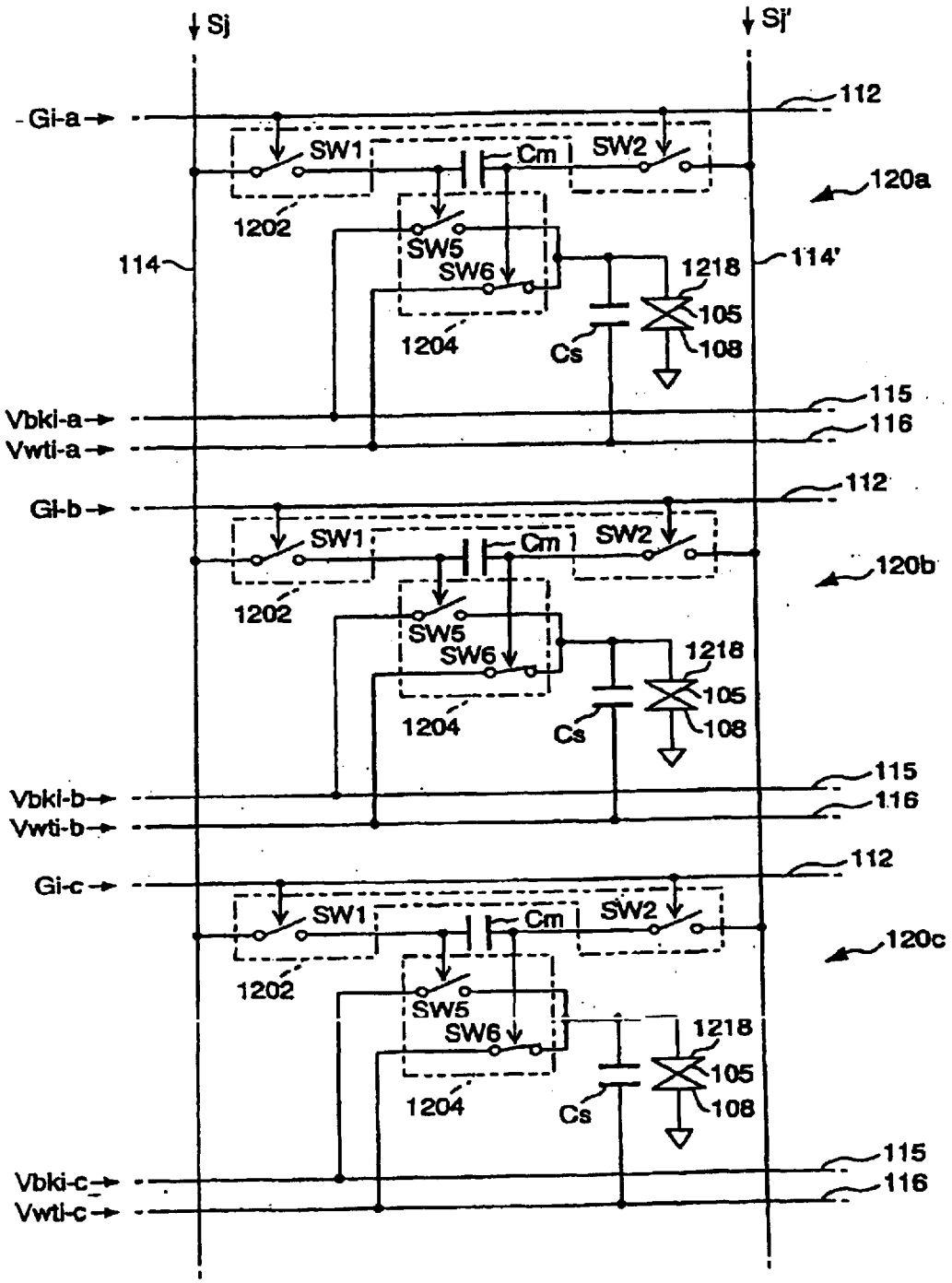
FIG. 4 is a circuit diagram showing the construction of one pixel of the electro-optical device.

The subpixels 120*a*, 120*b*, and 120*c* in the first embodiment are now discussed. FIG. 4 is a circuit diagram showing the construction of one pixel at an i-th row and j-th column. As shown, the three subpixels 120*a*, 120*b*, and 120*c* constituting a pixel at the i-th row and j -th column are electrically identical to each other (although the areas of the three subpixels are different from each other as already discussed). In the first mode, the subpixel 120*a*, which is turned on and off in response to the least significant bit of the gray scale data, includes a first switch 1202 composed of switches SW1 and SW2 and a second switch 1204 composed of switches SW5 and SW6.

The switch SW1 is turned on when the scanning signal Gi-a shifts to an active level (high level), and is configured with one terminal thereof connected to the data line 114 to which the data signal Sj is supplied, and with the other terminal thereof connected to one electrode of a capacitor Cm as a storage element. Similarly, the switch SW2 is turned on when the scanning signal Gi-a shifts to an active level, and is configured with one terminal thereof connected to the auxiliary data line 114' to which the data signal Sj' is supplied, and with the other terminal thereof connected to the other electrode of the capacitor Cm.

When the voltage at the one electrode of the capacitor Cm is at a high level, the switch SW5 is turned on, thereby supplying the subpixel electrode 1218 with the voltage signal Vbki-a through the first signal line 115. When the voltage at the other electrode of the capacitor Cm is at a high level, the switch SW6 is turned on, thereby supplying the subpixel electrode 1218 with the voltage signal Vwti-a through the second signal line 116.

In the first mode in this arrangement, when the scanning line Gi-a shifts to an active level, the least significant bit of the gray scale data corresponding to the pixel at the i-th row and j-th column is supplied as the data signal Sj, and the inverted version of the least significant bit is supplied as the data signal Sj'. For this reason, when the switches SW1 and SW2 are turned on with the scanning signal Gi-a active, the voltages having mutually opposite logic levels are applied on the two electrodes of the capacitor Cm. One of the switches SW5 and SW6 is turned on while the other is turned off. Specifically, when the data signal Sj is at a high level, the switch SW5 is turned on while the switch SW6 is turned off. When the data signal Sj is at a low level, the switch SW5 is turned off while the switch SW6 is turned on. When the switches SW1 and SW2 are turned off with the scanning signal Gi-a becoming inactive, the capacitor Cm through the stored charge thereof maintains the on and off states of the switches SW5 and SW6.

As already discussed, in the first mode, the Vbk selectors 140 at the (i-a)-th row select and supply the voltage signal Vbkp or Vbkn to the first signal line 115 as the voltage signal Vbki-a while supplying the second signal line 116 with the voltage signal Vwt as the voltage signal Vwti-a. In the first mode, the voltage signals Vbkp and Vbkn are respectively voltage signals Vbk(+) and Vbk(−) for turning on the subpixel (for a black display), and the voltage signal Vwt is the signal for turning off the subpixel (for a white display).

Even when the switches SW1 and SW2 are turned off, the on and off states of the switches SW5 and SW6 are maintained by the storage content of the capacitor Cm. The subpixel electrode 1218 is thus continuously applied with the on or off voltage. As a result, the subpixel 120*a* maintains a black display or a white display.

A similar operation is performed on each of the subpixels 120*b* and 120*c*. The area gray scale responsive to the area ratio of the subpixels is performed, if the subpixels are viewed as a single pixel.

Since the two electrodes of the capacitor Cm are continuously biased with the voltages of mutually opposite logic levels in the first mode, charge moves between the two electrodes of the capacitor Cm even if there is a change in the on and off commands to the subpixel. For this reason, no power is additionally consumed, and capacitance requirement for the capacitor is small.

The Vbk selector 140 alternately selects the voltage signals Vbkp and Vbkn to be supplied to the first signal line 115 every vertical scanning period. Once the least significant bit of the gray scale data Data (i.e., a bit for providing an on or off command for the subpixel 120*a*) is written on the capacitor Cm, the capacitance of the liquid crystal is alternately driven without the need for the selection and writing. In other words, there is no need for writing the bit of the same content if there is no change in the on and off states of the subpixel.

Accordingly, when there is no update in the on and off state of the subpixels on a single row, and when the signal ENB is driven to a low level while the scanning signal of the corresponding row shifts to an active level, the inactive level of the scanning signal is maintained. Power consumption involved in the rewriting of the subpixels is thus controlled.

In the second mode, the data signal Sj' is driven to a low level as already described. When the switch SW2 is turned on with the scanning signal Gi-a at an active level, the other electrode of the capacitor Cm is applied with a low level voltage, and the switch SW6 is turned off. On the other hand, when the switch SW1 is turned on with the scanning signal Gi-a at an active level, the switch SW5 remains turned on for a period during which the timing signal as the data signal Sj is at a high level, and the switch SW5 is turned off on the rest of the time.

In the second mode, when the scanning signal Gi-a (Yi-a) at the (i-a)-th row become active, the first signal line 115 at the same row is supplied with the ramp voltage signal as the voltage signal Vbki-a. For the period during which the switch SW5 remains on, the ramp voltage signal is sampled to the capacitance of the liquid crystal, and at the moment the switch SW5 is turned off, the capacitance of the liquid crystal holds the ramp voltage signal immediately prior to the turning off of the switch SW5. When the switch SW1 is turned off with the scanning signal Gi-a driven to an inactive level, the stored voltage is maintained by the capacitance of a storage capacitor Cs formed between the subpixel electrode 1218 and the second signal line 116. The subpixel 120*a* maintains density responsive to the written voltage.

In the second mode, the scanning signals Gi-a, Gi-b, and Gi-c concurrently shift to an active level, and the voltage signals Vbki-a, Vbki-b, and Vbki-c are of the same ramp voltage signal. The subpixels 120*b* and 120*c* operate in the same way as the subpixel 120*a*. As a result, the three subpixels 120*a*, 120*b*, and 120*c* result in the same density, and thus present a gray scale display of the same density if viewed as a single pixel.

As described above, the ratio of the liquid crystal capacitances of the subpixels 120*a*, 120*b*, and 120*c* is approximately 1:2:4 in accordance with the area ratio of the subpixel electrodes 1218. Further, the capacitances of the capacitors Cs are preferably set to agree with that ratio, namely, 1:2:4.

Returning to FIG. 2, the scanning line driving circuit 130 is discussed in detail. The scanning line driving circuit 130 includes a shift register 132 that successively shifts the pulse signal fed at the start of the vertical scanning period in response to the clock signal as a reference for horizontal scanning, and outputs the shifted pulse signals. Specifically, the shift register 132 is fabricated of latch circuits of (3m+1) stages for latching and outputting the input pulse signal in response to the clock signal, wherein the number (3m+1) is greater than the total number of scanning lines 112, namely, 3m, by one stage.

Figure 6:
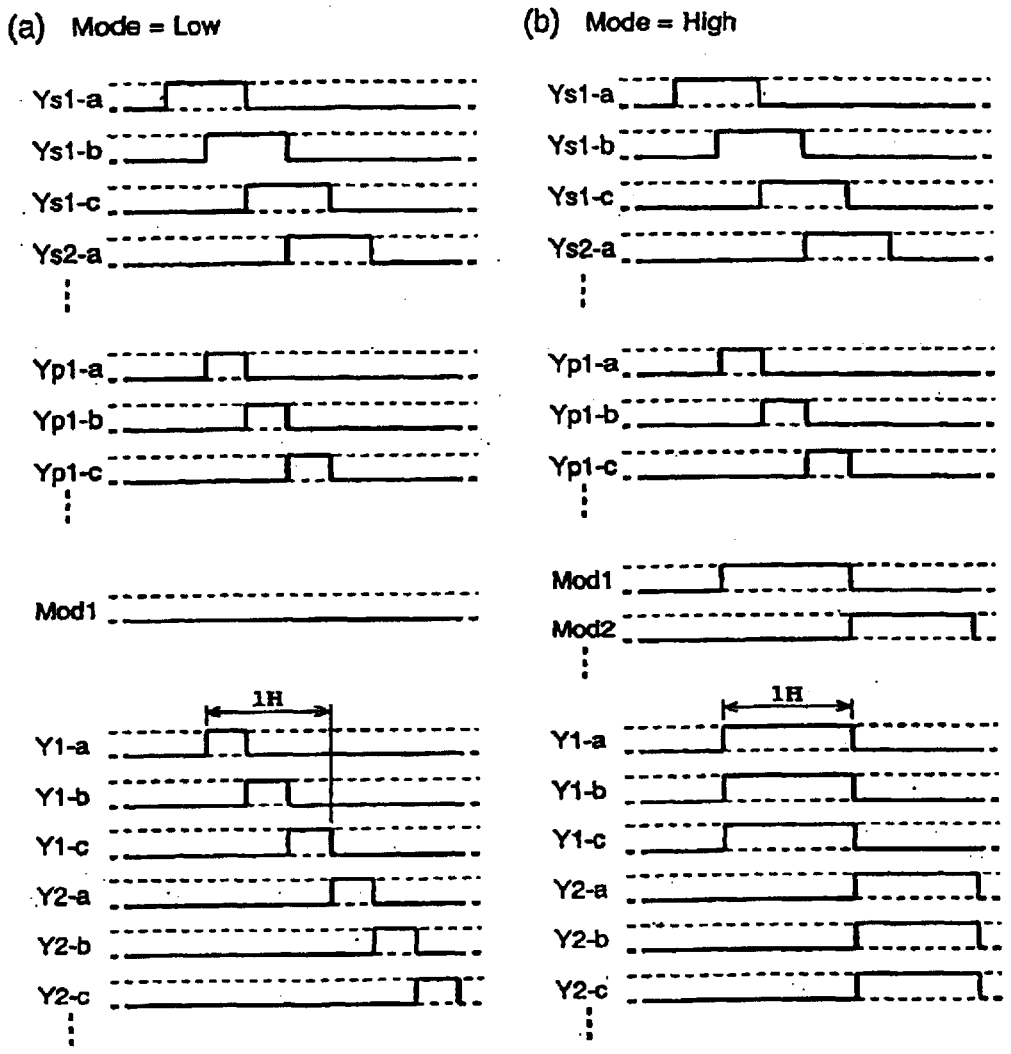
FIG. 6 is a timing diagram showing the operation of the scanning line driving circuit.

For simplicity, the pulse signals output from the latch circuits corresponding to the (i-a)-th row, the (i-b)-th row, and the (i-c)-th row are designated as Ysi-a, Ysi-b, and Ysi-c. For example, the pulse signals Ys1-*a*, Ys1-*b*, and Ys1-*c*, and Ys2-*a* respectively corresponding to the (1-*a*)-th row, the (1-*b*)-th row, the (1-*c*)-th row, and the (2-*a*)-th row are output as shown in FIG. 6(*a*) and FIG. 6(*b*) with the active level periods thereof overlapping by half (half the period of the clock signal).

Figure 5:
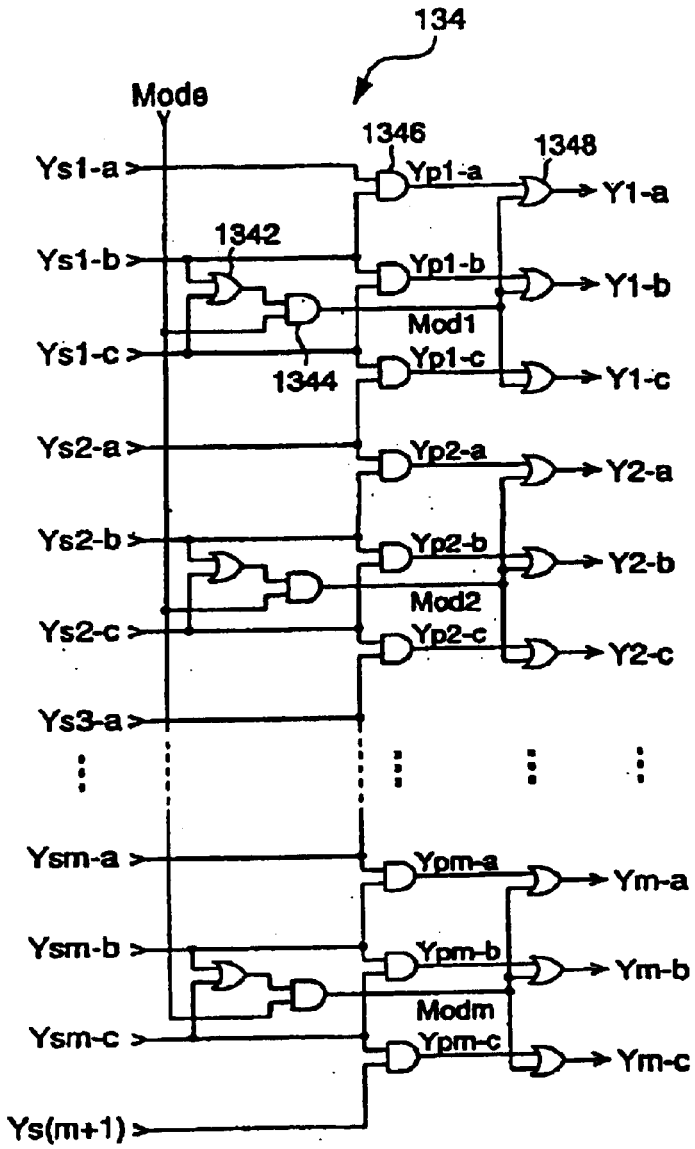
FIG. 5 is a circuit diagram showing the construction of a scanning signal selector in a scanning line driving circuit.

The (logical circuit) scanning signal selector 134 is now discussed in detail with respect to FIG. 5. As shown, a combination of an OR gate 1342 and an AND gate 1344 is typically arranged for the (i-b)-th row and the (i-c)-th row. The OR gate 1342 OR gates the pulse signals Ysi-b and Ysi-c output from the latch circuits corresponding to these rows (the latch circuits in the shift register 132), and the AND gate 1344 AND gates the OR output from the OR gate 1342 and the signal Mode, and outputs the AND gate output as a signal Mode for the i-th row.

An AND gate 1346 AND gates the pulse signals output from adjacent latch circuits, each arranged for a respective row, in the shift register 132, and gives the AND gate output. For simplicity of explanation, the AND gate output signals of the AND gate 1346 corresponding to the (i-a)-th row, the (i-b)-th row, and the (i-c)-th row are respectively designated as Ypi-a, Ypi-b, and Ypi-c.

An OR gate 1348 is arranged for each row, with one input thereof receiving the AND gate output of the corresponding AND gate 1346. The other input terminals of the OR gates 1348 corresponding to the (i-a)-th row, the (i-b)-th row, and the (i-c)-th row receive commonly the logical AND output Modi from the AND gate 1344 corresponding to the i-th row. The logical OR output of the OR gate 1348 is output to the corresponding scanning line 112. The scanning signal actually output to the scanning line 112 is supplied via the AND gate 152 in the enable circuit 150.

In the first mode in which the signal Mode is driven to a low level in this arrangement, the AND gate 1344 is closed. As a result, the output of the AND gate 1346 directly becomes the output of the OR gate 1348. Specifically, in the first mode, an overlapping portion of the signals output by the adjacent latch circuits in the shift register 132 is determined by the AND gate 1346, and is output as a scanning signal. Referring to FIG. 6(*a*), in the first mode, the scanning signals Y1-*a*, Y1-*b*, Y1-*c*, Y2-*a*, . . . having active levels not overlapping each other are successively supplied to the scanning lines 112 with one line at a time from top to bottom.

In the second mode in which the signal Mode is at a high level, the AND gate 1344 is opened, and the output of the AND gate 1344, i.e., the signal Mode, is determined by the output of the OR gate 1342. The OR gate 1342 remains at a high level for a period during which the pulse signals Ysi-b and Ysi-c out of the pulse signals output from the latch circuits in the shift register 132 are at an active level. Specifically, this period corresponds to the duration of time during which the scanning signals Yi-a, Yi-b, and Yi-c are successively driven active in the first mode. For the period during which the OR gate 1342 remains at a high level, the three OR gates 1348 corresponding to the OR gate 1342 also remain at a high level. The scanning signals Yi-a, Yi-b, and Yi-c for the scanning lines 112 corresponding to the three OR gates 1348 are commonly driven to an active level.

In the second mode, first, the pulse signals Ys1-*a*, Ys1-*b*, Ys1-*c*, Ys2-*a*, . . . are output from latch circuits adjacent to each other in the shift register 132 as shown in FIG. 6(*b*), and second, the overlapping portions therebetween are determined as the logic AND output signals Yp1-*a*, Yp1-*b*, Yp1-*c*, . . . by the AND gates 1346. The second mode remains unchanged from the first mode in this operation, but is different from the first mode in the following points.

Since the signal Mod1 corresponding to the first row remains at a high level for the period during which the pulse signal Ys1-*b* or Ys1-*c* is at a high level, all scanning signals Y1-*a*, Y1-*b*, and Y1-*c* corresponding to the three subpixel rows of the first pixel row remain at a high level for the same period. In succession, the signal Mod2 remains high for the period during which the pulse signal Ys2-*b* or Ys2-*c* remains at a high level, and all scanning signals Y2-*a*, Y2-*b*, and Y2-*c* corresponding to the three subpixel rows of the second pixel row remain at a high level for the same period. Generally, for the period during which the pulse signal Ysi-b or Ysi-c remains at a high level, all scanning signals Yi-a, Yi-b, and Yi-c corresponding to the three subpixel rows of the i-th pixel row remain at a high level.

In the second mode, the scanning lines 112, which are grouped into sets, each set composed of three lines (the number of which corresponds to the number of subpixels constituting a single pixel), are supplied with scanning signals having active level periods not overlapping to each other from the top to the bottom lines. Since, in the second mode, the scanning signal in the active level thereof lasts for the period during which the pulse signal Ysi-b and Ysi-c remains at a high level, the active period in the second mode is three times that in the first mode.

Figure 7:
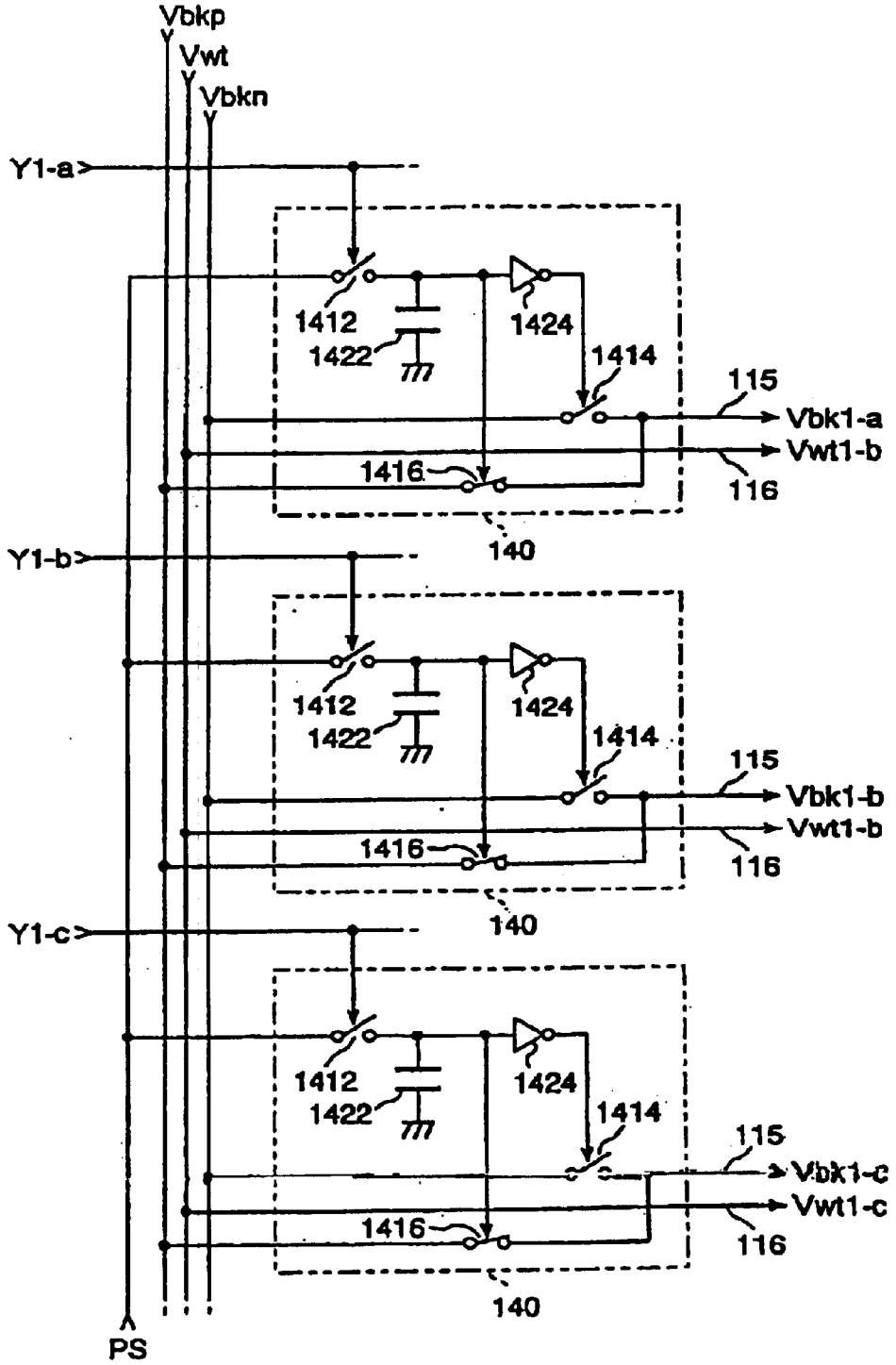
FIG. 7 is a circuit diagram showing the construction of a Vbk selector in the electro-optical device.

The Vbk selector 140 will now be discussed in detail with reference to FIG. 7 that shows an exemplary construction of the Vbk selectors 140. The Vbk selectors 140 shown here respectively correspond to the (1-*a*)-th row, the (1-*b*)-th row, and the (1-*c*)-th row, and only the Vbk selector 140 for the (1-*a*)-th row is representatively discussed here, because the three Vbk selectors 140 are identical to each other in construction.

As shown, a switch 1412 is turned on when the scanning signal Y1-*a* output by the scanning line driving circuit 130 remains at an active level (a high level). The switch 1412 is configured with one terminal thereof connected to the signal line supplied with a signal PS and with the other terminal thereof connected to one terminal of a capacitor 1422, a control input terminal of a switch 1416, and an input terminal of an inverter 1424.

The other terminal of the capacitor 1422 is grounded, and the output of the inverter 1424 is connected to a control input terminal of a switch 1414. One terminal of the switch 1414 is connected to a supply line for the voltage signal Vbkn selected by the voltage selector 170 (see FIG. 2). One terminal of the switch 1416 is connected to a supply line for the voltage signal Vbkp. The other terminals of the switch 1414 and the switch 1416 are together connected to the first signal line 115. The switches 1414 and 1416 are respectively turned on each time the respective control input terminals are driven to a high level. Since the control input terminals of the two switches are respectively connected to the input and output of the inverter 1424, the two switches are turned on and off in an exclusive fashion.

Figure 8:
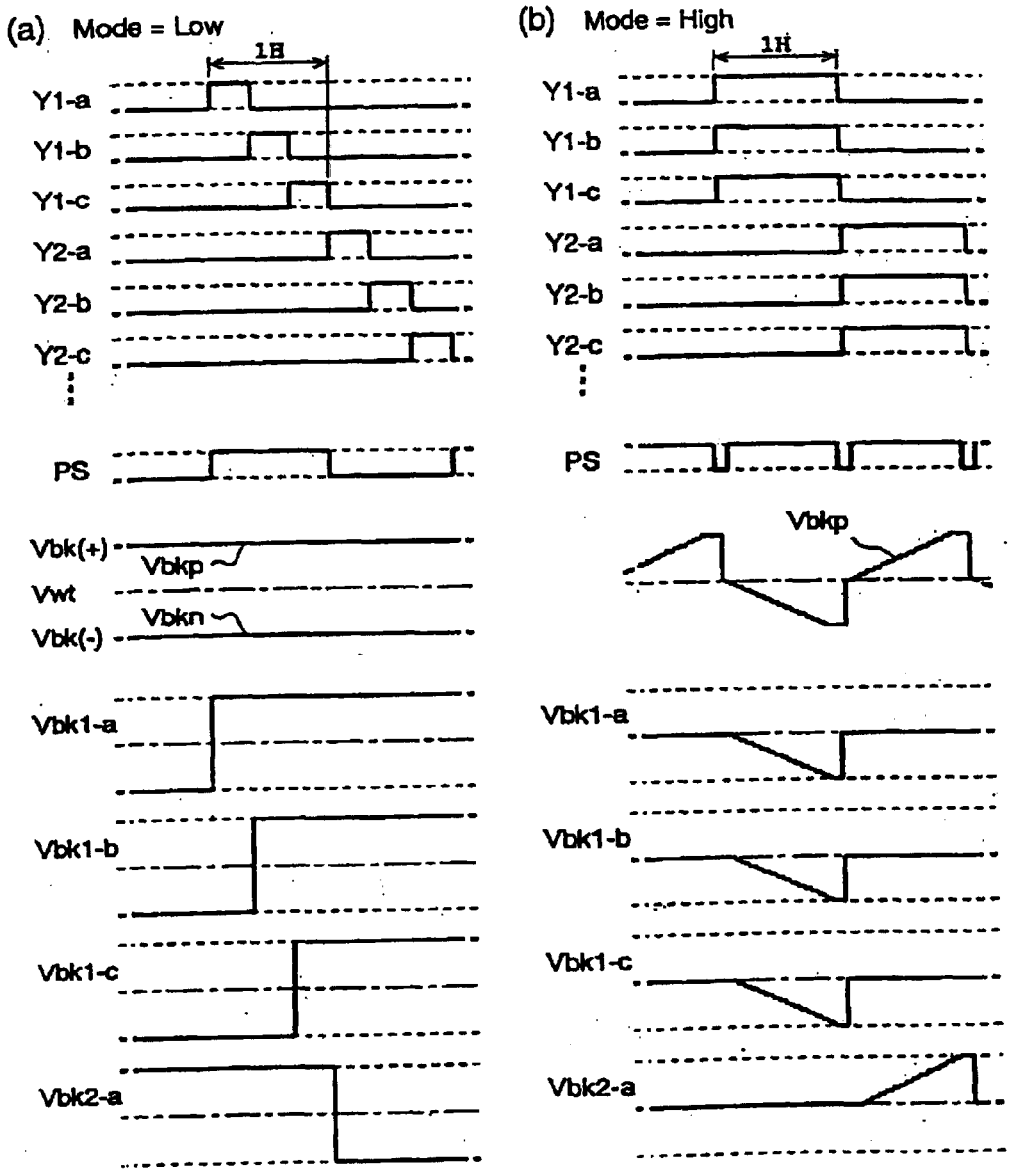
FIG. 8 is a timing diagram showing the operation of the Vbk selector.

Referring now to FIG. 8(*a*), the signal PS is inverted in logic level every horizontal scanning period 1 H (which is a duration of time required to successively select the three scanning lines 112) in the first mode with the signal Mode at a low level. Subsequent to one vertical scanning period, the logic level is inverted during the horizontal scanning period 1H in which the same three scanning lines 112 are selected.

When the scanning signal Y1-*a* is driven to a high level with the signal PS at a high level in the first mode during one horizontal scanning period, the high level is held at the one terminal of the capacitor 1422, the switch 1414 is turned off, and the switch 1416 is turned on. The voltage Vbk1-*a* supplied to the first signal line 115 of the (1-*a*)-th row becomes the voltage signal Vbkp supplied from the voltage selector 170, i.e., the positive side voltage signal Vbk(+) for turning on the subpixel 120*a*.

Even when the scanning signal Y1-*a* is driven to a low level, turning off the switch 1412, the capacitor 1422 holds the high level potential. The switches 1414 and 1416 continuously maintain the on and off states thereof. For this reason, the voltage signal Vbk1-*a* supplied to the first signal line 115 of the (1-*a*)-th row continuously remain the voltage signal Vbk(+).

When the scanning signal Y1-*a* is driven to a high level subsequent to the one vertical scanning period, the signal PS then shifts to a low level. The voltage signal Vbk1-*a* supplied to the first signal line 115 of the (1-*a*)-th row becomes the voltage signal Vbkn, i.e., the negative side voltage signal Vbk(−) for turning on the subpixel 120*a*.

This series of operational steps is performed for each of the 3m Vbk selectors 140, the number of which is equal to the total number of subpixels. In the first mode, the first signal line 115 is alternately applied with the voltage signals Vbk(−) and Vbk(+) each time the scanning signal of the corresponding row is driven to a high level (i.e., every vertical scanning period). In the first mode, the alternating driving of the subpixels is performed without changing the data signals Sj and Sj' to the data lines 114. Furthermore, in the first mode, the signal PS is inverted in logic level every horizontal scanning period 1H during which the three rows corresponding to the three subpixels 120*a*, 120*b*, and 120*c* constituting the one pixel 120 are selected. Write voltage polarity is thus inverted every row in terms of the unit of pixel.

In the second mode in which the signal Mode is at a high level as shown in FIG. 8(*b*), the signal PS remains at a low level for a duration of time immediately prior to the scanning signal output from the scanning line driving circuit 130 shifting to a high level and for a duration of time immediately prior to the scanning signal output from the scanning line driving circuit 130 shifting to a low level.

For this reason, when the scanning signal Y1-*a* is driven to a high level in the second mode, the signal PS is driven to a low level immediately prior to the transition of the scanning signal to the high level. The switch 1414 is then turned on, and the switch 1416 is then turned off. Soon after that, the signal PS is transitioned to an high level, thereby turning off the switch 1414, and turning on the switch 1416.

The voltage signal Vbk1-*a* supplied to the first signal line 115 of the (1-*a*)-th row is the voltage signal Vbkn(Vwt) for turning off the subpixel at the moment the scanning signal Y1-*a* is transitioned to a high level as shown in FIG. 8(*b*). Soon after that, the voltage signal Vbk1-*a* becomes the voltage signal Vbkp having a voltage responsive to the count result Q, i.e., the ramp voltage signal.

Immediately prior to the transitioning of the scanning signal Y1-*a* to a low level, the signal PS is again transitioned to an low level, thereby turning on the switch 1414 and turning off the switch 1416. As a result, the voltage signal Vbk1-*a* becomes again the voltage signal Vbkn(Vwt), and this state lasts for one vertical scanning period until the scanning signal Y1-*a* is next driven to a high level.

In the second mode, the first signal line 115 is supplied with the voltage signal Vbkp as the ramp voltage signal for the period during which the corresponding scanning signal remains at a high level (more precisely, for the period throughout which the switch 1416 is turned on), and is applied with the voltage signal Vwt as the off voltage signal for the rest of the time. This operation is concurrently performed on the grouped three scanning lines 112.

Since the voltage rising direction or the voltage falling direction of the ramp voltage signal in the second mode is inverted every horizontal scanning period 1H, writing operation is performed with polarity inverted every row in terms of the unit of pixels (every three rows in terms of the unit of subpixels). As discussed above, the voltage selector 170 alternates the ramp voltage signal between the voltage rising direction and the voltage falling direction.

Figure 9:
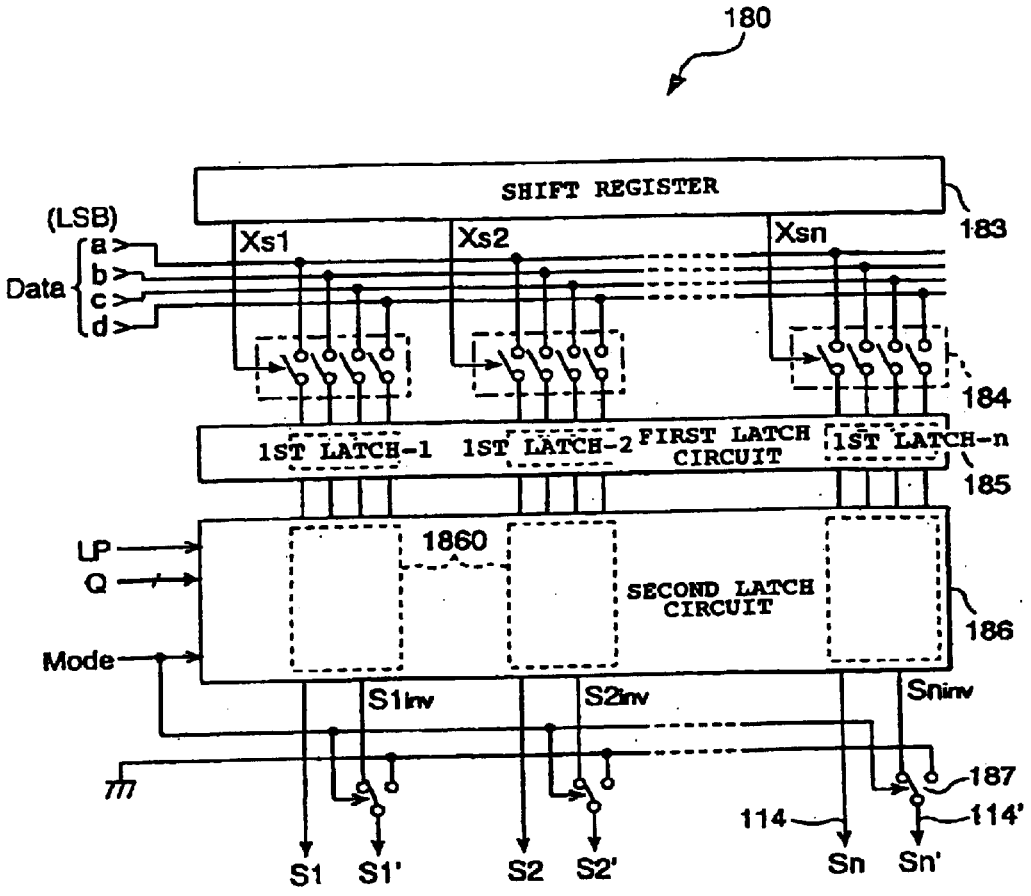
FIG. 9 is a block diagram showing the construction of a data line driving circuit in the electro-optical device.

FIG. 9 is an exemplary block diagram of the data line driving circuit 180. As shown, a shift register 183 successively outputs signals Xs1, Xs2, . . . , Xsn having active level durations thereof not overlapping each other in a horizontal scanning period. The shift register 183 includes a chain of latch circuits of (n+1) stages (not shown), the number of which is larger than the total number n of the data lines 114 by one. The latch circuit here is identical to that of the shift register 132 in the scanning line driving circuit 130. The shift register 183 successively shifts the pulse signal supplied at the start of the one horizontal scanning period in response to a dot clock signal, and successively outputs the shifted pulse signals. In practice, AND gates for AND gating outputs provided by latch circuits adjacent to each other are arranged, in a similar manner to the AND gates 1346 in the scanning signal selector 134 shown in FIG. 5. These AND gates are not shown and the discussion thereof is omitted here.

Connected to the output terminals of the shift register 183 are n switches 184. When the signal Xsj at the j-column is driven to an active level (high level), the corresponding switch 184 is turned on, sampling the gray scale data Data.

The gray scale data Data indicates the density of the pixel 120, and is successively supplied at a predetermined timing from the outside. For simplicity of explanation, the bits of the gray scale data Data are designated a, b, c, and d in the order from the least significant bit (LSB). As described above, the electro-optical device of this embodiment presents an eight-level gray scale display in the first mode, while a sixteen-level gray scale display in the second mode. The gray scale data Data is composed of three bits of a, b, and c in the first mode while the gray scale data Data is composed of four bits of a, b, c, and d. In either mode, the bit a is the least significant bit in either mode, and the bit d is not used in the first mode.

A first latch circuit 185 includes n latches of first latch-1, first latch-2, . . . , first latch-n. Generally, when the first latch j at the j-th column holds the gray scale data Data sampled by the corresponding switch 184 for the period corresponding to one horizontal scanning period 1H when the signal Xsj is driven to an active level.

A second latch circuit 186 includes n unit circuits 1860. In the first mode, the second latch circuit 186 successively shifts the bits a, b, and c of the latched gray scale data Data for one horizontal scanning period 1H, and outputs the shifted data as the data signal Sj, while outputting data signal Sjinv complementary to the data signal Sj at the same time. In the second mode, the second latch circuit 186 outputs, as the data signal Sj, a timing signal which remains at a high level for a duration indicated by the bits a, b, c, and d of the latched gray scale data. The unit circuit 1860 will be discussed further in detail.

There are arranged n selectors 187 respectively for the outputs of n unit circuits 1860 on a one to one basis. The selector 187 selects the complementary data signal Sjinv from the unit circuit 1860 in the first mode in which the signal Mode is at a low level, while selecting and outputting a low level to the data line 114' in the second mode in which the signal Mode is at a high level.

Figure 10:
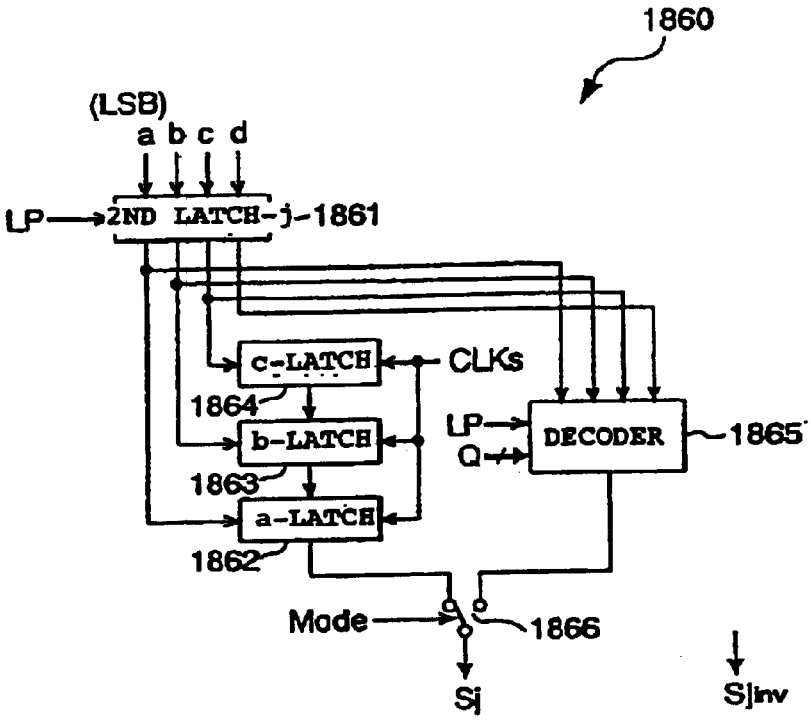
FIG. 10 is a block diagram showing the construction of one column of a second latch circuit in the data line driving circuit.

The unit circuits 1860 in the second latch circuit 186 are discussed, referring to the one at the j-th column. FIG. 10 is a block diagram showing the construction of the unit circuit 1860. As shown, a second latch-j designated by reference numeral 1861 latches the bits of a, b, c, and d of the gray scale data, latched again by the first latch-j in the first latch circuit 185, in response to a latch pulse LP output at the start of one horizontal scanning period 1H.

The bits a, b, and c out of the gray scale data latched by the second latch-j are respectively set in an a-latch 1862, a b-latch 1863, and a c-latch 1864. The a-latch 1862, the b-latch 1863, and the c-latch 1864 respectively shift the bits a, b, and c in response to a clock signal CLKs that is output every one-third of the one horizontal scanning period 1H, and outputs the latched signal. A first circuit is thus composed of these latches.

All bits a, b, c, and d of the gray scale data latched again by the second latch-j are fed to a decoder 1865. The decoder (a second circuit) 1865 compares the count result Q from the counter 160 (see FIG. 2) with the gray scale data Data of the bits a, b, c, and d, thereby generating the following timing signal. Specifically, the decoder 1865 sets the timing signal to a high level at the rising edge of the latch pulse LP and resets the timing signal to a low level when the count result Q coincides with the gray scale data Data indicated by the bits a, b, c, and d. The timing signal remains at a high level for a duration indicated by the gray scale data Data from the start of the one horizontal scanning period 1H.

A selector 1866 selects the bits a, b, and c shifted and output respectively by the a-latch 1862, the b-latch 1863, and the c-latch 1864 in the first mode in which the signal Mode is at a low level, and outputs the bits a, b, and c as the data signal Sj. In the second mode in which the signal Mode is at a high level, the selector 1866 selects the timing signal from the decoder 1865 and outputs the timing signal as the data signal Sj.

Since the data line driving circuit 180 is fabricated of complementary circuits including the unit circuits 1860 in the second latch circuit 186 in practice, the data line driving circuit 180 generates the data signal Sj and the data signal Sjinv complementary in level to the data signal Sj (in the second mode, however, the data signal Sjinv is not selected by the selector 187 and is not output to the auxiliary data line 114').

The a-latch 1862, the b-latch 1863, and the c-latch 1864 are used in the first mode only, and the decoder 1865 is used in the second mode only. The signal Mode may be used to enable one of the latch group and the decoder 1865 to function while disabling the other.

The operations of the electro-optical device of the first embodiment in the first mode and the second mode are separately discussed.

The first mode operation in which the signal Mode is at a low level is discussed. As described above, the gray scale data Data is constructed of the three bits a, b, and c.

Figure 11:
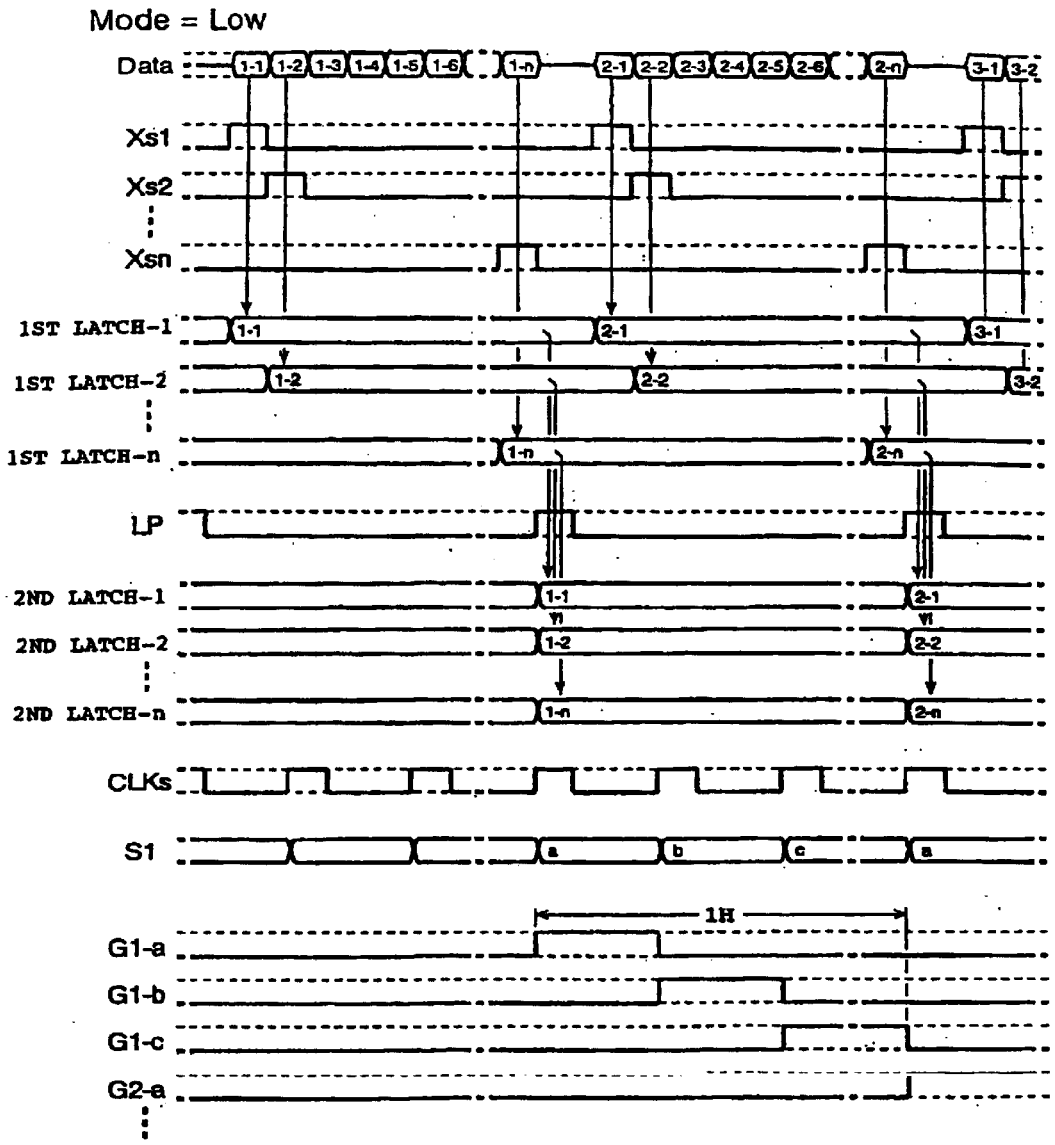
FIG. 11 is a timing diagram showing the operation in a first mode of the electro-optical device, in which the level of a signal Mode is at a low level.

FIG. 11 is a timing diagram showing the operation in the first mode. As shown, the gray scale data Data for the pixel 120 at the first row and the first column, the pixel 120 at the first row and the second column, . . . , the pixel 120 at the first row and the n-th column are successively fed. Then, the gray scale data Data for the pixel 120 at the second row and the first column, the pixel 120 at the second row and the second column, . . . , the pixel 120 at the second row and the n-th column are successively fed. Then, the gray scale data Data for the pixel 120 at the m-th row and the first column, the pixel 120 at the m-th row and the second column, . . . , the pixel 120 at the m-th row and the n-th column are successively fed.

The timing for supplying the gray scale data Data to the first row of pixels 120 is now considered. At the timing the gray scale data Data is supplied to the pixel 120 at the first row and the first column, the signal Xs1 output from the data line driving circuit 180 (see FIG. 9) is driven to an active level. The gray scale data Data is latched by the first column first latch-1 in the first latch circuit 185. At the timing the gray scale data Data is supplied to the pixel 120 at the first row and the second column, the signal Xs2 is driven to an active level, and the gray scale data Data is latched by the second column first latch-2 in the first latch circuit 185. Similarly, the gray scale data Data for the pixel 120 at the first row and the n-th column is latched by the n-th column first latch-n in the first latch circuit 185. In this way, the gray scale data Data for the first row of pixels are respectively latched by the first latch-1, the first latch-2, . . . , the first latch-n.

In response to the output of the latch pulse LP, the gray scale data Data latched by the first latch-1, the first latch-2, . . . , the first latch-n are simultaneously latched by the second latch-1, the second latch-2, . . . , the second latch-n in the second latch circuit 186.

The bits a, b, and c of the gray scale data Data latched at each column are respectively transferred by the a-latch 1862, the b-latch 1863, and the c-latch 1864 (see FIG. 10) in response to the clock signal CLKs.

In the first mode in which the signal Mode is at a low level, the selector 1866 selects and feeds the output of the a-latch 1862 to the data line 114 as the data signal. For example, data signal S1 corresponding to the first column is at the level of the bit a of the gray scale data for the pixel at the first row and the first column during a first segment equal to one third of the one horizontal scanning period 1H. The data signal S1 is at the level of the bit b of the gray scale data for a second segment, and is at the level of the bit c of the gray scale data for a third segment. The same is true of the data signals S2, S3, . . . , Sn for the second column and succeeding columns. In the first mode, the selector 187 (see FIG. 9) selects and outputs the complementary data signals from the unit circuits 1860 to the auxiliary data line 114'.

For the first segment, the scanning signal G1-*a* is driven to an active level. The n subpixels 120*a* at the (1-*a*)-th row are turned on or off for displaying in response to the data signal of the corresponding column (i.e., the least significant bit a). For the second segment, the scanning signal G1-*b* is driven to an active level. The n subpixels 120*b* at the (1-*b*)-th row are turned on or off for displaying in response to the data signal of the corresponding column (i.e., the bit b). For the third segment, the scanning signal G1-*c* is driven to an active level. The n subpixels 120*c* at the (1-*c*)-th row are turned on or off for displaying in response to the data signal of the corresponding column (i.e., the most significant bit c).

A similar operation is successively repeated for the subpixels 120*a*, 120*b*, and 120*c* positioned at the (2-*a*)-th row, the (2-*b*)-th row, the (2-*c*)-th row, the (3-*a*)-th row, the (3-*b*)-th row, the (3-*c*)-th row, . . . , the (m-a)-th row, the (m-b)-th row, and the (m-c)-th row. The area ratio of the subpixels 120*a*, 120*b*, and 120*c* is set to be approximately 1:2:4 in accordance with the weights of the bits a, b, and c. If the three adjacent subpixels 120*a*, 120*b*, and 120*c* are viewed as one pixel 120 in the same column, a gray scale display based on the area gray scale method is performed.

The voltage signal supplied to each first signal line 115 is alternately supplied with the voltages Vbk(+) and Vbk(−) every three subpixel rows. The write voltage polarity is thus inverted every row in terms of the unit of pixels (rather than in terms of subpixels). This arrangement controls the generation of flickering. The voltage signal supplied to the same first signal line 115 is switched between the Vbk(+) and the Vbk(−) at the selected timing when one vertical scanning period has elapsed. The liquid crystal 105 is thus driven in the alternating driving method in each subpixel.

In response to the storage content in the capacitor Cm, each of the subpixels 120*a*, 120*b*, and 120*c* selects the voltage signal Vbk(+) or Vbk(−) supplied to the first signal line 115 or the voltage signal Vwt supplied to the second signal line 116 to present an on or off display. There is no need for data rewriting through driving the scanning signal to an active level every vertical scanning period. The subpixels 120*a*, 120*b*, and 120*c* do not need to modify the on and off states thereof. The voltage in the corresponding scanning line 112 suffers from no fluctuations if the signal ENB is transitioned to a low level at the timing of the selection of the corresponding scanning line 112. No power is consumed in the capacitive load of the scanning lines 112. Since the first switch 1202 (see FIG. 4) is not driven for switching, no power is consumed accordingly. Power consumption is accordingly reduced.

Figure 12:
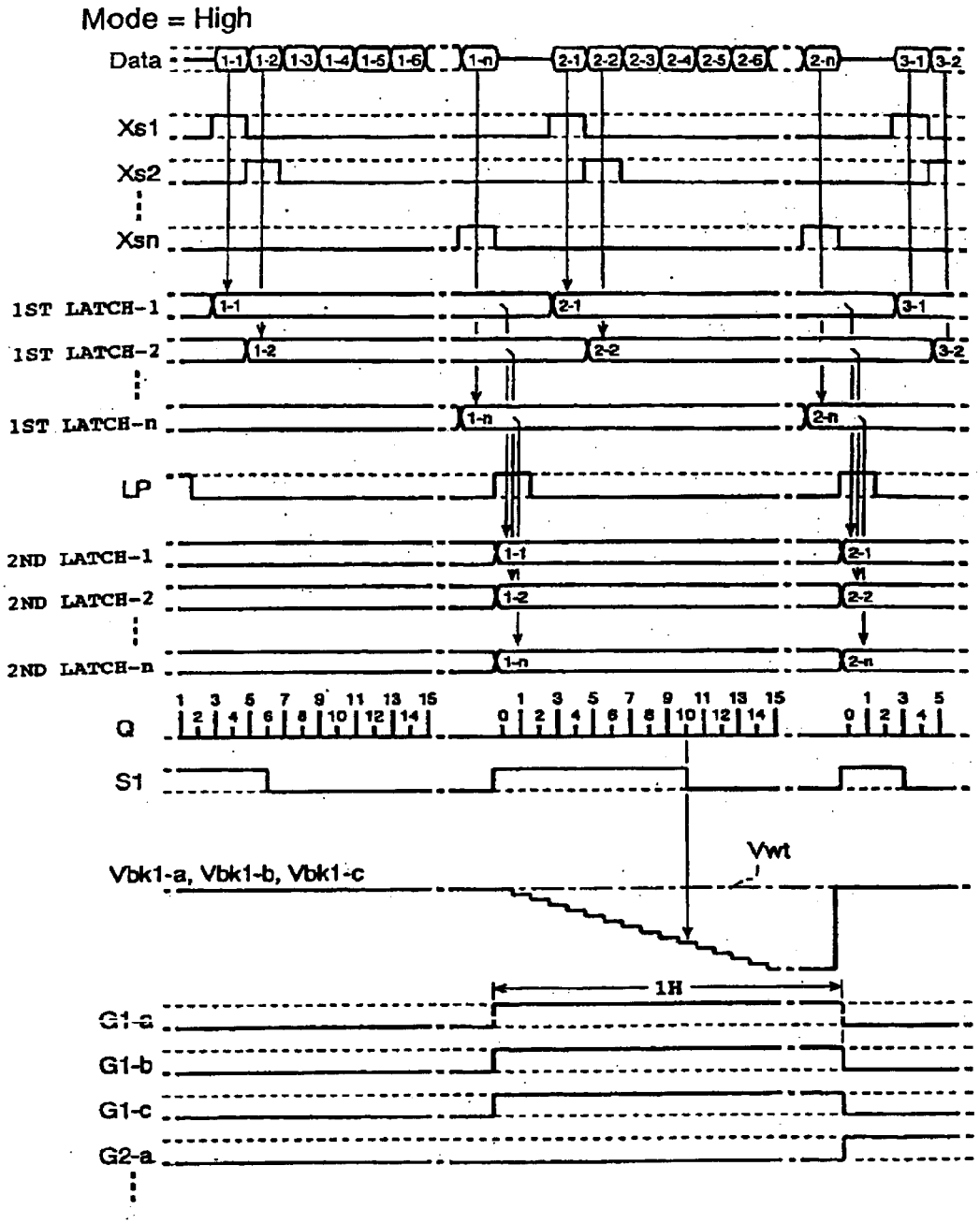
FIG. 12 is a timing diagram showing the operation in a second mode of the electro-optical device, in which the level of a signal Mode is at a high level.

The second mode operation with the signal Mode at a high level is now discussed. In the second mode, the gray scale data Data is composed of the four bits a, b, c, and d as already discussed. FIG. 12 is a timing diagram showing the second mode operation. As shown, the second latch-1, the second latch-2, . . . , the second latch-n in the second latch circuit 186 concurrently latch the gray scale data Data in the same way as in the first mode.

Specifically, first, as shown, the gray scale data Data for the pixel 120 at the first row and the first column, the pixel 120 at the first row and the second column, . . . , the pixel 120 at the first row and the n-th column are successively fed. Then, the gray scale data Data for the pixel 120 at the second row and the first column, the pixel 120 at the second row and the second column, . . . , the pixel 120 at the second row and the n-th column are successively fed. Then, the gray scale data Data for the pixel 120 at the m-th row and the first column, the pixel 120 at the m-th row and the second column, . . . , the pixel 120 at the m-th row and the n-th column are successively fed. Second, at the timings when the gray scale data Data for the pixel 120 at the first row and the first column, the pixel 120 at the first row and the second column, . . . , the pixel 120 at the first row and the n-th column are successively fed, the signals Xs1, Xs2, . . . , Xsn are successively driven to an active level, and then the gray scale data Data is respectively latched by the first latch-1, the first latch-2, . . . , the first latch-n in the first latch circuit 185. In this way, the gray scale data Data for the first row of pixels 120 are respectively latched. Third, in response to the latch pulse LP, the gray scale data Data respectively latched are latched by the second latch-1, the second latch-2, . . . , and the second latch-n in the second latch circuit 186. In the above operation, the second mode is identical to the first mode.

In the second mode, however, the bits a, b, c, and d of the gray scale data Data latched in the second latch-1, the second latch-2, . . . , the second latch-n are fed to the decoder 1865 of the corresponding column. Generally, the decoder 1865 at the j -th column sets the timing signal to a high level at the rising edge of the latch pulse LP, and thereafter resets the timing signal to a low level when the count result Q coincides with the value of the bits a, b, c, and d supplied by the second latch-j.

In the second mode in which the signal Mode is at a high level, the selector 1866 selects the timing signal from the decoder 1865, and supplies the timing signal as the data signal to the data line 114. For example, the gray scale data Data for the pixel 120 at the first row and the first column, the pixel 120 at the first row and the second column, . . . , the pixel 120 at the first row and the n-th column are respectively latched by the second latch-1, the second latch-2, . . . , and the second latch-n in the second latch circuit 186. For example, when the gray scale data Data for the first row and the first column is decimal number "10" (a=0, b=1, c=0, and d=1 in a binary system), the data signal S1 at the first column is set to a high level at the rising edge of the latch pulse LP and is then driven to a low level at the timing when the count result Q coincides with "10". FIG. 12 shows only the data signal S1 for the first column, and the data signals S2, S3, . . . , Sn on the second column and subsequent columns change the level thereof depending on the corresponding gray scale data Data. In the second mode, the selectors 187 (see FIG. 9) respectively select and supply a low level to the auxiliary data lines 114'. The data signals S1'-Sn' continuously remain at a low level.

The scanning signals G1-*a*, G1-*b*, and G1-*c* for the (1-*a*)-th row, the (1-*b*)-th row, and the (1-*c*)-th row are concurrently driven to an active level for the period during which the gray scale data Data for the pixel 120 at the first row and the first column, the pixel 120 at the first row and the second column, . . . , the pixel 120 at the first row and the n-th column are respectively latched by the latch pulses LP of the second latch-1, the second latch-2, . . . , and the second latch-n. The scanning signals G1-*a*, G1-*b*, and G1-*c* actually output to the scanning lines 112 are the scanning signals Y1-*a*, Y1-*b*, and Y1-*c* prior to the passing thereof through the enable circuit 150. For the period during which these scanning signals remain at an active level, the voltage signals Vbk1-*a*, Vbk1-*b*, and Vbk1-*c* become the same ramp voltage signal (see FIG. 8(*b*)).

When the scanning signals G1-*a*, G1-*b*, and G1-*c* are driven to an active level, switches SW1 are concurrently turned on (see FIG. 4) and switches SW5 are concurrently turned on for the period during which the data signal Sj remains at a high level in the subpixels 120*a*, 120*b*, and 120*c* at the intersections of the scanning lines 112 of the (1-*a*)-th row, the (1-*b*)-th row, and the (1-*c*)-th row and the data line 114 at the j-th column. As a result, the ramp voltage signals supplied to the first signal lines 115 of the (1-*a*)-th row, the (1-*b*)-th row, and the (1-*c*)-th row are sampled at the capacitance of the liquid crystal. When the data signal S1 is driven to a low level, the switch SW5 is turned off, and the ramp voltage signal, immediately prior to the turning off of the switch SW5, is held in the capacitance of the liquid crystal.

In the second mode, the subpixels 120*a*, 120*b*, and 120*c* forming the single pixel 120 present a gray scale display having the same density in response to the held voltage. A similar operation is line-sequentially performed on the second row, the third row, . . . , the m-th row of pixels 120. In other words, the operation of sampling and holding the ramp voltage signal is performed in response to the data signal every three subpixels forming the pixel at a single row every horizontal scanning period 1H.

A falling ramp voltage signal is now fed to the first signal lines 115 at the (1-*a*)-th row, the (1-*b*)-th row, and the (1-*c*)-th row. Since the first signal lines 115 at the next rows of (2-*a*), (2-*b*), and (2-*c*) are supplied with a rising ramp voltage signal (see FIG. 8(*b*)). Write voltage polarity is thus inverted in terms of the unit of pixel (not the unit of subpixel) as in the first mode. The generation of flickering is thus controlled.

When one vertical scanning period has elapsed since the falling ramp voltage signal was fed to the first signal lines 115 at the (1-*a*)-th row, the (1-*b*)-th row, and the (1-*c*)-th row, a rising ramp voltage signal is now fed to the same first signal lines 115 at the (1-*a*)-th row, the (1-*b*)-th row, and the (1-*c*)-th row. The liquid crystal 105 is thus driven in the alternating driving method in each subpixel.

In the first mode in the electro-optical device of the first embodiment, the subpixels 120*a*, 120*b*, and 120*c* are turned on and off in response to the gray scale Data, and a gray scale display based on the area gray scale method is presented. Further, it suffices to rewrite the storage content of the capacitor Cm in only the subpixels that need updating. Accordingly, a high-quality display that is free from non-uniformities is thus presented which also has a low power consumption. In the second mode, one pixel presents a gray scale display having the same density, although each pixel is split into three subpixels. The electro-optical device thus presents a gray scale display having levels, the number of which is larger than the number of subpixels. Selecting one of the modes depending on operational conditions, the electro-optical device of this embodiment presents a high-quality display free from non-uniformities or a multi-level gray scale display.

The first mode may be selected to display still pictures, characters and line drawings, or when there is low battery remaining power available, or when the device is on a standby. The second embodiment may be selected to display moving pictures, a landscape, and pictures. Further, a separate determination mechanism may be employed to select between the first mode and the second mode, by accounting for a variety of conditions, or alternatively a user may manually select between the first mode and the second mode using a separately arranged switch.

In the above-referenced first embodiment, one first signal line 115 and one second signal line 116 are arranged on the basis of per scanning line 112. Alternatively, one first signal line 115 and one second signal line 116 are arranged on the basis of per three scanning lines 112.

Figure 13:
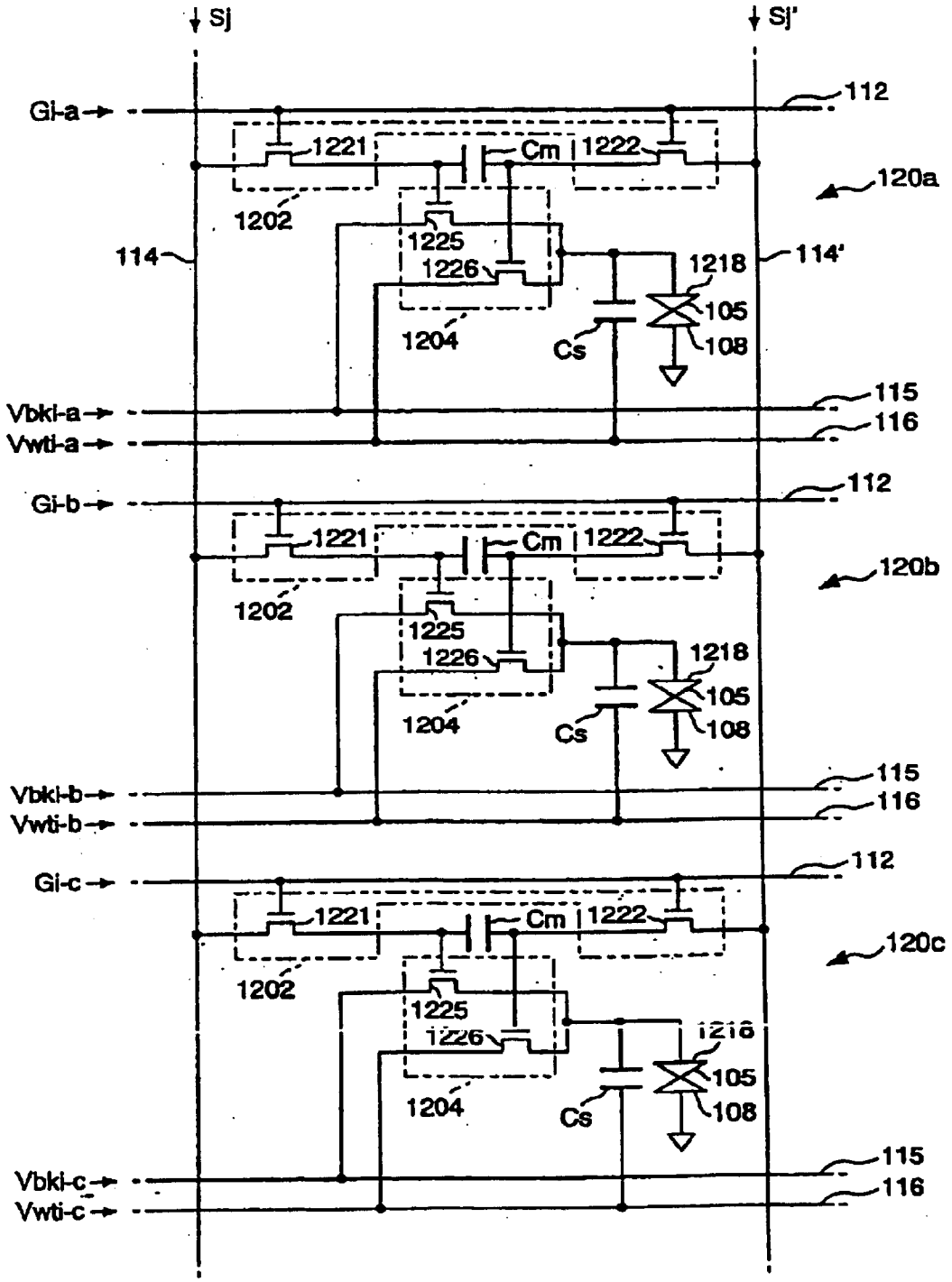
FIG. 13 is a circuit diagram showing the construction of one pixel in the electro-optical device.

In the first embodiment, the subpixels 120*a*, 120*b*, and 120*c* constituting the one pixel 120 have the construction shown in FIG. 4. In practice, the switches SW1 and SW2 in the first switch 1202 and the switches SW5 and SW6 in the second switch 1204 can be fabricated of N-channel TFTs (Thin-Film Transistors) 1221, 1222, 1225, and 1226 through polysilicon processing as shown in FIG. 13. The logic levels of the voltages supplied to the scanning lines 112, the data lines 114, and the auxiliary data lines 114' need to be determined by taking into account the characteristics of these transistors.

Figure 14:
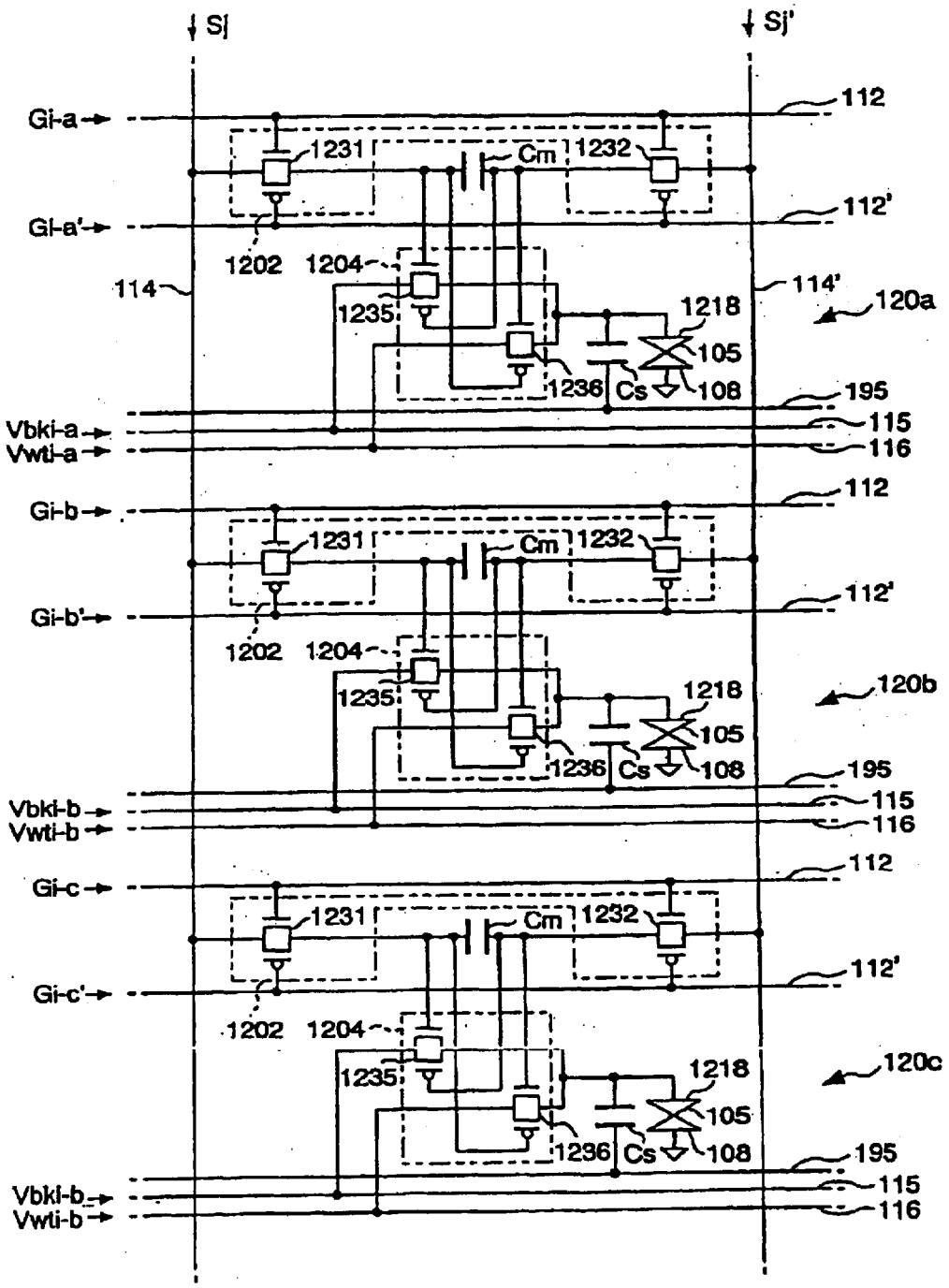
FIG. 14 is a circuit diagram showing the construction of one pixel in the electro-optical device.

However, if the switches SW1 and SW2 in the first switch 1202 are fabricated of complementary transistors 1231 and 1232, i.e., a combination of a P-channel transistor and an N-channel transistor as shown in FIG. 14, the characteristics of the elements require no particular consideration. In this arrangement, the offset voltages of the transistors 1221 and 1222 shown in FIG. 13 cancel each other, and the voltage supplied to the scanning line 112 is reduced accordingly. However, this arrangement requires that two scanning signals complementary to each other in logic level be supplied to one row of subpixels. For example, besides the scanning signal Gi-a, the (i-a)-th row needs a scanning signal Gi-a' complementary to the scanning signal Gi-a. Specifically, one row of subpixels need two scanning lines 112 and 112'.

Similarly, if the switches SW5 and SW6 in the second switch 1204 are fabricated of complementary transistors 1235 and 1236, i.e., a combination of a P-channel transistor and an N-channel transistor, as shown in FIG. 14, the characteristics of the elements require no particular consideration. In this arrangement, the offset voltages of the transistors 1235 and 1236 shown in FIG. 13 cancel each other, and the voltages supplied to the data line 114 and the auxiliary data line 114' are reduced accordingly.

If the complementary transistors are used for the first switch 1202 and the second switch 1204, the voltages supplied to the scanning lines 112 and the data lines 114 (auxiliary data lines 114') are lowered in level accordingly, and a common voltage level may be shared between the voltages. In this arrangement, the number of voltages may be reduced, the construction of power source circuits may be simplified, and cost reduction may be implemented.

Referring to FIG. 14, the other terminal of the storage capacitor Cs is connected to a capacitive line 195. In the first embodiment, the voltage signal applied to the second signal line 116 in the first mode and the second mode is the voltage signal Vwt corresponding to the off voltage and is fixed. The other terminal of the storage capacitor Cs may be connected to the second signal line 116. However, when the complementary transistors are used, the same ramp voltage signal is preferably supplied to the first signal line 115 and the second signal line 116 to reduce impedance during writing, and the connecting of the other terminal of the storage capacitor Cs to the capacitive line 195, as shown in FIG. 14, is therefore preferable.

Figure 15:
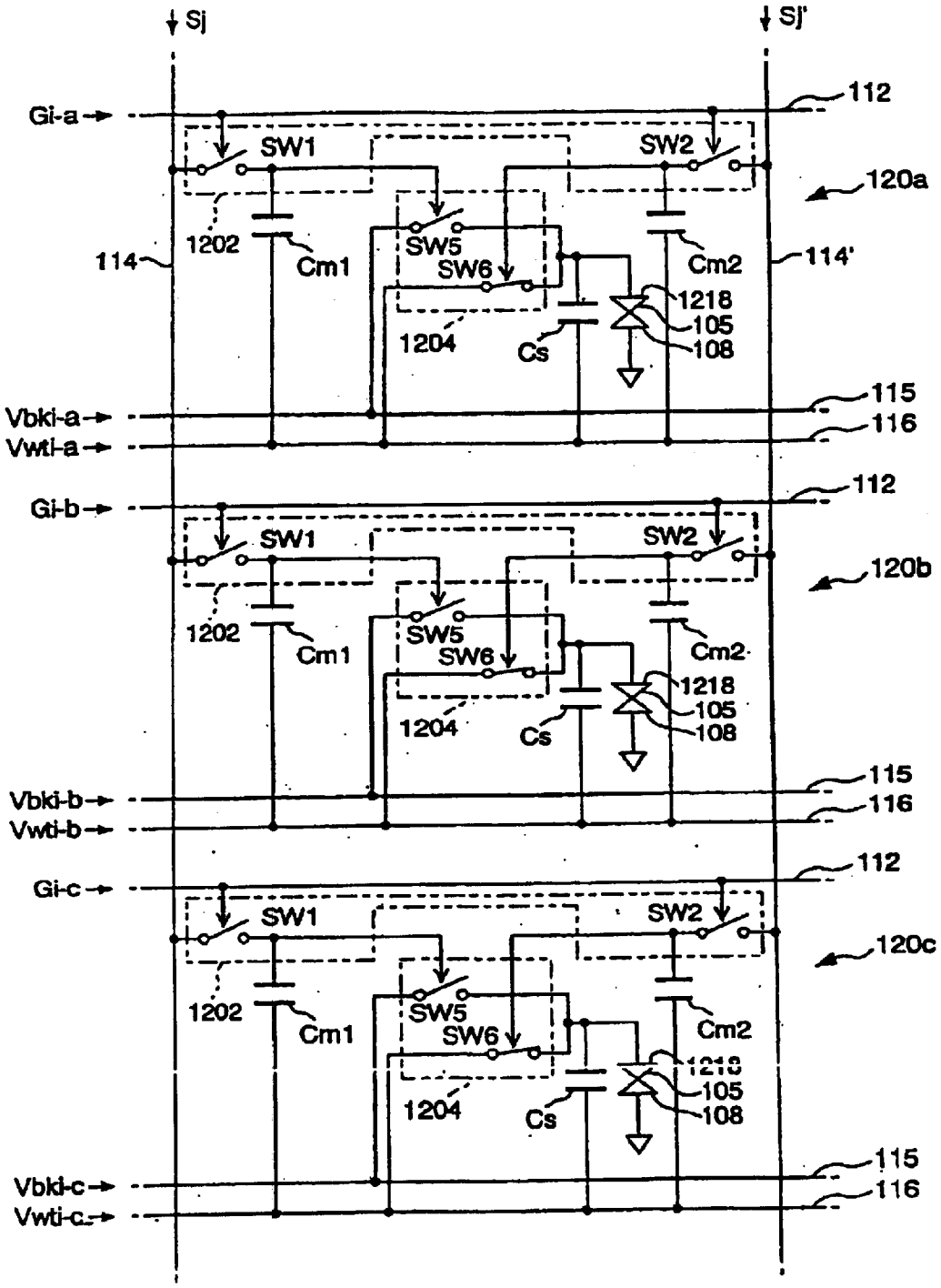
FIG. 15 is a circuit diagram showing the construction of one pixel in the electro-optical device.
Figure 16:
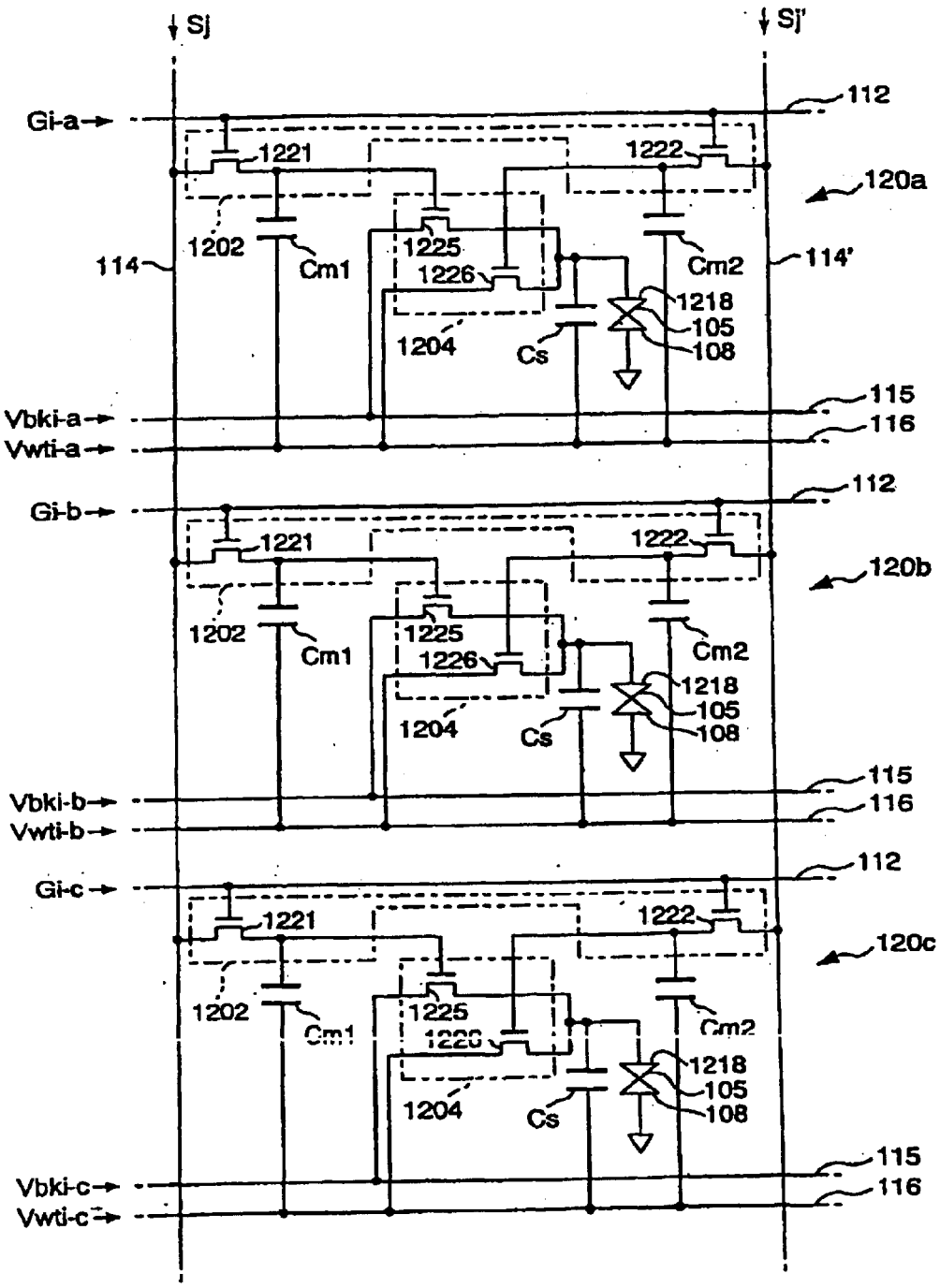
FIG. 16 is a circuit diagram showing the construction of one pixel in the electro-optical device.

In the first mode in the first embodiment, the storage element for holding the voltage of the data line 114 and the auxiliary data line 114' is formed of a single capacitor Cm. Alternatively, two capacitors of Cm1 and Cm2 may be used to separately hold the voltage levels of the data line 114 and the auxiliary data line 114' as shown in FIG. 15. In the first mode, the data signal Sj supplied to the data line 114 and the data signal Sj' supplied to the auxiliary data line 114' are complementary in logic level. Even if a change in the logic level occurs, charge simply moves along the common second signal line 116 between the capacitors Cm1 and Cm2 within the same subpixel. Therefore, no power is additionally consumed, and the second signal line 116 that connects the two capacitors suffers from no voltage fluctuations. In this case, again, the switches SW1 and SW2 in the first switch 1202 and the switches SW5 and SW6 in the second switch 1204 are actually fabricated of N-channel TFTs (Thin-Film Transistors) 1221, 1222, 1225, and 1226 through polysilicon processing as shown in FIG. 16.

Figure 17:
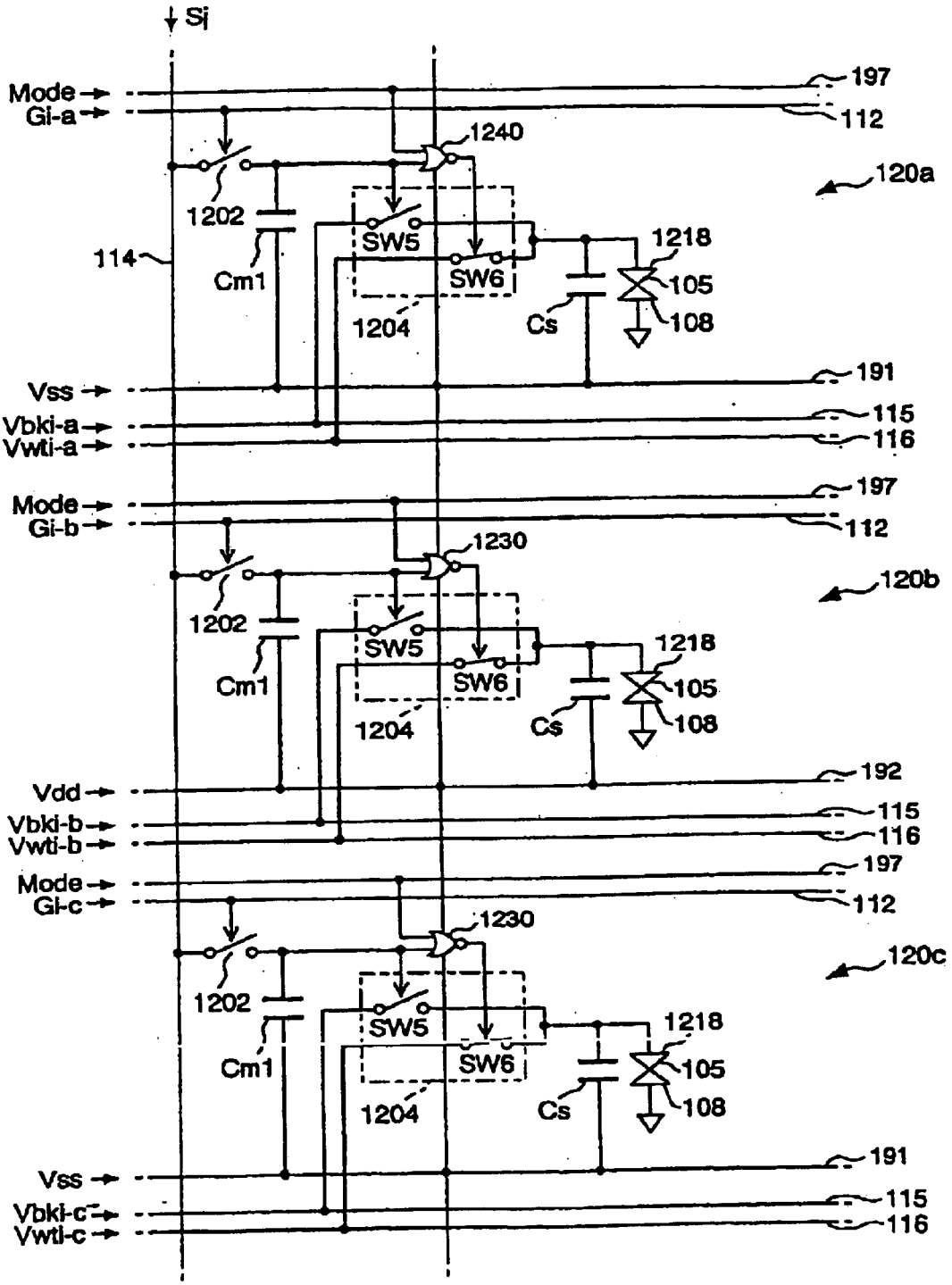
FIG. 17 is a circuit diagram showing the construction of one pixel in the electro-optical device.

In the second mode in the first embodiment, mode control is indirectly performed on the subpixels by driving the auxiliary data line 114' to a low level. However, it is to be understood that the present invention is not limited to this configuration. The signal Mode may be supplied to the subpixels, thereby directly controlling the mode of the subpixels. FIG. 17 shows the arrangement for such an operation. In FIG. 17, a signal line 197 for supplying the signal Mode is closely arranged in parallel with the scanning line 112. A NOR gate 1240 for NOR gating the signal Mode and the storage voltage at the capacitor Cm1 is arranged for each subpixel. The NOR gate output signal is used to control the switch SW6 in the second switch 1204 for on and off operation.

In the first mode with the signal Mode at a low level in this arrangement, the output of the NOR gate 1240 is defined by only the storage voltage of the capacitor Cm1. The switches SW5 and SW6 are turned on and off in an exclusive fashion. In the second mode with the signal Mode at a high level, the output of the NOR gate 1240 remains at a low level regardless of the storage voltage of the capacitor Cm1. The switch SW6 is turned off. This arrangement operates in the same way as the first embodiment.

In comparison with the first embodiment, this arrangement requires the supply of a separate power source voltage for the NOR gate 1240. However, this arrangement eliminates the need for arranging two supply lines for a low voltage and a high voltage per each row of subpixels. As shown in FIG. 17, a first supply line 191 for supplying a low voltage Vss and a second supply line 192 for supplying a high voltage Vdd are alternately arranged every row of subpixels. The NOR gate 1240 of one subpixel is supplied with the low voltage Vss of the power source and the high voltage Vdd of the power source by a supply line in the close vicinity of the scanning line 112 of the corresponding subpixel row and a supply line in the close vicinity of another scanning line 112 adjacent to the first scanning line 112. In this arrangement, the first supply line 191 and the second supply line 192 remain at a constant voltage. The capacitor Cm1 may be alternately connected to the first supply line 191 and the second supply line 192 as shown in FIG. 17.

In the first embodiment described above, the number of switches per subpixel is four, as shown in FIG. 4, FIG. 13, FIG. 14, FIG. 15, and FIG. 16. In the arrangement shown in FIG. 17, the number of switches is three, but the NOR gate 1240 is additionally needed. In either case, the number of transistors per subpixel is at least four.

As is known, the yield of the device drops as the number of elements per pixel increases. Therefore, the smaller the number of transistors per subpixel, the better. Discussed next is a second embodiment having a transistor count smaller than that of the first embodiment.

Figure 18:
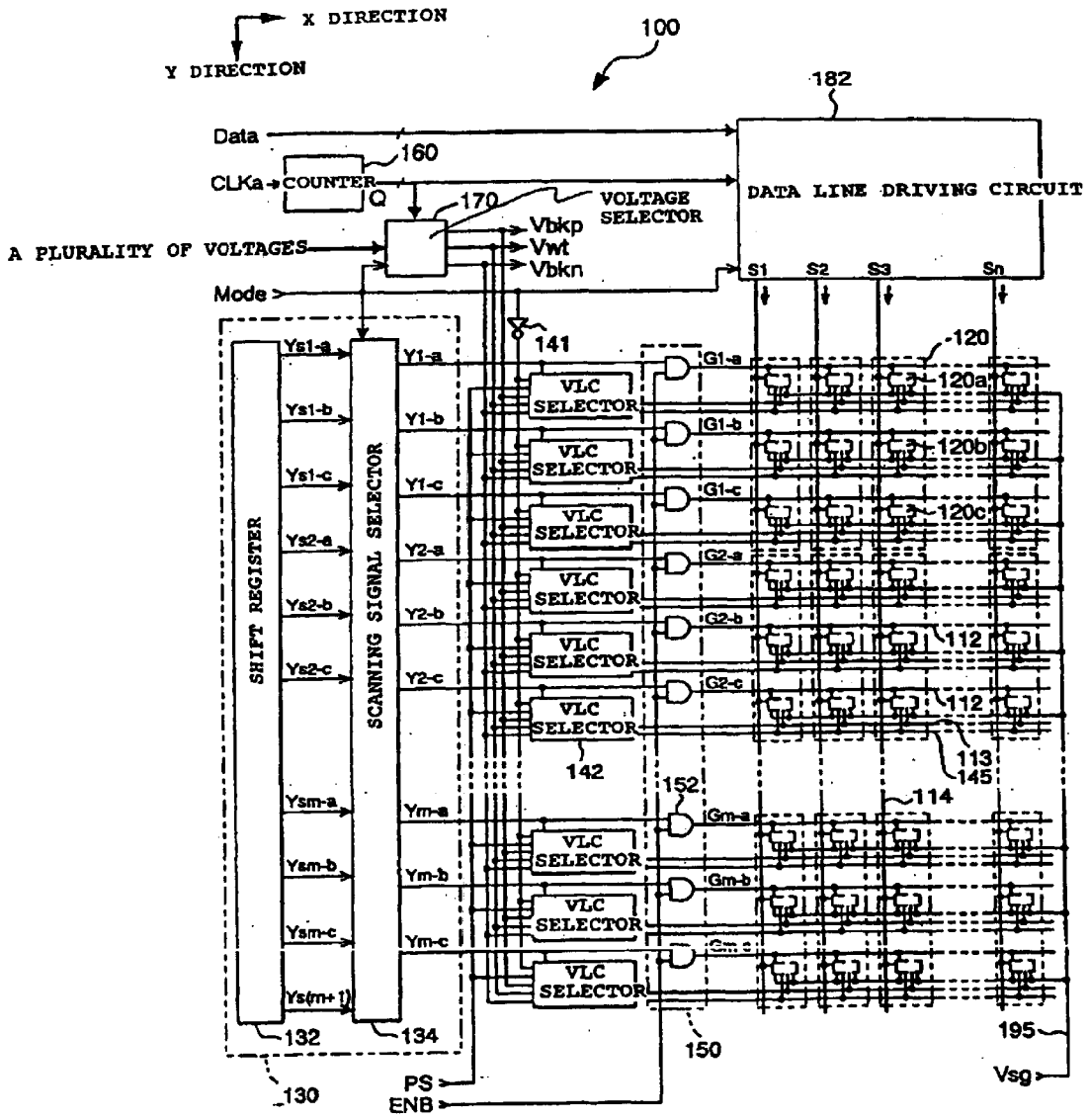
FIG. 18 is a block diagram showing the electrical construction of the electro-optical device of a second embodiment of the present invention.

FIG. 18 is a block diagram showing the electrical construction of an electro-optical device of the second embodiment. As shown, components identical to those described with reference to FIG. 2 are designated with the same reference numerals, and any redundant discussion thereof is omitted. In other words, the second embodiment is mainly discussed from the point of difference from the first embodiment.

In the second embodiment, each column has no auxiliary data line 114'. A data line driving circuit 182 in the second embodiment includes no selector 187 (see FIG. 9) for each column. The scanning line 112 is arranged on each row. Instead of the first signal line 115 and the second signal line 116, a display refresh control line 113, a third signal line 145, and a capacitive line 195 are arranged.

The capacitive line 195 commonly feeds a constant voltage Vsg to all subpixels in the same way as shown in FIG.

14. The voltage signal Vwt equivalent to the off voltage may be used as the voltage Vsg.

In the first mode, the display refresh control line 113 is supplied with a signal (a refresh command signal) for refreshing the display of a subpixel on the corresponding row in response to the storage content of the storage element Cm. The third signal line 145 is supplied with a voltage signal for turning on the subpixel of the corresponding row in the first mode. In the second mode, the third signal line 145 is supplied with a ramp voltage signal similar to that in the first embodiment.

The signals respectively supplied to the display refresh control line 113 and the third signal line 145 are selected by a VLC selector 142 arranged for each corresponding row. In the second embodiment, the VLC selector 142 is substituted for the Vbk selector 140 on each row.

For simplicity of explanation, the signals selected by the VLC selectors 142 corresponding to the (i-a)-th row, the (i-b)-th row, and the (i-c)-th row and supplied to the corresponding display refresh control lines 113 are respectively designated Ri-a, Ri-b, and Ri-c. Voltage signals supplied to the corresponding third signal lines 145 are respectively designated VLCi-a, VLCi-b, and VLCi-c. The VLC selector 142 will be discussed in detail later.

Figure 19:
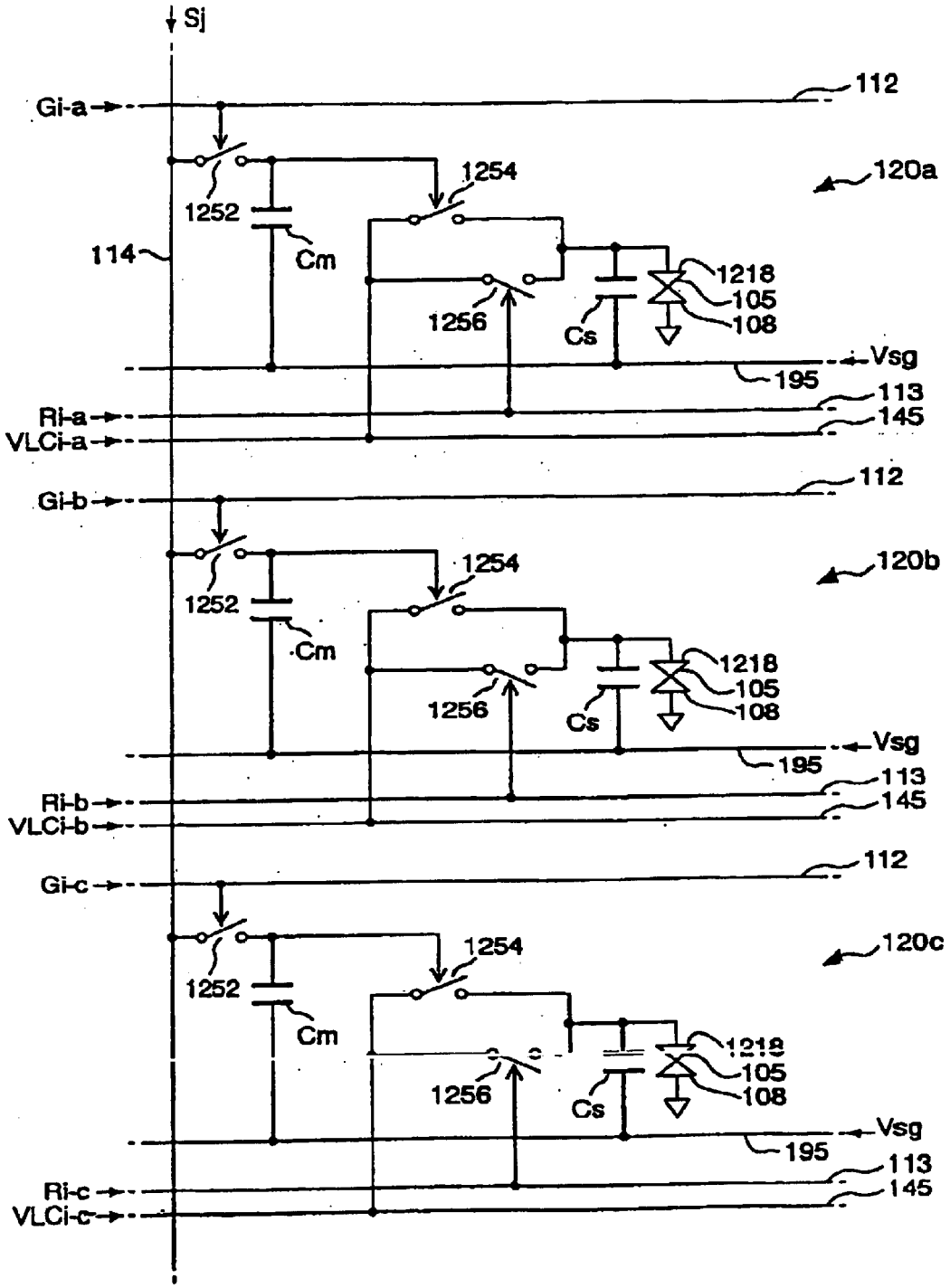
FIG. 19 is a circuit diagram showing the construction of one pixel in the electro-optical device.

The subpixels 120*a*, 120*b*, and 120*c* in the second embodiment will now be discussed in detail with reference to FIG. 19. FIG. 19 is a circuit diagram of one pixel at the i-th row and j -th column. As shown, the three subpixels 120*a*, 120*b*, and 120*c* forming the pixel at the i-th row and j-th column are electrically identical to each other (but the areas of the three subpixels are different from each other, as in the first embodiment). In the first mode, the subpixel 120*a*, which is turned on and off in response to the least significant bit of the gray scale data, is now considered. The subpixel 120*a* includes a third switch 1252, a fourth switch 1254, and a fifth switch 1256.

The third switch 1252 is turned on when the scanning signal Gi-a is driven to an active level (a high level). The third switch 1252 is configured with one terminal thereof connected to a data line 114 with which the data signal Sj is supplied, and with the other terminal thereof connected one electrode of a capacitor Cm as a storage element. The other electrode of the capacitor Cm is connected to the capacitive line 195.

The fourth switch 1254 is turned on when the voltage at the one electrode of the capacitor Cm is at a high level. The fifth switch 1256 is turned on when the signal Ri-a supplied to the display refresh control line 113 at the (i-a)-th row is driven to an active level (a high level). One terminal of the fourth switch 1254 and one terminal of the fifth switch 1256 are connected together to the third signal line 145, with which the voltage signal VLCi-a at the (i-a)-th row is supplied, while the other terminals of the fourth switch 1254 and the fifth switch 1256 are connected together to one terminal of a subpixel electrode 1218 and one terminal of a storage capacitor Cs. In this embodiment, the other ends of the storage capacitors Cs in all subpixels are all connected together to the capacitive line 195 as already discussed (see FIG. 18).

The ratio of the capacitances of the liquid crystals of the subpixels 120*a*, 120*b*, and 120*c* are approximately 1:2:4 in accordance with the area ratio of the subpixel electrodes 1218. Also, the capacitances of the capacitors Cs are set in accordance with the same ratio as in the first embodiment.

Figure 27:
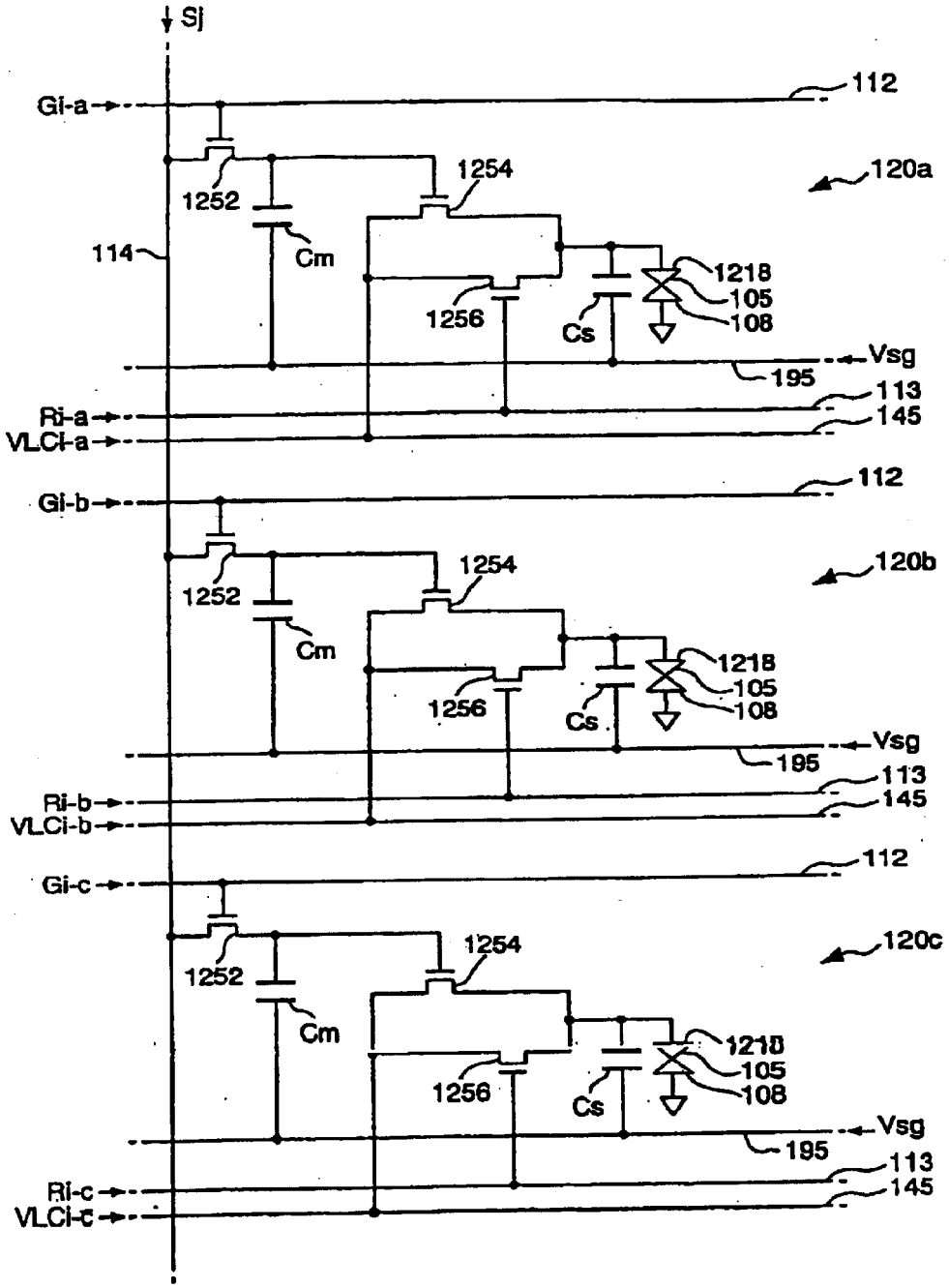
FIG. 27 is a circuit diagram showing the construction of one pixel in the electro-optical device.

In the second embodiment, the three subpixels 120*a*, 120*b*, and 120*c* are constructed as shown in FIG. 19. In practice, the third switch 1252, the fourth switch 1254, and the fifth switch 1256 are fabricated of N-channel TFTs of polysilicon as an active layer as shown in FIG. 27. In this arrangement, N-channel TFTs may be combined with P-channel TFTs in a complementary construction.

Figure 20:
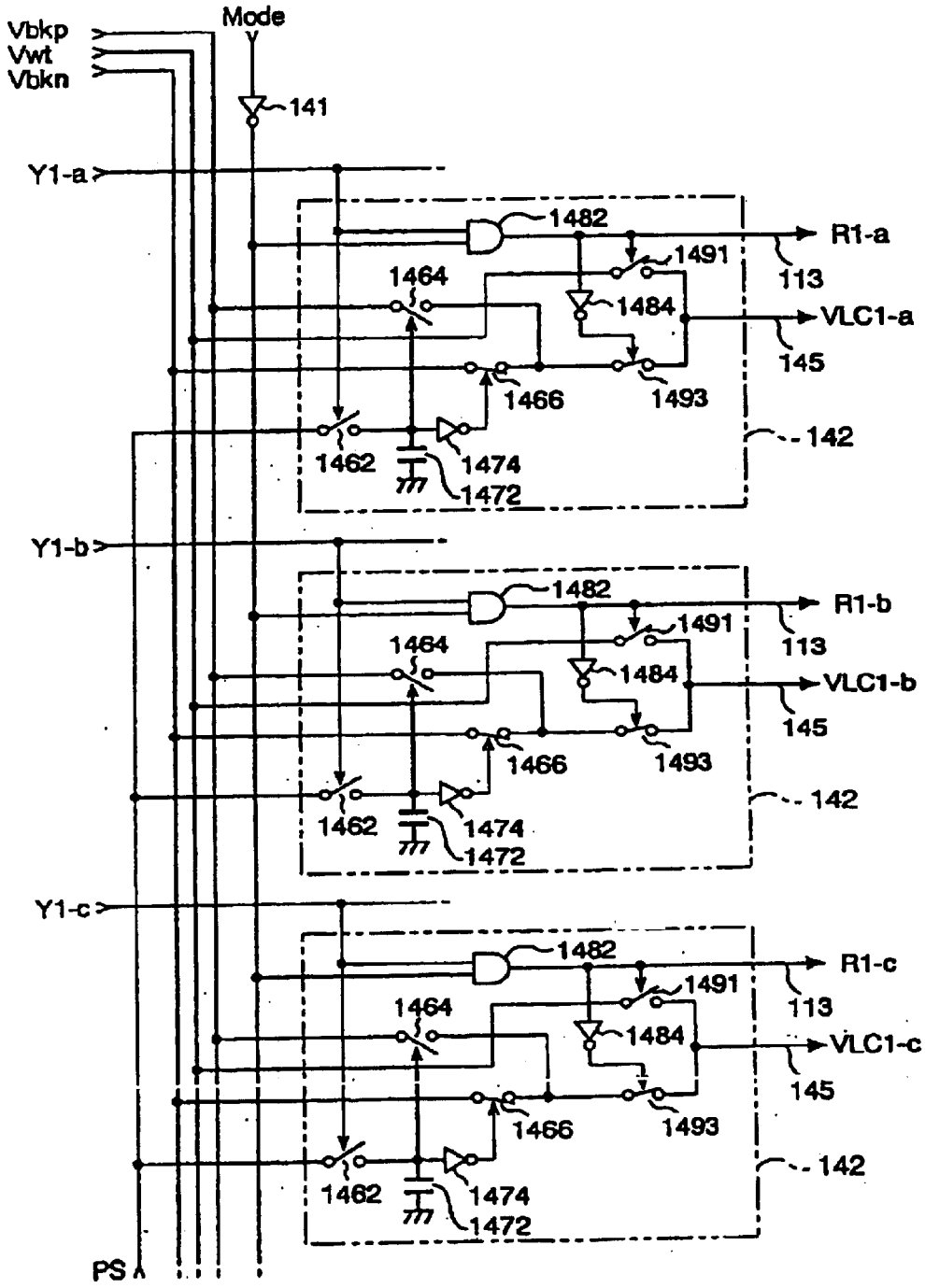
FIG. 20 is a circuit diagram showing the construction of a VLC selector in the electro-optical device.

The VLC selector 142 will be now discussed in detail with reference to FIG. 20. FIG. 20 is a circuit diagram showing the construction of the VLC selector 142. Although the VLC selectors 142 respectively correspond to the (1-*a*)-th row, the (1-*b*)-th row, and the (1-*c*)-th row, they are identical in construction. Here, the VLC selector 142 for the (1-*a*)-th row is discussed.

As shown, a switch 1462 is turned on when the scanning signal Y1-*a* output by the scanning line driving circuit 130 for that corresponding row is driven to an active level (a high level). The switch 1462 is configured with one terminal thereof connected to a signal line for the signal PS, and with the other terminal thereof connected to one terminal of a capacitor 1472, a control input terminal of a switch 1464, and an input terminal of an inverter 1474.

The other terminal of the capacitor 1472 is connected to a supply line of a voltage low in logic level. The output terminal of the inverter 1474 is connected to a control input terminal of a switch 1466. One terminal of the switch 1464 is connected to a supply line of a voltage signal Vbkp. One terminal of the switch 1466 is connected to a supply line of a voltage signal Vbkn. The other terminals of the switch 1464 and the switch 1466 are connected together to one terminal of a switch 1493.

Each of the switches 1464 and 1466 is turned on when the control input terminal thereof is driven to a high level. Since the input terminals of these switches are respectively connected to the input terminal and the output terminal of the inverter 1474, the two switches are turned on and off in an exclusive fashion. Specifically, either the voltage signal Vbkp or the voltage signal Vbkn is selected depending on the voltage held at the one terminal of the capacitor 1472, and is then supplied to the one terminal of the switch 1493.

An AND gate 1482 AND gates the scanning signal Y1-*a* and the signal Mode inverted by an inverter 141 and feeds the AND gate output signal as the signal R1-*a* to the display refresh control line 113. The AND gate output signal is supplied to a control input terminal of a switch 1491 and a control input terminal of the switch 1493 via an inverter 1484.

One terminal of the switch 1491 is connected to the supply line of the voltage signal Vwt and the other terminals of the switches 1491 and 1493 are connected together to the third signal line 145. The switches 1491 and 1493 are turned on when their control input terminals are driven to a high level, and since their control input terminals are respectively connected to the input terminal and the output terminal of the inverter 1484, the two switches are turned on and off in an exclusive fashion. Specifically, the voltage signal Vwt, or the voltage signal Vbkp, or the voltage signal Vbkn is selected depending on the level of the AND gate output signal of the AND gate 1482. The selected voltage signal is then supplied as the voltage signal VLC1-*a* to the third signal line 145.

In this arrangement, the AND gate 1482 is opened in the first mode with the signal Mode at a low level. The scanning signal Y1-*a* from the scanning line driving circuit 130 is directly output as the signal R1-*a*.

Figure 21:
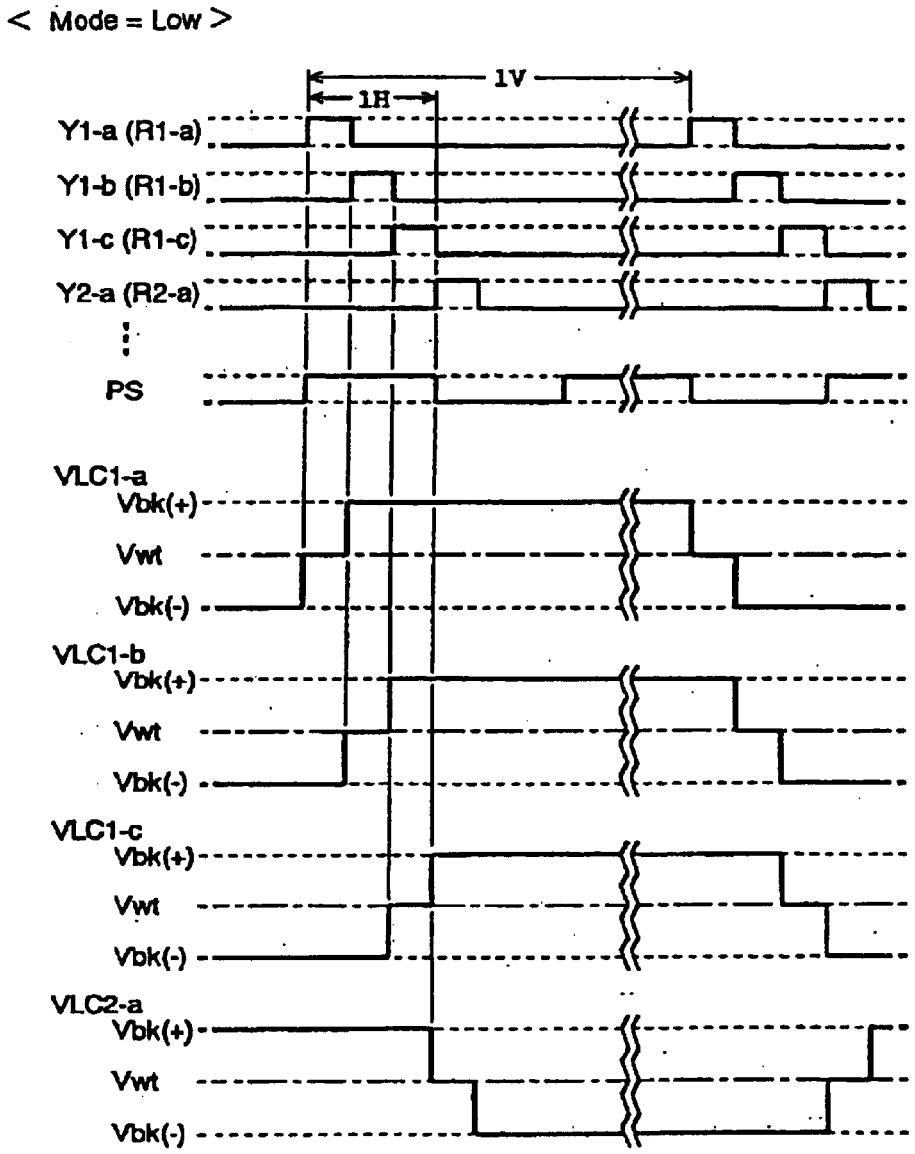
FIG. 21 is a timing diagram showing the operation of the VLC selector in the first mode, in which the signal Mode is at a low level.

The signal PS remains unchanged from that in the first embodiment. More specifically, as shown in FIG. 21, the signal PS is inverted in logic level every horizontal scanning period 1H (the period required to successively select the three scanning lines 112) in the first mode with the signal Mode at a low level. Subsequent to the one vertical scanning period, the signal PS is inverted in logic level for the next horizontal scanning period 1H during which the same three scanning lines 112 are selected.

When the scanning signal Y1-*a* is transitioned to a high level in one horizontal scanning period 1H during which the signal PS remains at a high level, the high level voltage is held at the one terminal of the capacitor 1472. The switch 1464 is turned on, while the switch 1466 is turned off. The AND gate 1482 turns on the switch 1491 while turning off the switch 1493. In the first mode, the voltage signal Vwt is thus selected as the voltage signal VLC1-1 for the period during which the scanning signal Y1-*a* remains active.

Even when the switch 1462 is turned off with the scanning signal Y1-*a* transitioned to a low level, the high level signal PS is continuously held at the one terminal of the capacitor 1472. The on and off states of the switches 1464 and 1466 are maintained. Since a low level scanning signal Y1-*a* drives the signal R1-*a* of the AND gate 1482 to a low level, the switch 1491 is turned off, and the switch 1493 is turned on. The on and off states of these switches are maintained thereafter. In the first mode, when the scanning signal Y1-*a* is transitioned to a low level in one horizontal scanning period 1H during which the signal PS remains at a high level, the voltage signal Vbkp, i.e., Vbk(+), is continuously selected as the voltage signal VLC1-*a* until the scanning signal Y1-*a* is driven back to a high level after one vertical scanning period 1V.

When the scanning signal Y1-*a* is driven back to a high level, the switch 1491 is turned on and the switch 1493 is turned off. The voltage signal Vwt is then output as VLC1-*a*. The scanning signal Y1-*a* again becomes high in level for the period during which the signal PS is at a low level as shown in FIG. 21. When the scanning signal Y1-*a* again becomes high in level, the voltage held at the one terminal of the capacitor 1472 is at a low level. The switch 1464 is turned off, and the switch 1466 is turned on. When the scanning signal Y1-*a* is transitioned to a low level in one horizontal scanning period 1H during which the signal PS is at a low level, the voltage signal Vbkn, i.e., Vbk(−), is continuously selected as the voltage signal VLC1-*a* until the scanning signal Y1-*a* is transitioned back to a high level after one vertical scanning period 1V.

The above operation is carried out in each VLC selector 142 in response to the level change in the corresponding scanning signal. As described above, in the first mode the signal PS remains unchanged in logic level during one horizontal scanning period during which the scanning signals Yi-a, Yi-b, and Yi-c are successively driven to a high level. For the period during which each of the scanning signals remains at a low level (a non-selective period in the i-th row pixel), the on voltage polarities of the voltage signals VCLi-a, VLCi-b, and VLCi-c are identical to each other, and are inverted every vertical scanning period 1V. Since the signal PS is inverted every horizontal scanning period 1H, the voltage signals Vbk(+) and Vbk(−) are alternately supplied to the third signal lines 145 every three subpixel rows.

In the first mode, the voltage signal selected and output to the third signal line 145 by the VLC selector 142 in the second embodiment is different from the voltage selected and output to the first signal line 115 by the Vbk selector 140 in the first embodiment. For example, when a given row is selected, the switching between the voltage signals Vbk(+) and Vbk(−) is directly performed in the first embodiment, while the switching between the voltage signals Vbk(+) and Vbk(−) is performed with the voltage signal Vwt selected in the midway point from Vbk(+) to Vbk(−) or from Vbk(−) to Vbk(+) in the second embodiment as can be understood from the comparison of FIG. 8(*a*) with FIG. 21.

In the second mode with the signal Mode at a high level, the AND gate 1482 in FIG. 20 is closed. The switch 1491 is fixed to be turned off, while the switch 1493 is fixed to be turned on. In the second mode, the signal PS remains unchanged from that in the first embodiment. More specifically, as shown in FIG. 22, the signal PS remains at a low level for a duration immediately prior to the scanning signal output from the scanning line driving circuit 130 shifting to a high level and for a duration immediately prior to the scanning signal output from the scanning line driving circuit 130 shifting to a low level.

In the second mode, the switch 1464 is turned off and the switch 1466 is turned on because the signal PS is transitioned to a low level immediately prior to the transitioning of the scanning signal Y1-*a* to a high level. Soon after that, the signal PS is transitioned to an high level, thereby turning on the switch 1464, and turning off the switch 1466.

Figure 22:
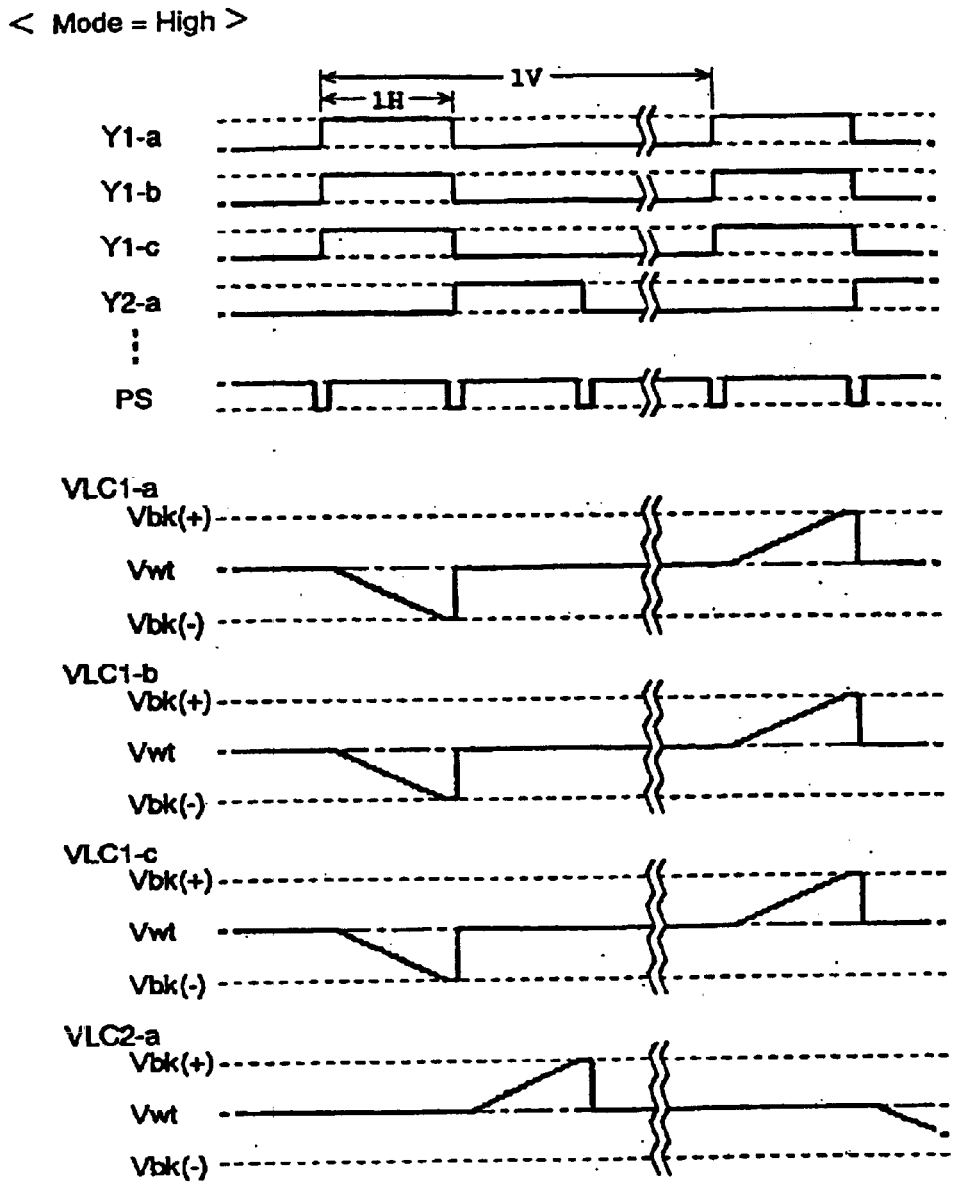
FIG. 22 is a timing diagram showing the operation of the VLC selector in the second mode, in which the signal Mode is at a high level.

The voltage signal VLC1-*a* supplied to the third signal line 145 at the (1-*a*)-th row becomes the voltage signal Vbkn(Vwt) for turning off the subpixel at the moment the scanning signal Y1-*a* is transitioned to a high level as shown in FIG. 22. Immediately after that, the voltage signal VLC1-*a* becomes the voltage signal Vbkp as the ramp voltage signal in response to the count result Q.

The signal PS is driven to a low level immediately prior to the transitioning of the scanning signal Y1-*a* to a low level, thereby turning off the switch 1464 and turning on the switch 1466. The voltage signal VLC1-*a* becomes again the voltage signal Vbkn(Vwt) and this state continues until the scanning signal Y1-*a* is driven to a high level after the one vertical scanning period 1V.

In the second mode, the voltage signal selected and output to the third signal line 145 by the VLC selector 142 in the second embodiment is identical to the voltage selected and output to the first signal line 115 by the Vbk selector 140 in the first embodiment, as understood from the comparison of FIG. 8(*b*) with FIG. 22.

The first mode operation and the second mode operation of the electro-optical device of the second embodiment are now individually discussed. The scanning line driving circuit 130 in the second embodiment remains the same as that of the first embodiment. The data line driving circuit 182 in the second embodiment is identical to the data line driving circuit 180 in the first embodiment without the circuit for data outputting for the auxiliary data line 114'. For this reason, the discussion here focuses on the display operation of the subpixel. The electro-optical device of the second embodiment also operates in a normally white mode with a white display presented with no voltage applied. The subpixel 120*a* at the (i-a)-th row and the j-th column is representatively discussed.

Discussed first is the first mode, in which the signal Mode is at a low level.

Figure 23:
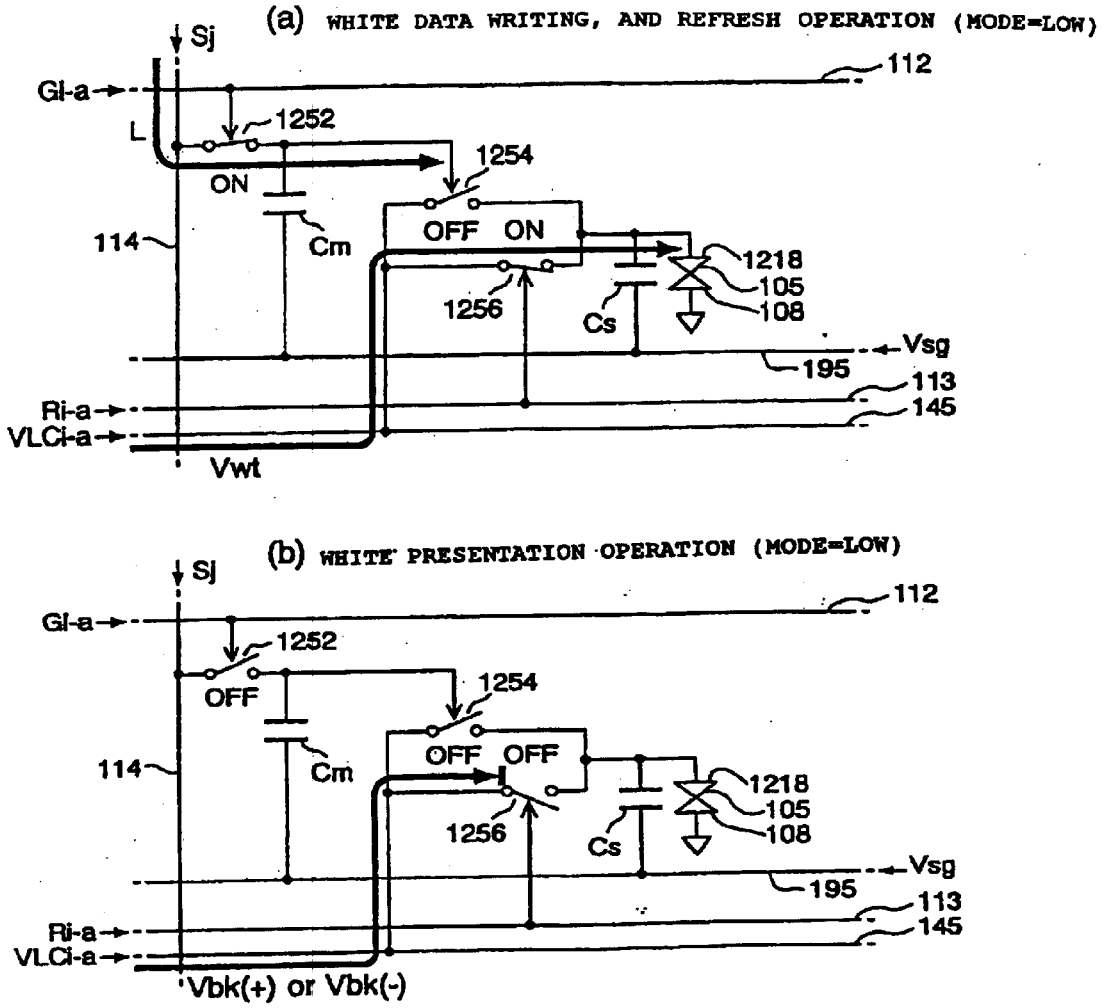
FIGS. 23(*a*) and 23(*b*) explain a white display presented by a subpixel in the first mode with the signal Mode at a low level.
Figure 24:
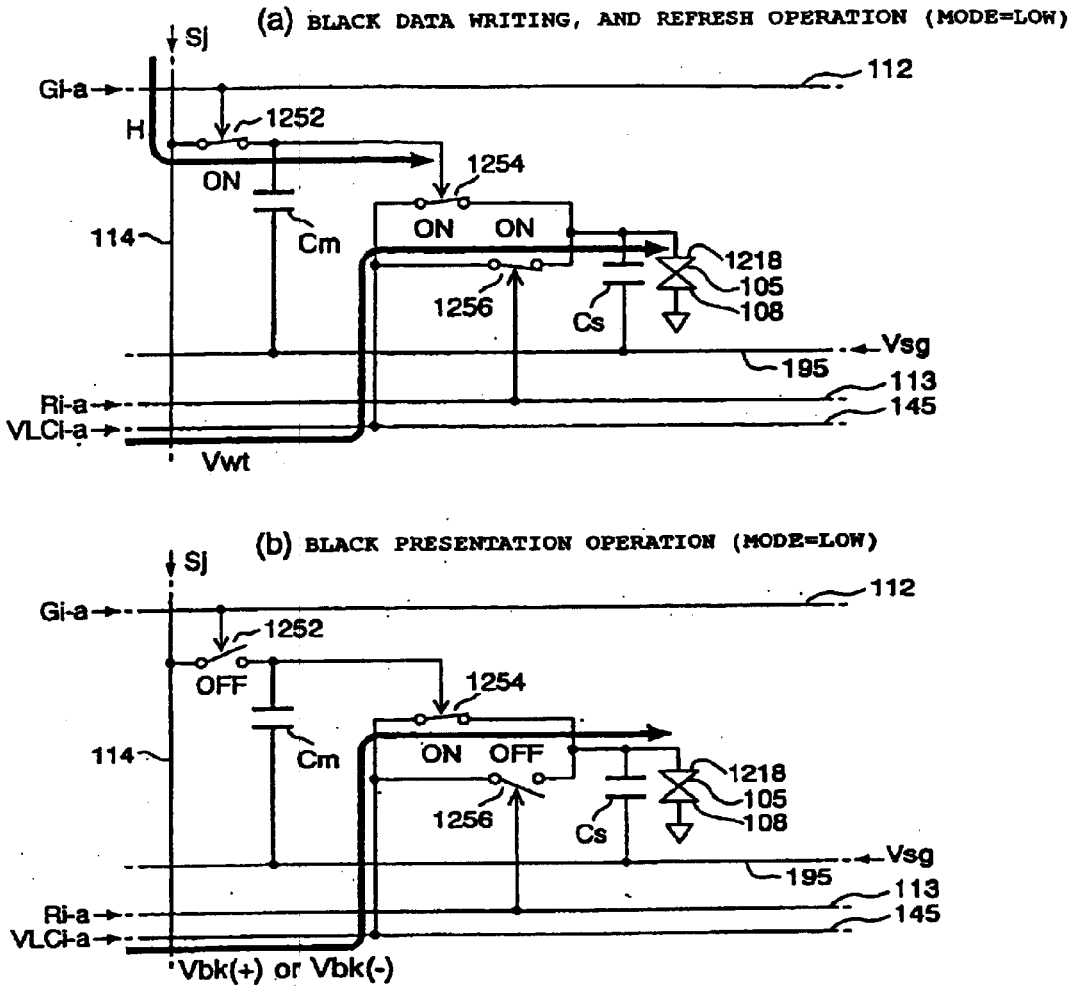
FIGS. 24(*a*) and 24(*b*) explain a black display presented by a subpixel in the first mode with the signal Mode at a low level.

When the third switch 1252 is turned on with the scanning signal Gi-a supplied to the scanning line 112 at the (i-a)-th row transitioned to an active level (a high level), the bit level of the data signal Sj supplied via the data line 114 is held at the one terminal of the capacitor Cm, and the fourth switch 1254 is turned off or on in response to the storage content of the capacitor Cm. Specifically, when the subpixel 120*a* is turned off (for a white display), a low level bit as the data signal Sj is supplied as shown in FIG. 23(*a*), and is then stored in the capacitor Cm. The fourth switch 1254 is thus turned off. To turn on the subpixel 120*a* (for a black display), a high level bit is supplied as the data signal Sj as shown in FIG. 24(*b*), and is stored in the capacitor Cm. The fourth switch 1254 is thus turned on.

When the scanning signal Gi-a is transitioned to an active level, the signal Ri-a supplied to the display refresh control line 113 is also transitioned to an active level in this embodiment. The third signal line 145 is supplied with the voltage signal Vwt as the voltage signal VLCi-a for causing the subpixel to present a white display. The voltage applied to the subpixel electrodes 1218 becomes the voltage signal Vwt for presenting a white display.

Even when the third switch 1252 is turned off in succession to the transitioning of the scanning signal Gi-a to an inactive level (a low level), the on and off state of the fourth switch 1254 is maintained by the capacitor Cm. When the scanning signal Gi-1 is transitioned to an inactive level, the third signal line 145 is supplied with one of the voltage signals Vbk(+) and Vbk(−) as the voltage signal VLCi-a for presenting a black display on the corresponding subpixel. In this embodiment, for the period during which the scanning signal Gi-a remains at an inactive level, the signal Ri-a also remains at an inactive level. The fifth switch 1256 is turned off.

For the subpixel to present a white display, the voltage signal Vwt supplied to the subpixel electrodes 1218 is continuously held by the capacitance of the liquid crystal and the subpixel electrode 1218 as shown in FIG. 23(*b*) when the signal Ri-a is transitioned to an active level. The subpixel 120*a* thus presents a white display.

For the subpixel to present a black display, the on state of the fourth switch 1254 is maintained by the capacitor Cm as shown in FIG. 24(*b*). The subpixel electrode 1218 is thus applied with one of the voltage signals Vbk(+) and Vbk(−), causing the subpixel 120*a* to present a black display.

The voltage signal VLCi-a shifts to the voltage signal Vwt at the moment the scanning signal Yi-a (Ri-a) is transitioned to an active level, and then switches alternately between the voltage signals Vbk(+) and Vbk(−) (see FIG. 21) every vertical scanning period 1V. This means that the subpixel 120*a* is driven in an alternate drive fashion.

In the first mode, the display of the subpixel is performed depending on the storage content of the capacitor Cm in this embodiment. If the white display or the black display remains unchanged on all subpixels 120*a* from the first column to the n-th column on the (i-a)-th row, there is no need to drive the scanning signal Gi-a to an active level. An external circuit may supply the signal ENB at a low level (see FIG. 18) at the moment the scanning signal Yi-a is transitioned to an active level. No voltage change occurs in the corresponding scanning line 112, no power is consumed by the scanning line 112 as a load, the third switch 1252 is not activated for switching. No additional power is thus consumed.

The display operation responsive to the storage content of the capacitor Cm is individually performed on the subpixels 120*b* and 120*c* in the first mode. A gray scale display responsive to the area ratio of the subpixels is thus performed if viewed as a single pixel.

Discussed next is the second mode, in which the signal Mode is at a low level. The scanning signal from the scanning line driving circuit 130 is directly supplied to the scanning lines 112. Since the AND gate 1482 (see FIG. 20) is closed, the signal supplied to the display refresh control line 113 continuously remains at a low level. For this reason, the fifth switch 1256 continuously remains off in the subpixel 120*a* of interest at the (i-a)-th row and the j-th column.

Figure 26:
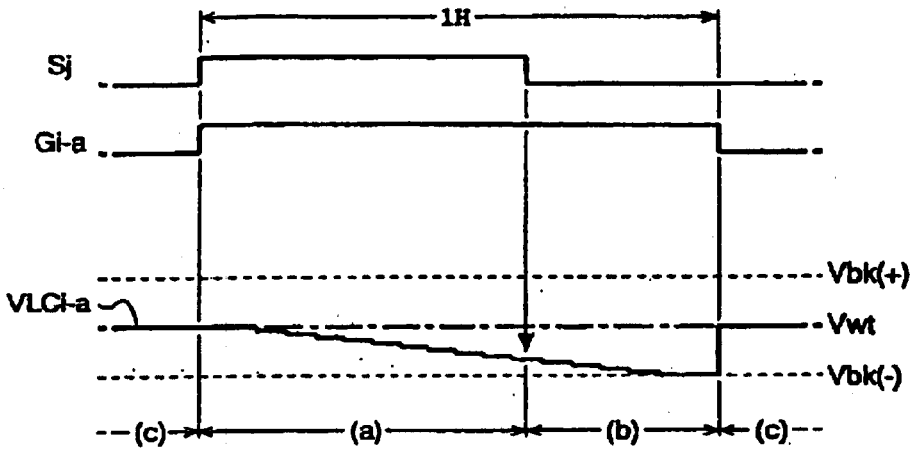
FIG. 26 is a timing diagram showing the displaying operation of the subpixel in the second mode with the signal Mode at a high level.

When the scanning signal Gi-a remains at an active level throughout one horizontal scanning period 1H in the second mode, the data signal Sj as the timing signal remains at a high level from the start of the horizontal scanning period 1H to the moment corresponding to the value of the gray scale data Data of the pixel at the i-th row and the j-th column as shown in FIG. 26. The voltage signal VLCi-a supplied to the third signal line 145 at the (i-a)-th row becomes the ramp voltage signal rising or falling with time during the one horizontal scanning period 1H throughout which the scanning signal Gi-a remains at an active level.

Figure 25:
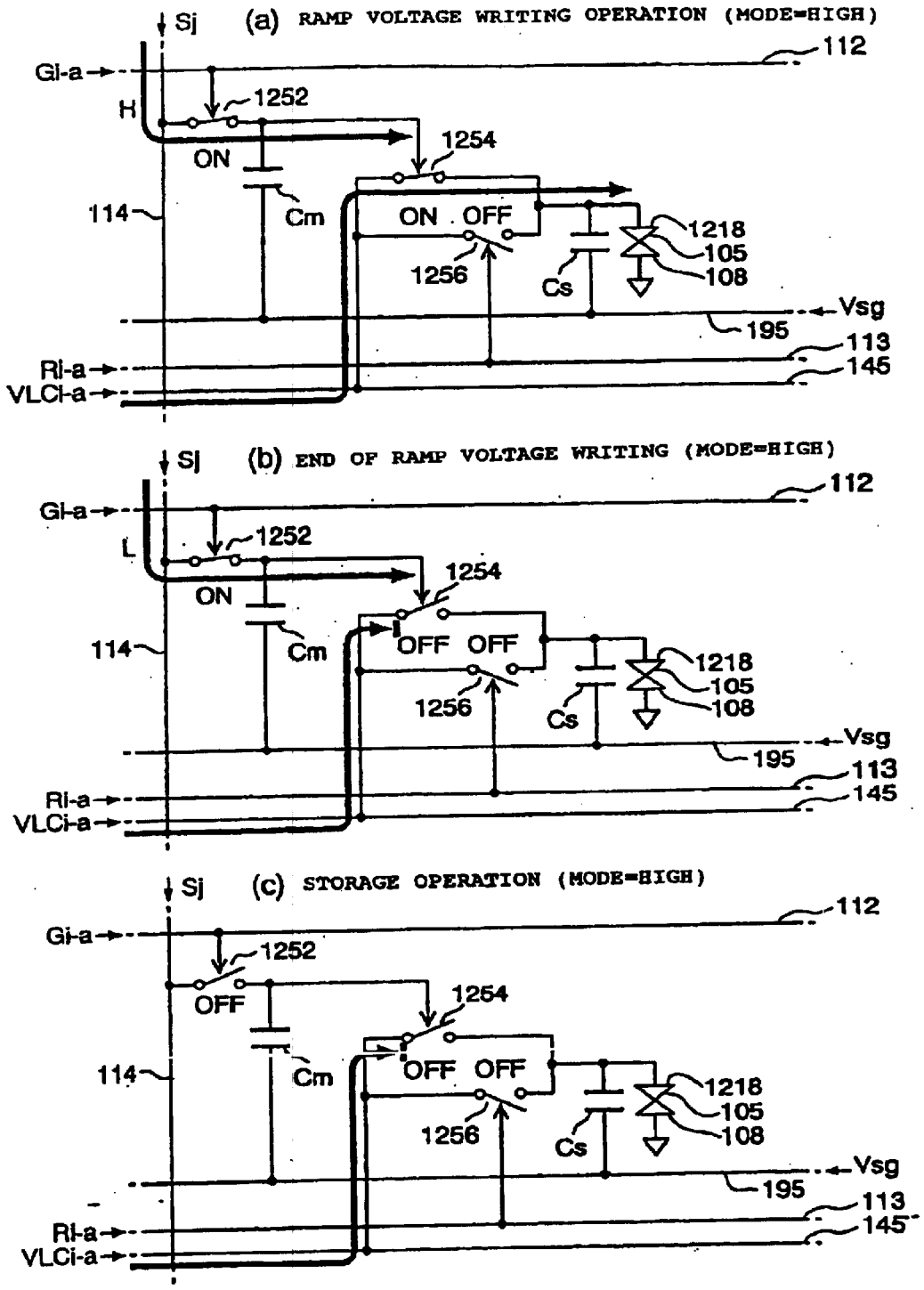
FIGS. 25(*a*), 25(*b*) and 25(*c*) explain the displaying operation of the subpixel in the second mode with the signal Mode at a high level.

For the duration of time represented by time interval (a) in FIG. 26, i.e., for the duration of time during which both the scanning signal Gi-a and the data signal Sj remain at a high level, the third switch 1252 is turned on and the fourth switch 1254 is turned on (see FIG. 25(*a*)) in the subpixel 120*a* at the (i-a)-th row and the j -th column. For this reason, in the subpixel 120*a*, the ramp voltage signal as the voltage signal VLCi-a is sampled at the subpixel electrode 1218.

For the duration of time represented by time interval (b) in FIG. 26, i.e., for the duration of time during which the scanning signal Gi-a remains at a high level with the data signal Sj as the timing signal being at a low level, the third switch 1252 is turned on and the fourth switch 1254 is turned off (see FIG. 25(*b*)). In the subpixel 120*a*, the ramp voltage signal immediately prior to the turning off of the fourth switch 1254 is sampled and held by the subpixel electrode 1218.

For the duration of time represented by time interval (c) in FIG. 26, i.e., for the duration of time during which both the scanning signal Gi-a and the data signal Sj remain at a low level, both the third switch 1252 and the fourth switch 1254 are turned off (see FIG. 25(*c*)). Since the ramp voltage signal is held by the storage capacitor Cm and the capacitance of the liquid crystal, the subpixel 120*a* maintains a density corresponding to the held voltage.

In the second mode, the scanning signals Gi-a (Yi-a), Gi-b (Yi-b), and Gi-c (Yi-c) are concurrently driven to an active level (see FIG. 22). The third switches 1252 in the respective three subpixels 120*a*, 120*b*, and 120*c* constituting a single pixel 120 are turned on and off at the same timing. The fourth switches 1254 in these subpixels are also turned on and off as the same timing. The voltage signals VLCi-a, VLCi-b, and VLCi-c supplied to the third signal lines 145 become a ramp voltage signal for a period of time during which the scanning signal Gi-a, Gi-b, and Gi-c remain at a high level. Since the subpixel electrodes 1218 at these subpixels hold identical ramp voltage signals, the three subpixels provide the same density. If viewed as a single pixel, the three subpixels thus present a gray scale display responsive to the density.

In the first mode in the electro-optical device of the second embodiment, the subpixels 120*a*, 120*b*, and 120*c* are turned on and off in response to the gray scale Data, and a gray scale display based on the area gray scale method is presented. In the second mode, a gray scale display having the same density is presented on the three subpixels 120*a*, 120*b*, and 120*c* forming each single pixel 120. The second embodiment requires only three switches per subpixel, and therefore has a construction simpler than that of the first embodiment.

In the first mode in the second embodiment, the signals Ri-a, Ri-b, and Ri-c respectively supplied to the display refresh control lines 113 at the (i-a)-th row, the (i-b)-th row, and the (i-c)-th row are driven to an active level at the same moment the scanning signals Gi-a (Yi-a), Gi-b (Yi-b), and Gi-c (Yi-c) output to the corresponding rows are respectively driven to an active level. It suffices to drive the signals Ri-a, Ri-b, and Ri-c to an active level for a constant period of time in a predetermined order.

Figure 28:
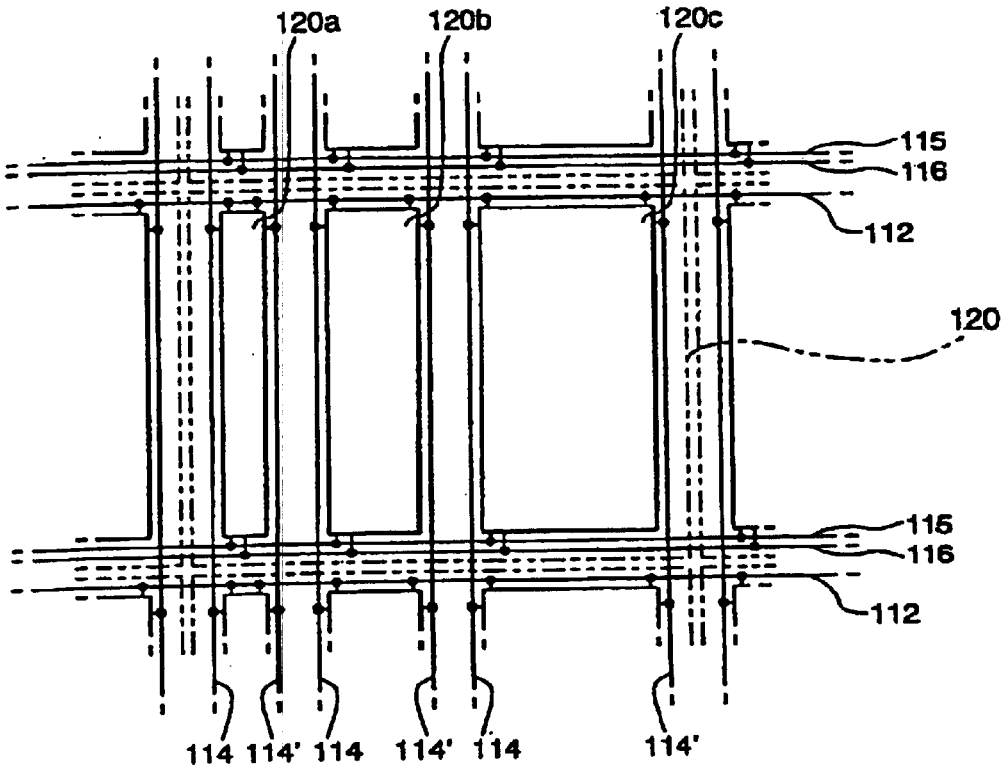
FIG. 28 is a plan view showing the layout of pixels in the electro-optical device of the present invention.

In the first and second embodiments, the subpixels 120*a*, 120*b*, and 120*c* forming each single pixel 120 are arranged in the Y direction as shown in FIG. 3. The present invention is not limited to this layout. Alternatively, the subpixels 120*a*, 120*b*, and 120*c* may be arranged in the X direction as shown in FIG. 28.

In this arrangement, however, the scanning lines 112 must supply the scanning signal to each row of pixels regardless of the first mode or the second mode. The data lines 114 (the auxiliary data line 114') supplies individually the bits a, b, and c of the gray scale data Data in one horizontal scanning period 1H in the first mode. In the second mode, the three data lines 114 corresponding to one pixel supplies the bits a, b, and c of the gray scale data Data at the same timing in one horizontal scanning period 1H.

The scanning line driving circuit 130 in the first embodiment and the second embodiment includes the shift register 132 composed of latch circuits of (3m+1) stages, the number of which is greater than three times the number of rows of the pixels 120 by one, and the scanning signal selector 134 which outputs the AND gate output provided from adjacent latches in the shift register 132 to each of the scanning lines 112 in the first mode, while tripling the active period of the AND gate output and outputting the tripled active period of the AND gate output to every three lines of the scanning lines 112 in the second embodiment. Alternatively, the scanning line driving circuit 130 may be arranged as shown in FIG. 29.

Figure 29:
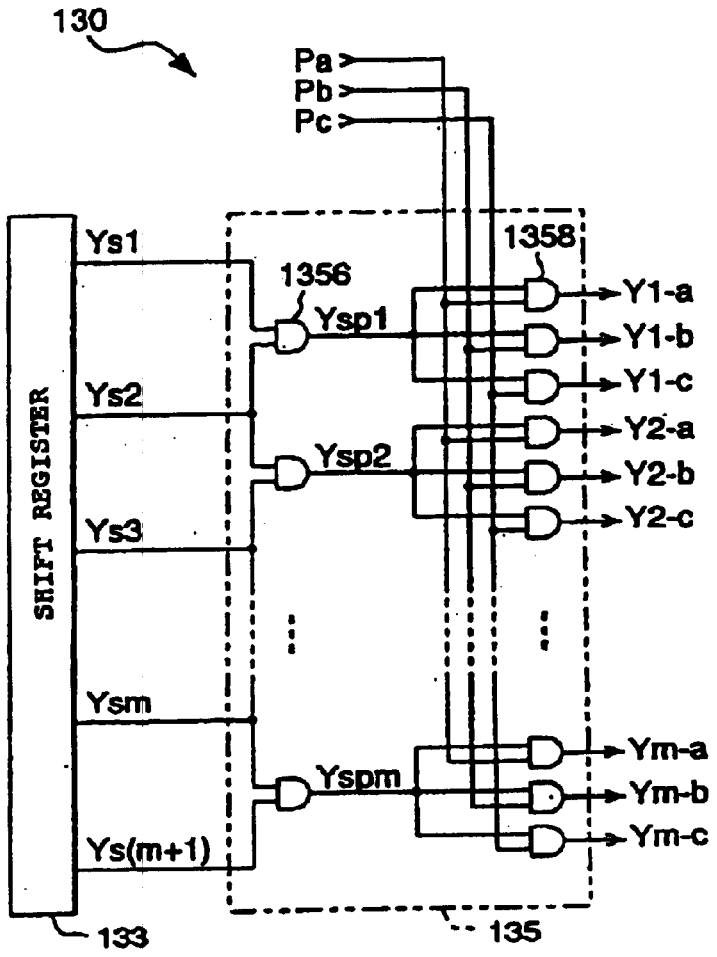
FIG. 29 is a block diagram showing another construction of the scanning line driving circuit in the electro-optical device.

The scanning line driving circuit 130 shown in FIG. 29 includes a shift register 133 composed of latches of (m+1) stages, the number of which is greater than the number of rows of the pixels 120, i.e., m, by one, and a scanning signal selector 135. The scanning signal selector 135 includes AND gates 1356 for AND gating the pulse signals output from adjacent latches in the shift register 133, and AND gates 1358 for AND gating the AND gate output pulse and each of control signals Pa, Pb, and Pc and outputting the AND gate output signal as a scanning signal.

The AND gated signal Yspi from the AND gate 1356 is commonly fed to inputs of the three AND gates 1358 corresponding to the scanning lines at the (i-a)-th row, the (i-b)-th row, and the (i-c)-th row. The other input of the AND gate 1358 at the (i-a)-th row receives the control signal Pa, the other input of the AND gate 1358 at the (i-b)-th row receives the control signal Pb, and the other input of the AND gate 1358 at the (i-c)-th row receives the control signal Pc.

Figure 30:
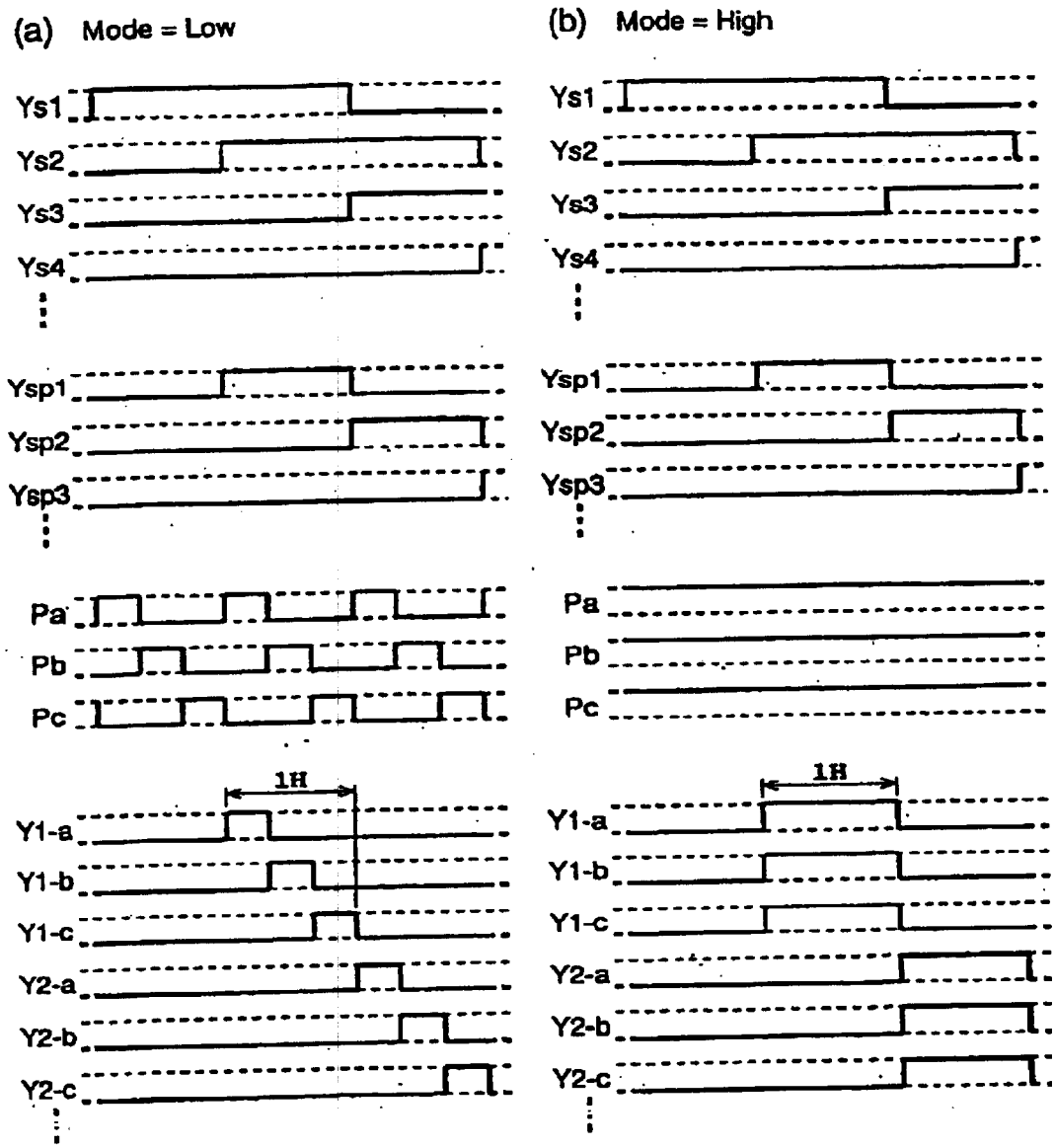
FIG. 30 is a timing diagram showing the operation of the scanning line driving circuit.

In this arrangement, the number of stages of the latches in the shift register 133 is approximately one-third the number of stages of the latches in the shift register 132. The active period of the pulse signal output from each latch circuit is extended by three times as shown in FIG. 30(*a*) and FIG. 30(*b*). The AND gated output of the pulse signals output from the adjacent latch circuits in the shift register 132, i.e., the active period of the output signal of the AND gate 1356 is also extended by three times.

In the first mode, in which the signal mode is at a low level, the control signals Pa, Pb, and Pc are pulse signals different in phase by 120° in the transfer period of the shift register as shown in FIG. 30(*a*). In response to these control signals Pa, Pb, and Pc, the active period of the output signal by the AND gate 1356 is divided into three segments to result in scanning signals not overlapping each other. The scanning signals are then respectively supplied to the scanning lines 112 at the (i-a)-th row, the (i-b)-th row, and the (i-c)-th row.

In the second mode, in which the signal mode is at a high level, the control signals Pa, Pb, and Pc are continuously high level signals as shown in FIG. 30(*b*). In this arrangement, the output signal from the AND gate 1356 is branched off into three lines, and the common signal is fed as a scanning signal to the (i-a)-th row, the (i-b)-th row, and the (i-c)-th row.

In this arrangement, the scanning signals as those in the first embodiment and the second embodiment may be respectively applied to the scanning lines 112. Since the number of stages of the shift register 133 in this arrangement is approximately one-third the number of stages of the shift register 132, the construction of the device is simple. The operational speed of this arrangement becomes one-third that of the first and second embodiment, and power consumption is thus reduced. On the other hand, the control signals Pa, Pb, and Pc needs to be generated.

In the above embodiments, the first mode presents an eight-level gray scale display based on three bit data while the second mode presents a sixteen-level gray scale display based on gray scale data. However, it is to be understood that the present invention is not limited to this arrangement. Alternatively, the same number of gray scale levels in the gray scale display may be used in the two modes. Many more number of gray scale levels may be employed. A color display may be presented by assigning the pixels to R (red), G (green), and B (blue) colors.

In the discussion of the above embodiments, a normally white mode is employed which presents a white display with the subpixels turned off (and presents a black display with the subpixels turned on). Alternatively, a normally black mode may be employed which presents a black display with the subpixels turned off (and presents a white display with the subpixels turned on).

In the above-referenced embodiments, glass substrates are employed for the element substrate 101. The element substrate 101 may be produced using a silicon monocrystal layer formed on an insulator substrate fabricated of sapphire, quartz, or glass and a variety of elements may be embedded on the silicon monocrystal layer using the SOI (Silicon On Insulator) technology. A silicon substrate may be used for the element substrate 101, and a variety of elements may be formed thereon. Since field-effect transistors may be employed as switches in this case, high-speed operation becomes possible. When the element substrate 101 has no transparency, the subpixel electrode 1218 may be fabricated of aluminum, or a separate reflective layer, and the liquid-crystal device may be used as a reflective type display.

Employed as the liquid crystal, besides the TN type, may be a BTN (Bistable Twisted Nematic) type/ferroelectric type employing a bistable twisted nematic liquid crystal having memory, a polymer dispersed type, a guest-host type in which a dye (guest) having anisotropy in the absorption of visible light in the minor axis and the major axis of molecules is dissolved in a liquid crystal (host) having a predetermined molecular arrangement and the dye molecules and the liquid-crystal molecules are arranged in parallel.

Perpendicular alignment (homeotropic alignment) may be arranged in which the liquid-crystal molecules are perpendicularly aligned with respect to the two substrates with no voltage applied, and aligned in parallel to the two substrates with a voltage applied. On the other hand, parallel (planar) alignment (homogeneous alignment) may be arranged in which the liquid-crystal molecules are aligned in parallel to the two substrates with no voltage applied, and are perpendicularly aligned to the two substrates with a voltage applied. The present invention may be applied to a variety of liquid crystals having various alignment methods.

Besides the liquid-crystal device, the present invention is applied to a diversity of electro-optical devices including electroluminescences (EL), or the electro-optical effect based on fluorescence by plasma emission or electron emission. In this case, the electro-optical materials may include EL, a mirror device, gas, fluorescent materials, etc. When the EL is used as an electro-optical material, the EL is interposed between the subpixel electrode 1218 and the counter electrode of the transparent, electrically conductive layer, and the counter substrate 102 is thus dispensed with.

The present invention is thus applicable to electro-optical devices having a construction similar to the ones discussed above.

Several specific examples of electronic apparatus using the above-described liquid-crystal device are now discussed.

Figure 31:
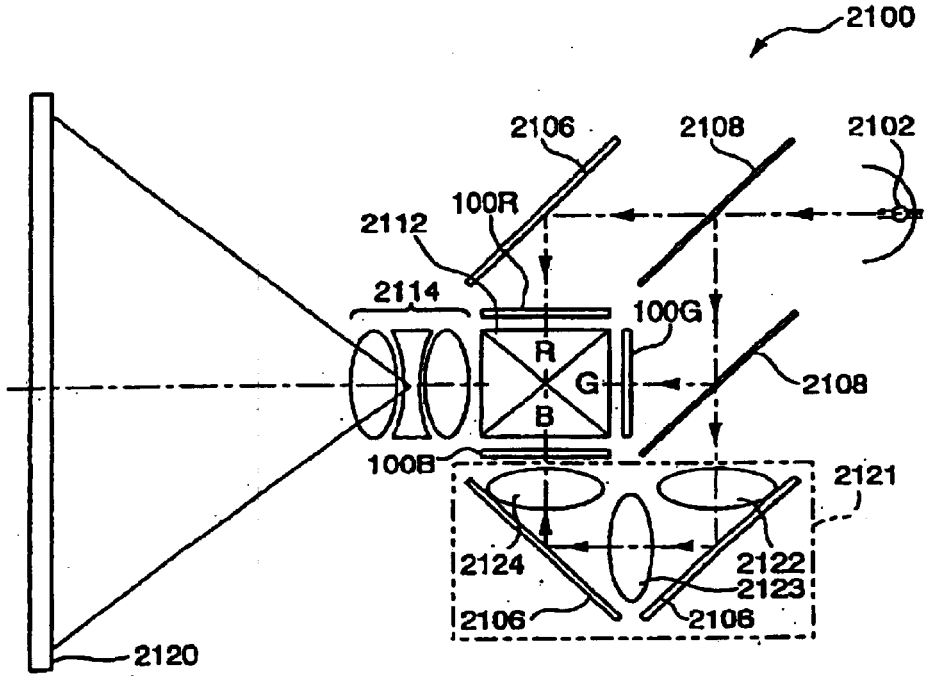
FIG. 31 shows the construction of a projector as electronic apparatus in which the electro-optical device of each of the embodiments is incorporated.

For example, a projector that uses the electro-optical device 100 of each of the above embodiments as a light valve. FIG. 31 is a plan view showing the projector 2100 including a lamp unit 2102 composed of a white-light source such as a halogen lamp. The light beam projected from the lamp unit 2102 is separated into three RGB color beams through internally arranged three mirrors 2106 and two dichroic mirrors 2108. The three color light beams are then guided to respective light valves 100R, 100G, and 100B. The light valves 100R, 100G, and 100B can be identical in construction to the electro-optical device 100 of each of the above-referenced embodiments. Each of the light valves 100R, 100G, and 100B is driven by the primary three R, G, and B color signals supplied from processing circuits (not shown) receiving a video signal. The blue color beam travels along a path longer than those for the red and green color beams. To prevent loss, the blue color beam is guided through a relay lens system 2121, composed of an incident lens 2122, a relay lens 2123, and an exit lens 2123.

The red, green, and blue light beams respectively color-modulated by the electro-optical devices 100R, 100G, and 100B are incident on a dichroic prism 2112 in three directions. The red and blue color beams are refracted at 90° by the dichroic prism 2112, while the green color beam travels straight. The three color images are synthesized, and a synthesized color image is then projected by a projection lens 2114 onto a screen 2120.

Since the three primary color beams are incident on the light valves 100R, 100G, and 100B through the dichroic mirrors 2108, the light valves 100R, 100G, and 100B need no color filters.

Figure 32:
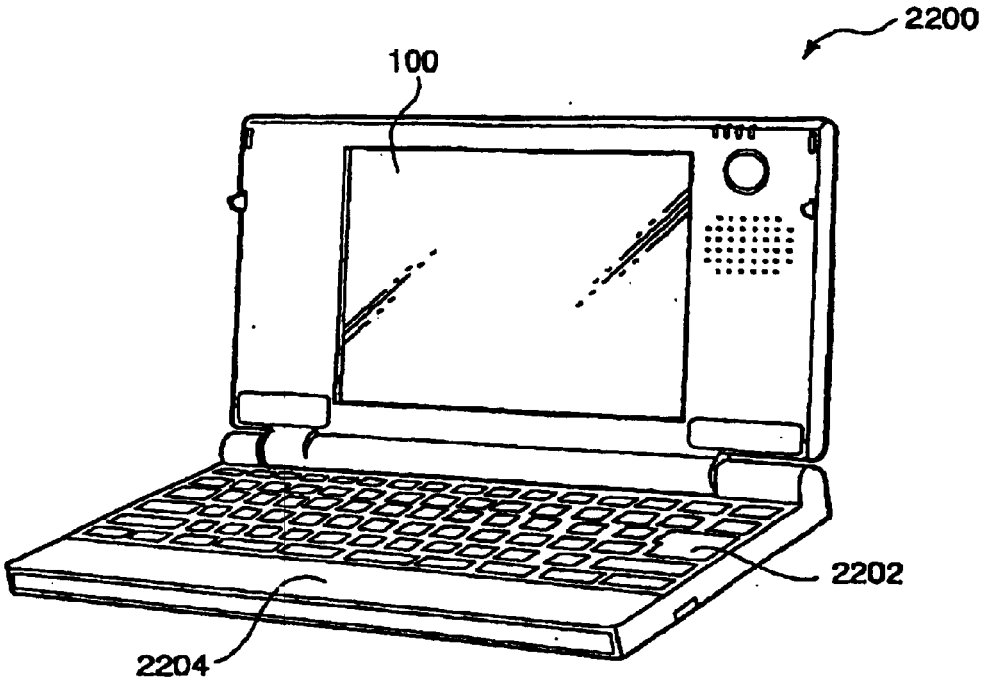
FIG. 32 is a perspective view showing a personal computer as electronic apparatus in which the electro-optical device of each of the embodiments is incorporated.

Further, a mobile computer incorporating the above-referenced electro-optical device 100 is described. FIG. 32 is a perspective view of the construction of the mobile computer. The computer 2200 includes a main unit 2204 having a keyboard 2202, and the electro-optical device 100 as a display unit. The mobile computer can include a back light unit (not shown) for higher visibility.

Figure 33:
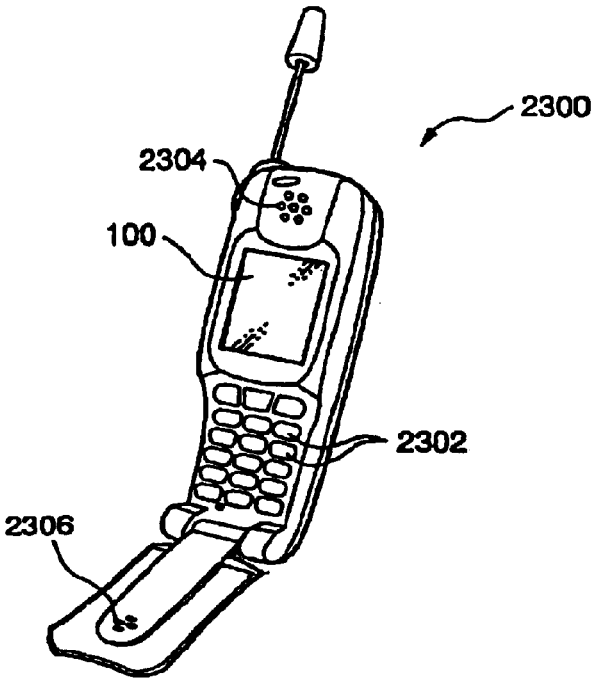
FIG. 33 is a perspective view showing a mobile telephone as electronic apparatus in which the electro-optical device is incorporated.

Additionally, a mobile telephone incorporating the above-referenced electro-optical device 100 is described. FIG. 33 is a perspective view of the mobile telephone. As shown, the mobile telephone 2300 includes a plurality of control buttons 2302, a earpiece 2304, a mouthpiece 2306, and the electro-optical device 100. In this arrangement, the first mode can preferably be selected in a standby state, and the second mode can preferably be selected in a busy state. The liquid-crystal panel 100 on the back thereof can also provided with a back light unit (not shown) for higher visibility.

Besides the electronic apparatus described with reference to FIG. 31 through FIG. 33, the electronic apparatus of the present invention can be used with any of the diversity of electronic apparatus that require the display of information, including a liquid-crystal display television, a viewfinder type or direct monitoring type video cassette recorder, a car navigation system, a pager, an electronic pocketbook, an electronic tabletop calculator, a word processor, a workstation, a video phone, a POS terminal, and an apparatus having a touch panel. These pieces of electronic apparatus may incorporate the electronic devices of the above embodiment and modifications.

In accordance with the present invention, a high-quality display free from non-uniformities is presented because the data line is not provided with an analog signal regardless of the first mode or the second mode.

While this invention has been described in conjunction with specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention.

What is claimed is:

1. A driving method for driving an electro-optical device in which a plurality of subpixels are arranged corresponding to intersections of a plurality of scanning lines and a plurality of data lines, the method comprising:

a first mode, and a second mode, supplying a first scanning signal to first subpixels among the plurality of subpixels at a time in the first mode, the first scanning signal controlling a switch included in each of the first subpixels to turn each of the first subpixels on or off in response to gray scale data indicating the gray scale of a pixel, supplying a second scanning signal to second subpixels among the plurality of subpixels at a time in the second mode, the second scanning signal controlling a switch included in each of the second subpixels to supply a substantially identical voltage to each of the second subpixels in response to gray scale data indicating the gray scale of the pixel, the number of the first subpixels being different from the number of the second subpixels, turning a first switch of a subpixel on or off in response to a signal supplied to a corresponding scanning line, storing in a storage element of the subpixel the storage content corresponding to the signal level at a corresponding data line when the first switch is turned on, selecting with a second switch of the subpixel between a first signal line and a second signal line in response to the storage content of the storage element in the first mode, while sampling, in the second mode, the voltage applied to the first signal line at the timing of the gray scale data of the one pixel of the subpixels during the on period of the first switch, and receiving at a subpixel electrode the voltage selected or sampled by the second switch.

2. The driving method according to claim 1, each of the first subpixels being set to any one of on-state and off-state.

3. The driving method according to claim 1, refreshing being not carried out except when a subpixel of the plurality of subpixels changes its state.

4. The driving method according to claim 1, the first mode including a reset step for making a subpixel of the plurality of subpixels a predetermined state.

5. The driving method according to claim 1, further comprising inverting on-polarity of a subpixel of the plurality of subpixels with respect to a reference level.

6. The driving method according to claim 1, in the second mode, supplying a time-varied voltage to a respective subpixel of the plurality of subpixels in response to a scanning signal supplied to the respective subpixel.

7. The driving method according to claim 1, each of the plurality of scanning lines being selected on a line by line basis in the first mode, and two or more scanning lines of the plurality of scanning lines being selected simultaneously in the second mode.

8. The driving method according to claim 7, a polarity of the voltage supplied to a subpixel of the plurality of subpixels being inverted with respect to a reference level each time a scanning signal is supplied.

9. A driving circuit for driving an electro-optical device, the driving circuit comprising:

a scanning line driving circuit that supplies a first scanning signal through a scanning line among a plurality of scanning lines at a time in a first mode to turn each of a set of subpixels on or off in response to gray scale data indicating the gray scale of a pixel and that supplies a second scanning signal through two or more scanning lines among the plurality of scanning lines at a time in a second mode to supply a substantially identical voltage to a set of subpixels in response to gray scale data indicating the gray scale of the pixel, the first scanning signal and the second scanning signal controlling switches each of which is included in a respective subpixel of a plurality of subpixels of the electro-optical device, wherein the subpixel comprises:

a first switch which is turned on or off in response to a signal supplied to a corresponding scanning line, a storage element for storing the content corresponding to the signal level at a corresponding data line when the first switch is turned on, a second switch that selects between the first signal line and the second signal line in response to the storage content of the storage element in the first mode, while sampling, in the second mode, the voltage applied to the first signal line at the timing of the gray scale data of the one pixel of the subpixels during the on period of the first switch, and a subpixel electrode that receives the voltage selected or sampled by the second switch.

10. The driving circuit according to claim 9, further comprising an enable circuit, the enable circuit disabling the selection of a scanning line corresponding to a subpixel of which the state does not change among the plurality of scanning lines.

11. A driving circuit according to claim 9, a pulse width of the second scanning signal being wider than that of the first scanning signal.

12. The driving circuit according to claim 9, further comprising a data line driving circuit that supplies a data signal corresponding to any one of on-state and off-state of each of the plurality of the subpixels in the first mode.

13. The driving circuit according to claim 9, the first scanning signal supplied through a respective scanning line of the plurality of scanning lines does not overlap each other in the axis of time.

14. The driving circuit according to claim 9, further comprising a data line driving circuit that supplies a data signal corresponding to any one of on-state and off-state of each of the plurality of the subpixels in the first mode, and the data line driving circuit outputting a timing signal for sampling a time-varied voltage in the second mode.

15. The driving circuit according to claim 9, the driving circuit supplying a binary signal to a subpixels of the electro-optical device in the first mode, and the driving circuit supplying a timing signal for sampling a time-varied voltage in the second mode.

16. An electro-optical device comprising:

a plurality of scanning lines;

a plurality of data lines; and a plurality of subpixels which are arranged corresponding to intersection of the plurality of scanning lines and the plurality of data lines, first subpixels among the plurality of subpixels receiving a first scanning signal at a time in the first mode to turn each of the first subpixels on or off in response to gray scale data indicating the gray scale of a pixel, the first scanning signal controlling a switch included in each of the first subpixels, second subpixels among the plurality of subpixels receiving a second scanning signal at a time in the second mode to supply a substantially identical voltage to each of the second subpixels in response to gray scale data indicating the gray scale of the pixel, the second scanning signal controlling a switch included in each of the second subpixels, and the number of the first subpixels being different from the number of the second subpixels.

17. An electro-optical device comprising:

a plurality of scanning lines;

a plurality of data lines;

a plurality of subpixels which are arranged corresponding to intersection of the plurality of scanning lines and the plurality of data lines, first subpixels among the plurality of subpixels receiving a first scanning signal at a time in the first mode, the first scanning signal controlling a switch included in each of the first subpixels, second subpixels among the plurality of subpixels receiving a second scanning signal at a time in the second mode, the second scanning signal controlling a switch included in each of the second subpixels;

the number of the first subpixels being different from the number of the second subpixels; and a first signal line that transmits a voltage for turning on a subpixel in the first mode while transmitting a time-varied voltage in the second mode, and a second signal line that transmits a voltage for turning off the subpixel in at least the first mode, wherein the subpixel comprises:

a first switch which is turned on or off in response to a signal supplied to a corresponding scanning line, a storage element for storing the content corresponding to the signal level at a corresponding data line when the first switch is turned on, a second switch that selects between the first signal line and the second signal line in response to the storage content of the storage element in the first mode, while sampling, in the second mode, the voltage applied to the first signal line at the timing of the gray scale data of the one pixel of the subpixels during the on period of the first switch, and a subpixel electrode that receives the voltage selected or sampled by the second switch.

18. The electro-optical device according to claim 17, wherein each subpixel includes a storage capacitor for storing the voltage received by the subpixel electrode.

19. The electro-optical device according to claim 18, wherein the storage capacitor is configured with a first terminal thereof connected to the subpixel electrode and with a second terminal thereof connected to a constant-potential signal line.

20. The electro-optical device according to claim 19, wherein the second signal line transmits a voltage for turning off the subpixel even in the second mode, and is used as the constant-potential signal line.

21. The electro-optical device according to claim 18, wherein the storage capacitor accounts for the area of the subpixel electrode.

22. The electro-optical device according to claim 17, wherein the storage element includes a single capacitor, and is applied across the two terminals thereof with voltages having mutually opposite signal levels in the first mode.

23. The electro-optical device according to claim 17, wherein the storage element includes two capacitors which store mutually opposite charges in the first mode, and the first side electrodes of the two capacitors are both connected to a constant-potential signal line.

24. The electro-optical device according to claim 23, wherein the second signal line transmits a voltage for turning off the subpixel even in the second mode, and is used as the constant-potential signal line.

25. The electro-optical device according to claim 17, wherein the subpixel comprises:

a logic element for controlling the second switch, wherein a first supply line for supplying the logic element with a low voltage of a power source and a second supply line for supplying the logic element with a high voltage of the power source are alternately arranged in a direction parallel with the scanning line or the data line.

26. The electro-optical device according to claim 17, the first switch being a complementary element.

27. The electro-optical device according to claim 17, the second switch being a complementary element.

28. The electro-optical device according to claim 17, both the first switch and the second switch being complementary elements.

29. The electro-optical device according to claim 17, further comprising:

a display refresh control line provided at each row for supplying a refresh command signal that refreshes the on and off state of the subpixel in the first mode; and a signal line which is provided at each row and supplied with an off voltage signal that turns off the subpixel when the refresh command is given to a corresponding row, while an on voltage signal for turning on the subpixel when the refresh command is not given in the first mode, while, in the second mode, being supplied with a time-varied ramp voltage signal when a corresponding row scanning line is selected, wherein the subpixel comprises:

a third switch configured with one terminal thereof connected to the data line of a corresponding column, and turned on when the scanning line on a corresponding row is selected;

a storage element that stores a signal level at the other terminal of the third switch;

a fourth switch configured with one terminal thereof connected to the signal line at the corresponding row and turned on and off in response to the signal level at the other terminal of the third switch;

a fifth switch configured with one terminal thereof connected to the signal line at the corresponding row and turned on when the refresh command is given to the corresponding row; and a subpixel electrode commonly connected to the other terminals of the fourth switch and the fifth switch.

30. The electro-optical device according to claim 29, each subpixel including a storage capacitor that stores a voltage applied to the subpixel electrode.

31. The electro-optical device according to claim 30, the storage capacitor being configured with one terminal thereof connected to the subpixel electrode and with the other terminal thereof connected to a constant-potential signal line.

32. The electro-optical device according to claim 30, wherein the storage capacitor accounts for the area of the subpixel electrode.

33. Electronic apparatus comprising an electro-optical device according to claim 17.

34. A driving method for driving an electro-optical device in which a plurality of subpixels are arranged corresponding to intersections of a plurality of scanning lines and a plurality of data lines, the method comprising:

a first mode, and a second mode, supplying a binary signal to each of the plurality of subpixels in the first mode to turn each of the first subpixels on or off in response to gray scale data indicating the gray scale of a pixel, and supplying a substantially identical voltage to a set of subpixels selected from the plurality of subpixels in the second mode, the set of subpixels constituting one pixel, and the one pixel displaying a gray scale according to the substantially identical voltage, turning a first switch of a subpixel on or off in response to a signal supplied to a corresponding scanning line, storing in a storage element of the subpixel the storage content corresponding to the signal level at a corresponding data line when the first switch is turned on, selecting with a second switch of the subpixel between a first signal line and a second signal line in response to the storage content of the storage element in the first mode, while sampling, in the second mode, the voltage applied to the first signal line at the timing of the gray scale data of the one pixel of the subpixels during the on period of the first switch, and receiving at a subpixel electrode the voltage selected or sampled by the second switch.

35. A driving circuit for driving an electro-optical device in which a plurality of subpixels are arranged corresponding to intersections of a plurality of scanning lines and a plurality of data lines, the driving circuit comprising:

a data line driving circuit that supplies a binary signal corresponding to any one of on-state and off-state of each of the plurality of the subpixels in the first mode to turn each of the first subpixels on or off in response to gray scale data indicating the gray scale of a pixel, and the data line driving circuit supplying a substantially identical voltage to a set of subpixels selected from the plurality of subpixels in the second mode, the set of subpixels constituting one pixel, and the one pixel displaying a gray scale according to the substantially identical voltage, wherein a subpixel comprises:

a first switch which is turned on or off in response to a signal supplied to a corresponding scanning line, a storage element for storing the content corresponding to the signal level at a corresponding data line when the first switch is turned on, a second switch that selects between the first signal line and the second signal line in response to the storage content of the storage element in the first mode, while sampling, in the second mode, the voltage applied to the first signal line at the timing of the gray scale data of the one pixel of the subpixels during the on period of the first switch, and a subpixel electrode that receives the voltage selected or sampled by the second switch.

36. An electro-optical device, comprising:

a plurality of scanning lines;

a plurality of data lines; and a plurality of subpixels which are arranged corresponding to the intersection of the plurality of scanning lines and the plurality of data lines, a binary signal being supplied to each of the plurality of subpixels in the first mode to turn each of the first subpixels on or off in response to gray scale data indicating the gray scale of a pixel, and a substantially identical voltage being supplied to a set of subpixels selected from the plurality of subpixels in the second mode, the set of subpixels constituting one pixel, and the one pixel displaying a gray scale according to the substantially identical voltage; and wherein a subpixel comprises:

a first switch which is turned on or off in response to a signal supplied to a corresponding scanning line, a storage element for storing the content corresponding to the signal level at a corresponding data line when the first switch is turned on, a second switch that selects between the first signal line and the second signal line in response to the storage content of the storage element in the first mode, while sampling, in the second mode, the voltage applied to the first signal line at the timing of the gray scale data of the one pixel of the subpixels during the on period of the first switch, and a subpixel electrode that receives the voltage selected or sampled by the second switch.

* * * * *